US007420576B2

(12) United States Patent
Takeuchi et al.

(10) Patent No.: US 7,420,576 B2
(45) Date of Patent: Sep. 2, 2008

(54) DISPLAY APPARATUS AND DISPLAY DRIVING METHOD FOR EFFECTIVELY ELIMINATING THE OCCURRENCE OF A MOVING IMAGE FALSE CONTOUR

(75) Inventors: Masanori Takeuchi, Kawasaki (JP); Masaya Tajima, Kawasaki (JP); Yutaka Chiaki, Kawasaki (JP); Shunji Ohta, Kawasaki (JP); Akira Yamamoto, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 765 days.

(21) Appl. No.: 10/807,252

(22) Filed: Mar. 24, 2004

(65) Prior Publication Data

US 2004/0263541 A1 Dec. 30, 2004

(30) Foreign Application Priority Data

Jun. 30, 2003 (JP) ..... 2003-187702

(51) Int. Cl.
*G09G 5/10* (2006.01)

(52) U.S. Cl. ..... 345/691; 345/690; 345/692

(58) Field of Classification Search ..... 345/60–69, 345/690, 204, 589, 59, 692, 87, 89, 72, 596, 345/600, 473, 82, 76, 94, 208, 211; 315/169.4; 359/618, 501, 507, 527; 313/483, 586; 701/211; 348/346; 235/462.42, 462.11, 462.07; 600/173, 600/544; 382/275, 166; 710/13
See application file for complete search history.

(56) References Cited

U.S. PATENT DOCUMENTS 4,739,411 A * 4/1988 Bolton ..... 348/346
5,474,081 A * 12/1995 Livingstone et al. ..... 600/544
5,756,981 A * 5/1998 Roustaei et al. ..... 235/462.42
6,036,637 A * 3/2000 Kudo ..... 600/173
6,144,364 A 11/2000 Otobe et al.
6,208,467 B1 * 3/2001 Naka et al. ..... 359/618
6,304,238 B1 * 10/2001 Tsuchida ..... 345/87
6,414,658 B1 * 7/2002 Tokunaga ..... 345/63
6,477,588 B1 * 11/2002 Yerazunis et al. ..... 710/13
6,496,194 B1 * 12/2002 Mikoshiba et al. ..... 345/596
6,512,854 B1 * 1/2003 Mucci et al. ..... 382/275
6,541,914 B1 * 4/2003 Ahn ..... 313/586
6,646,625 B1 * 11/2003 Shigeta et al. ..... 345/63

(Continued)

FOREIGN PATENT DOCUMENTS

JP 10-031455 2/1998

(Continued)

*Primary Examiner*—Prabodh Dharia
(74) *Attorney, Agent, or Firm*—Staas & Halsey LLP

(57) ABSTRACT

A display apparatus displaying gray scale by using a subfield method has a gain control circuit, a sub gain control circuit, and an error diffusion circuit. The gain control circuit has the number of gray scale levels of an input signal and outputting a first intermediate image signal with a first number of gray scale levels, and the sub gain control circuit receives the first intermediate image signal, compresses the number of gray scale levels of the first intermediate image signal, and outputs a second intermediate image signal with a second number of gray scale levels. The error diffusion circuit receives the second intermediate image signal and increase the number of gray scale levels by simulating additional gray scale levels through error diffusion.

4 Claims, 60 Drawing Sheets

U.S. PATENT DOCUMENTS

| | | | | |
|---|---|---|---|---|
| 6,690,388 | B2 * | 2/2004 | Kasahara et al. | 345/690 |
| 6,741,227 | B2 * | 5/2004 | Naka et al. | 345/72 |
| 6,919,892 | B1 * | 7/2005 | Cheiky et al. | 345/473 |
| 6,950,551 | B2 * | 9/2005 | Murashita et al. | 382/166 |
| 6,989,824 | B1 * | 1/2006 | Ishii et al. | 345/204 |
| 7,138,967 | B2 * | 11/2006 | Kimura | 345/76 |
| 7,209,152 | B2 * | 4/2007 | Chiaki et al. | 345/692 |
| 7,212,178 | B2 * | 5/2007 | Ishii et al. | 345/66 |
| 7,256,755 | B2 * | 8/2007 | Ohta et al. | 345/68 |
| 2001/0028347 | A1 * | 10/2001 | Kawahara et al. | 345/204 |
| 2002/0089514 | A1 * | 7/2002 | Kitahara et al. | 345/600 |
| 2002/0130826 | A1 * | 9/2002 | Otobe et al. | 345/60 |
| 2003/0090447 | A1 * | 5/2003 | Kimura | 345/82 |
| 2004/0041754 | A1 * | 3/2004 | Inukai | 345/76 |
| 2004/0090434 | A1 * | 5/2004 | Miyazawa | 345/204 |
| 2004/0155835 | A1 * | 8/2004 | Ishii et al. | 345/60 |
| 2004/0263538 | A1 * | 12/2004 | Ohta et al. | 345/690 |
| 2007/0067104 | A1 * | 3/2007 | Mays | 701/211 |

FOREIGN PATENT DOCUMENTS

| | | |
|---|---|---|
| JP | 11-085101 | 3/1999 |
| JP | 2002-082649 | 3/2002 |

* cited by examiner

Fig.9

| | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 8 | 12 | 16 | 20 | 24 | 28 | 32 |
| 0 | | | | | | | | | | |
| 1 | ○ | | | | | | | | | |
| 2 | | ○ | | | | | | | | |
| 3 | ○ | ○ | | | | | | | | |
| 4 | | | ○ | | | | | | | |
| 5 | ○ | | ○ | | | | | | | |
| 6 | | ○ | ○ | | | | | | | |
| 7 | ○ | ○ | ○ | | | | | | | |
| 8 | | | | ○ | | | | | | |
| 9 | ○ | | | ○ | | | | | | |
| 10 | | ○ | | ○ | | | | | | |
| 11 | ○ | ○ | | ○ | | | | | | |
| 12 | | | ○ | ○ | | | | | | |
| 13 | ○ | | ○ | ○ | | | | | | |
| 14 | | ○ | ○ | ○ | | | | | | |
| 15 | ○ | ○ | ○ | ○ | | | | | | |
| 16 | | | ○ | | ○ | | | | | |
| 17 | ○ | | ○ | | ○ | | | | | |
| 18 | | ○ | ○ | | ○ | | | | | |
| 19 | ○ | ○ | ○ | | ○ | | | | | |
| 20 | | | | ○ | ○ | | | | | |
| 21 | ○ | | | ○ | ○ | | | | | |
| 22 | | ○ | | ○ | ○ | | | | | |
| 23 | ○ | ○ | | ○ | ○ | | | | | |
| 24 | | | ○ | ○ | ○ | | | | | |
| 25 | ○ | | ○ | ○ | ○ | | | | | |
| 26 | | ○ | ○ | ○ | ○ | | | | | |
| 27 | ○ | ○ | ○ | ○ | ○ | | | | | |
| 28 | | | ○ | ○ | | ○ | | | | |
| 29 | ○ | | ○ | ○ | | ○ | | | | |
| 30 | | ○ | ○ | ○ | | ○ | | | | |
| 31 | ○ | ○ | ○ | ○ | | ○ | | | | |
| 32 | | | ○ | | ○ | ○ | | | | |
| 33 | ○ | | ○ | | ○ | ○ | | | | |
| 34 | | ○ | ○ | | ○ | ○ | | | | |
| 35 | ○ | ○ | ○ | | ○ | ○ | | | | |
| 36 | | | | ○ | ○ | ○ | | | | |
| 37 | ○ | | | ○ | ○ | ○ | | | | |

Fig.10

| | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 8 | 12 | 16 | 20 | 24 | 28 | 32 |
| 38 | | ○ | | ○ | ○ | ○ | | | | |
| 39 | ○ | ○ | | ○ | ○ | ○ | | | | |
| 40 | | | ○ | ○ | ○ | ○ | | | | |
| 41 | ○ | | ○ | ○ | ○ | ○ | | | | |
| 42 | | ○ | ○ | ○ | ○ | ○ | | | | |
| 43 | ○ | ○ | ○ | ○ | ○ | ○ | | | | |
| 44 | | | ○ | ○ | ○ | | ○ | | | |
| 45 | ○ | | ○ | ○ | ○ | | ○ | | | |
| 46 | | ○ | ○ | ○ | ○ | | ○ | | | |
| 47 | ○ | ○ | ○ | ○ | ○ | | ○ | | | |
| 48 | | | ○ | ○ | | ○ | ○ | | | |
| 49 | ○ | | ○ | ○ | | ○ | ○ | | | |
| 50 | | ○ | ○ | ○ | | ○ | ○ | | | |
| 51 | ○ | ○ | ○ | ○ | | ○ | ○ | | | |
| 52 | | | ○ | | ○ | ○ | ○ | | | |
| 53 | ○ | | ○ | | ○ | ○ | ○ | | | |
| 54 | | ○ | ○ | | ○ | ○ | ○ | | | |
| 55 | ○ | ○ | ○ | | ○ | ○ | ○ | | | |
| 56 | | | | ○ | ○ | ○ | ○ | | | |
| 57 | ○ | | | ○ | ○ | ○ | ○ | | | |
| 58 | | ○ | | ○ | ○ | ○ | ○ | | | |
| 59 | ○ | ○ | | ○ | ○ | ○ | ○ | | | |
| 60 | | | ○ | ○ | ○ | ○ | ○ | | | |
| 61 | ○ | | ○ | ○ | ○ | ○ | ○ | | | |
| 62 | | ○ | ○ | ○ | ○ | ○ | ○ | | | |
| 63 | ○ | ○ | ○ | ○ | ○ | ○ | ○ | | | |
| 64 | | | ○ | ○ | ○ | ○ | | ○ | | |
| 65 | ○ | | ○ | ○ | ○ | ○ | | ○ | | |
| 66 | | ○ | ○ | ○ | ○ | ○ | | ○ | | |
| 67 | ○ | ○ | ○ | ○ | ○ | ○ | | ○ | | |
| 68 | | | ○ | ○ | ○ | | ○ | ○ | | |
| 69 | ○ | | ○ | ○ | ○ | | ○ | ○ | | |
| 70 | | ○ | ○ | ○ | ○ | | ○ | ○ | | |
| 71 | ○ | ○ | ○ | ○ | ○ | | ○ | ○ | | |
| 72 | | | ○ | ○ | | ○ | ○ | ○ | | |
| 73 | ○ | | ○ | ○ | | ○ | ○ | ○ | | |
| 74 | | ○ | ○ | ○ | | ○ | ○ | ○ | | |
| 75 | ○ | ○ | ○ | ○ | | ○ | ○ | ○ | | |

Fig.11

| | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 8 | 12 | 16 | 20 | 24 | 28 | 32 |
| 76 | | | ○ | | ○ | ○ | ○ | ○ | | |
| 77 | ○ | | ○ | | ○ | ○ | ○ | ○ | | |
| 78 | | ○ | ○ | | ○ | ○ | ○ | ○ | | |
| 79 | ○ | ○ | ○ | | ○ | ○ | ○ | ○ | | |
| 80 | | | | ○ | ○ | ○ | ○ | ○ | | |
| 81 | ○ | | | ○ | ○ | ○ | ○ | ○ | | |
| 82 | | ○ | | ○ | ○ | ○ | ○ | ○ | | |
| 83 | ○ | ○ | | ○ | ○ | ○ | ○ | ○ | | |
| 84 | | | ○ | ○ | ○ | ○ | ○ | ○ | | |
| 85 | ○ | | ○ | ○ | ○ | ○ | ○ | ○ | | |
| 86 | | ○ | ○ | ○ | ○ | ○ | ○ | ○ | | |
| 87 | ○ | ○ | ○ | ○ | ○ | ○ | ○ | ○ | | |
| 88 | | | ○ | ○ | ○ | ○ | ○ | | ○ | |
| 89 | ○ | | ○ | ○ | ○ | ○ | ○ | | ○ | |
| 90 | | ○ | ○ | ○ | ○ | ○ | ○ | | ○ | |
| 91 | ○ | ○ | ○ | ○ | ○ | ○ | ○ | | ○ | |
| 92 | | | ○ | ○ | ○ | ○ | | ○ | ○ | |
| 93 | ○ | | ○ | ○ | ○ | ○ | | ○ | ○ | |
| 94 | | ○ | ○ | ○ | ○ | ○ | | ○ | ○ | |
| 95 | ○ | ○ | ○ | ○ | ○ | ○ | | ○ | ○ | |
| 96 | | | ○ | ○ | ○ | | ○ | ○ | ○ | |
| 97 | ○ | | ○ | ○ | ○ | | ○ | ○ | ○ | |
| 98 | | ○ | ○ | ○ | ○ | | ○ | ○ | ○ | |
| 99 | ○ | ○ | ○ | ○ | ○ | | ○ | ○ | ○ | |
| 100 | | | ○ | ○ | | ○ | ○ | ○ | ○ | |
| 101 | ○ | | ○ | ○ | | ○ | ○ | ○ | ○ | |
| 102 | | ○ | | | ○ | ○ | ○ | ○ | ○ | |
| 103 | ○ | ○ | | | ○ | ○ | ○ | ○ | ○ | |
| 104 | | | ○ | | ○ | ○ | ○ | ○ | ○ | |
| 105 | ○ | | ○ | | ○ | ○ | ○ | ○ | ○ | |
| 106 | | ○ | ○ | | ○ | ○ | ○ | ○ | ○ | |
| 107 | ○ | ○ | ○ | | ○ | ○ | ○ | ○ | ○ | |
| 108 | | | | ○ | ○ | ○ | ○ | ○ | ○ | |
| 109 | ○ | | | ○ | ○ | ○ | ○ | ○ | ○ | |
| 110 | | ○ | | ○ | ○ | ○ | ○ | ○ | ○ | |
| 111 | ○ | ○ | | ○ | ○ | ○ | ○ | ○ | ○ | |
| 112 | | | ○ | ○ | ○ | ○ | ○ | ○ | ○ | |
| 113 | ○ | | ○ | ○ | ○ | ○ | ○ | ○ | ○ | |

Fig.12

| | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 8 | 12 | 16 | 20 | 24 | 28 | 32 |
| 114 | | ○ | ○ | ○ | ○ | ○ | ○ | ○ | ○ | |
| 115 | ○ | ○ | ○ | ○ | ○ | ○ | ○ | ○ | ○ | |
| 116 | | | ○ | ○ | ○ | ○ | ○ | ○ | | ○ |
| 117 | ○ | | ○ | ○ | ○ | ○ | ○ | ○ | | ○ |
| 118 | | ○ | ○ | ○ | ○ | ○ | ○ | ○ | | ○ |
| 119 | ○ | ○ | ○ | ○ | ○ | ○ | ○ | ○ | | ○ |
| 120 | | | ○ | ○ | ○ | ○ | ○ | | ○ | ○ |
| 121 | ○ | | ○ | ○ | ○ | ○ | ○ | | ○ | ○ |
| 122 | | ○ | ○ | ○ | ○ | ○ | ○ | | ○ | ○ |
| 123 | ○ | ○ | ○ | ○ | ○ | ○ | ○ | | ○ | ○ |
| 124 | | | ○ | ○ | ○ | ○ | | ○ | ○ | ○ |
| 125 | ○ | | ○ | ○ | ○ | ○ | | ○ | ○ | ○ |
| 126 | | ○ | ○ | ○ | ○ | ○ | | ○ | ○ | ○ |
| 127 | ○ | ○ | ○ | ○ | ○ | ○ | | ○ | ○ | ○ |
| 128 | | | ○ | ○ | ○ | | ○ | ○ | ○ | ○ |
| 129 | ○ | | ○ | ○ | ○ | | ○ | ○ | ○ | ○ |
| 130 | | ○ | ○ | ○ | ○ | | ○ | ○ | ○ | ○ |
| 131 | ○ | ○ | ○ | ○ | ○ | | ○ | ○ | ○ | ○ |
| 132 | | | ○ | ○ | | ○ | ○ | ○ | ○ | ○ |
| 133 | ○ | | ○ | ○ | | ○ | ○ | ○ | ○ | ○ |
| 134 | | ○ | ○ | ○ | | ○ | ○ | ○ | ○ | ○ |
| 135 | ○ | ○ | ○ | ○ | | ○ | ○ | ○ | ○ | ○ |
| 136 | | | ○ | | ○ | ○ | ○ | ○ | ○ | ○ |
| 137 | ○ | | ○ | | ○ | ○ | ○ | ○ | ○ | ○ |
| 138 | | ○ | ○ | | ○ | ○ | ○ | ○ | ○ | ○ |
| 139 | ○ | ○ | ○ | | ○ | ○ | ○ | ○ | ○ | ○ |
| 140 | | | | ○ | ○ | ○ | ○ | ○ | ○ | ○ |
| 141 | ○ | | | ○ | ○ | ○ | ○ | ○ | ○ | ○ |
| 142 | | ○ | | ○ | ○ | ○ | ○ | ○ | ○ | ○ |
| 143 | ○ | ○ | | ○ | ○ | ○ | ○ | ○ | ○ | ○ |
| 144 | | | ○ | ○ | ○ | ○ | ○ | ○ | ○ | ○ |
| 145 | ○ | | ○ | ○ | ○ | ○ | ○ | ○ | ○ | ○ |
| 146 | | ○ | ○ | ○ | ○ | ○ | ○ | ○ | ○ | ○ |
| 147 | ○ | ○ | ○ | ○ | ○ | ○ | ○ | ○ | ○ | ○ |

Fig.13

| | SF1 | SF2 | SF3 | SF4 | SF5 | SF6 | SF7 | SF8 | SF9 | SF10 |
|---|---|---|---|---|---|---|---|---|---|---|
| | 1 | 2 | 4 | 8 | 12 | 16 | 20 | 24 | 28 | 32 |
| 0 | | | | | | | | | | |
| 1 | ○ | | | | | | | | | |
| 3 | ○ | ○ | | | | | | | | |
| 7 | ○ | ○ | ○ | | | | | | | |
| 15 | ○ | ○ | ○ | ○ | | | | | | |
| 27 | ○ | ○ | ○ | ○ | ○ | | | | | |
| 43 | ○ | ○ | ○ | ○ | ○ | ○ | | | | |
| 63 | ○ | ○ | ○ | ○ | ○ | ○ | ○ | | | |
| 87 | ○ | ○ | ○ | ○ | ○ | ○ | ○ | ○ | | |
| 115 | ○ | ○ | ○ | ○ | ○ | ○ | ○ | ○ | ○ | |
| 147 | ○ | ○ | ○ | ○ | ○ | ○ | ○ | ○ | ○ | ○ |

Fig.14

| | SF1 | SF2 | SF3 | SF4 | SF5 | SF6 | SF7 | SF8 | SF9 | SF10 |
|---|---|---|---|---|---|---|---|---|---|---|
| | 32 | 28 | 24 | 20 | 16 | 12 | 8 | 4 | 2 | 1 |
| 0 | | | | | | | | | | |
| 1 | | | | | | | | | | ○ |
| 2 | | | | | | | | | ○ | |
| 3 | | | | | | | | | ○ | ○ |
| 4 | | | | | | | | ○ | | |
| 5 | | | | | | | | ○ | | ○ |
| 6 | | | | | | | | ○ | ○ | |
| 7 | | | | | | | | ○ | ○ | ○ |
| 8 | | | | | | | ○ | | | |
| 9 | | | | | | | ○ | | | ○ |
| 10 | | | | | | | ○ | | ○ | |
| 11 | | | | | | | ○ | | ○ | ○ |
| 12 | | | | | | | ○ | ○ | | |
| 13 | | | | | | | ○ | ○ | | ○ |
| 14 | | | | | | | ○ | ○ | ○ | |
| 15 | | | | | | | ○ | ○ | ○ | ○ |
| 16 | | | | | | ○ | | ○ | | |
| 17 | | | | | | ○ | | ○ | | ○ |
| 18 | | | | | | ○ | | ○ | ○ | |
| 19 | | | | | | ○ | | ○ | ○ | ○ |
| 20 | | | | | | ○ | ○ | | | |
| 21 | | | | | | ○ | ○ | | | ○ |
| 22 | | | | | | ○ | ○ | | ○ | |
| 23 | | | | | | ○ | ○ | | ○ | ○ |
| 24 | | | | | | ○ | ○ | ○ | | |
| 25 | | | | | | ○ | ○ | ○ | | ○ |
| 26 | | | | | | ○ | ○ | ○ | ○ | |
| 27 | | | | | | ○ | ○ | ○ | ○ | ○ |
| 28 | | | | | ○ | | ○ | ○ | | |
| 29 | | | | | ○ | | ○ | ○ | | ○ |
| 30 | | | | | ○ | | ○ | ○ | ○ | |
| 31 | | | | | ○ | | ○ | ○ | ○ | ○ |
| 32 | | | | | ○ | ○ | | ○ | | |
| 33 | | | | | ○ | ○ | | ○ | | ○ |
| 34 | | | | | ○ | ○ | | ○ | ○ | |
| 35 | | | | | ○ | ○ | | ○ | ○ | ○ |
| 36 | | | | | ○ | ○ | ○ | | | |
| 37 | | | | | ○ | ○ | ○ | | | ○ |

Fig.15

| | SF1 | SF 2 | SF 3 | SF 4 | SF 5 | SF 6 | SF 7 | SF 8 | SF 9 | SF10 |
|---|---|---|---|---|---|---|---|---|---|---|
| | 32 | 28 | 24 | 20 | 16 | 12 | 8 | 4 | 2 | 1 |
| 38 | | | | | O | O | O | | O | |
| 39 | | | | | O | O | O | | O | O |
| 40 | | | | | O | O | O | O | | |
| 41 | | | | | O | O | O | O | | O |
| 42 | | | | | O | O | O | O | O | |
| 43 | | | | | O | O | O | O | O | O |
| 44 | | | | O | | O | O | O | | |
| 45 | | | | O | | O | O | O | | O |
| 46 | | | | O | | O | O | O | O | |
| 47 | | | | O | | O | O | O | O | O |
| 48 | | | | O | O | | O | O | | |
| 49 | | | | O | O | | O | O | | O |
| 50 | | | | O | O | | O | O | O | |
| 51 | | | | O | O | | O | O | O | O |
| 52 | | | | O | O | O | | O | | |
| 53 | | | | O | O | O | | O | | O |
| 54 | | | | O | O | O | | O | O | |
| 55 | | | | O | O | O | | O | O | O |
| 56 | | | | O | O | O | O | | | |
| 57 | | | | O | O | O | O | | | O |
| 58 | | | | O | O | O | O | | O | |
| 59 | | | | O | O | O | O | | O | O |
| 60 | | | | O | O | O | O | O | | |
| 61 | | | | O | O | O | O | O | | O |
| 62 | | | | O | O | O | O | O | O | |
| 63 | | | | O | O | O | O | O | O | O |
| 64 | | | O | | O | O | O | O | | |
| 65 | | | O | | O | O | O | O | | O |
| 66 | | | O | | O | O | O | O | O | |
| 67 | | | O | | O | O | O | O | O | O |
| 68 | | | O | O | | O | O | O | | |
| 69 | | | O | O | | O | O | O | | O |
| 70 | | | O | O | | O | O | O | O | |
| 71 | | | O | O | | O | O | O | O | O |
| 72 | | | O | O | O | | O | O | | |
| 73 | | | O | O | O | | O | O | | O |
| 74 | | | O | O | O | | O | O | O | |
| 75 | | | O | O | O | | O | O | O | O |

Fig.16

| | SF1 | SF2 | SF3 | SF4 | SF5 | SF6 | SF7 | SF8 | SF9 | SF10 |
|---|---|---|---|---|---|---|---|---|---|---|
| | 32 | 28 | 24 | 20 | 16 | 12 | 8 | 4 | 2 | 1 |
| 76 | | | O | O | O | O | | O | | |
| 77 | | | O | O | O | O | | O | | O |
| 78 | | | O | O | O | O | | O | O | |
| 79 | | | O | O | O | O | | O | O | O |
| 80 | | | O | O | O | O | O | | | |
| 81 | | | O | O | O | O | O | | | O |
| 82 | | | O | O | O | O | O | | O | |
| 83 | | | O | O | O | O | O | | O | O |
| 84 | | | O | O | O | O | O | O | | |
| 85 | | | O | O | O | O | O | O | | O |
| 86 | | | O | O | O | O | O | O | O | |
| 87 | | | O | O | O | O | O | O | O | O |
| 88 | | O | | O | O | O | O | O | | |
| 89 | | O | | O | O | O | O | O | | O |
| 90 | | O | | O | O | O | O | O | O | |
| 91 | | O | | O | O | O | O | O | O | O |
| 92 | | O | O | | O | O | O | O | | |
| 93 | | O | O | | O | O | O | O | | O |
| 94 | | O | O | | O | O | O | O | O | |
| 95 | | O | O | | O | O | O | O | O | O |
| 96 | | O | O | O | | O | O | O | | |
| 97 | | O | O | O | | O | O | O | | O |
| 98 | | O | O | O | | O | O | O | O | |
| 99 | | O | O | O | | O | O | O | O | O |
| 100 | | O | O | O | O | | O | O | | |
| 101 | | O | O | O | O | | O | O | | O |
| 102 | | O | O | O | O | O | | | O | |
| 103 | | O | O | O | O | O | | | O | O |
| 104 | | O | O | O | O | O | | O | | |
| 105 | | O | O | O | O | O | | O | | O |
| 106 | | O | O | O | O | O | | O | O | |
| 107 | | O | O | O | O | O | | O | O | O |
| 108 | | O | O | O | O | O | O | | | |
| 109 | | O | O | O | O | O | O | | | O |
| 110 | | O | O | O | O | O | O | | O | |
| 111 | | O | O | O | O | O | O | | O | O |
| 112 | | O | O | O | O | O | O | O | | |
| 113 | | O | O | O | O | O | O | O | | O |

Fig.17

| | SF1 | SF 2 | SF 3 | SF 4 | SF 5 | SF 6 | SF 7 | SF 8 | SF 9 | SF10 |
|---|---|---|---|---|---|---|---|---|---|---|
| | 32 | 28 | 24 | 20 | 16 | 12 | 8 | 4 | 2 | 1 |
| 114 | | O | O | O | O | O | O | O | O | |
| 115 | | O | O | O | O | O | O | O | O | O |
| 116 | O | | O | O | O | O | O | O | | |
| 117 | O | | O | O | O | O | O | O | | O |
| 118 | O | | O | O | O | O | O | O | O | |
| 119 | O | | O | O | O | O | O | O | O | O |
| 120 | O | O | | O | O | O | O | O | | |
| 121 | O | O | | O | O | O | O | O | | O |
| 122 | O | O | | O | O | O | O | O | O | |
| 123 | O | O | | O | O | O | O | O | O | O |
| 124 | O | O | O | | O | O | O | O | | |
| 125 | O | O | O | | O | O | O | O | | O |
| 126 | O | O | O | | O | O | O | O | O | |
| 127 | O | O | O | | O | O | O | O | O | O |
| 128 | O | O | O | O | | O | O | O | | |
| 129 | O | O | O | O | | O | O | O | | O |
| 130 | O | O | O | O | | O | O | O | O | |
| 131 | O | O | O | O | | O | O | O | O | O |
| 132 | O | O | O | O | O | | O | O | | |
| 133 | O | O | O | O | O | | O | O | | O |
| 134 | O | O | O | O | O | | O | O | O | |
| 135 | O | O | O | O | O | | O | O | O | O |
| 136 | O | O | O | O | O | O | | O | | |
| 137 | O | O | O | O | O | O | | O | | O |
| 138 | O | O | O | O | O | O | | O | O | |
| 139 | O | O | O | O | O | O | | O | O | O |
| 140 | O | O | O | O | O | O | O | | | |
| 141 | O | O | O | O | O | O | O | | | O |
| 142 | O | O | O | O | O | O | O | | O | |
| 143 | O | O | O | O | O | O | O | | O | O |
| 144 | O | O | O | O | O | O | O | O | | |
| 145 | O | O | O | O | O | O | O | O | | O |
| 146 | O | O | O | O | O | O | O | O | O | |
| 147 | O | O | O | O | O | O | O | O | O | O |

Fig.18

| | SF1 | SF2 | SF3 | SF4 | SF5 | SF6 | SF7 | SF8 | SF9 | SF10 |
|---|---|---|---|---|---|---|---|---|---|---|
| | 32 | 28 | 24 | 20 | 16 | 12 | 8 | 4 | 2 | 1 |
| 0 | | | | | | | | | | |
| 1 | | | | | | | | | | ○ |
| 3 | | | | | | | | | ○ | ○ |
| 7 | | | | | | | | ○ | ○ | ○ |
| 15 | | | | | | | ○ | ○ | ○ | ○ |
| 27 | | | | | | ○ | ○ | ○ | ○ | ○ |
| 43 | | | | | ○ | ○ | ○ | ○ | ○ | ○ |
| 63 | | | | ○ | ○ | ○ | ○ | ○ | ○ | ○ |
| 87 | | | ○ | ○ | ○ | ○ | ○ | ○ | ○ | ○ |
| 115 | | ○ | ○ | ○ | ○ | ○ | ○ | ○ | ○ | ○ |
| 147 | ○ | ○ | ○ | ○ | ○ | ○ | ○ | ○ | ○ | ○ |

<RELATIONS BETWEEN SIGNAL AA AND SIGNAL BB>

REGION R11 3×k ≦SIGNAL AA<3×k+1 :SLOPE1 INTERCEPT-k
REGION R12 3×k+1≦SIGNAL AA<3×(k+1):SLOPE1/2 INTERCEPT(1/2)×(k+1)
(k=0.1.2.∵)

Fig.21

※WHEN REMAINDER IS 0, P11 IS SELECTED;
OTHERWISE, P12 IS SELECTED

| AA | P11 | P12 | BB | DISPLAY |
|---|---|---|---|---|
| 0 | 0 | 0.5 | 0 | 0 |
| 1 | 1 | 1 | 1 | 1 |
| 2 | 2 | 1.5 | 1.5 | 2 |
| 3 | 2 | 2.5 | 2 | 3 |
| 4 | 3 | 3 | 3 | 4 |
| 5 | 4 | 3.5 | 3.5 | 5 |
| 6 | 4 | 4.5 | 4 | 6 |
| 7 | 5 | 5 | 5 | 7 |
| 8 | 6 | 5.5 | 5.5 | 8 |
| 9 | 6 | 6.5 | 6 | 9 |
| 10 | 7 | 7 | 7 | 10 |
| 11 | 8 | 7.5 | 7.5 | 11 |
| 12 | 8 | 8.5 | 8 | 12 |
| 13 | 9 | 9 | 9 | 13 |
| 14 | 10 | 9.5 | 9.5 | 14 |
| 15 | 10 | 10.5 | 10 | 15 |
| 16 | 11 | 11 | 11 | 16 |
| 17 | 12 | 11.5 | 11.5 | 17 |
| 18 | 12 | 12.5 | 12 | 18 |
| 19 | 13 | 13 | 13 | 19 |
| 20 | 14 | 13.5 | 13.5 | 20 |
| 21 | 14 | 14.5 | 14 | 21 |
| 22 | 15 | 15 | 15 | 22 |
| 23 | 16 | 15.5 | 15.5 | 21 |
| 24 | 16 | 16.5 | 16 | 24 |
| 25 | 17 | 17 | 17 | 25 |
| 26 | 18 | 17.5 | 17.5 | 24 |
| 27 | 18 | 18.5 | 18 | 27 |
| 28 | 19 | 19 | 19 | 28 |
| 29 | 20 | 19.5 | 19.5 | 29 |
| 30 | 20 | 20.5 | 20 | 30 |
| 31 | 21 | 21 | 21 | 31 |
| 32 | 22 | 21.5 | 21.5 | 32 |
| 33 | 22 | 22.5 | 22 | 33 |
| 34 | 23 | 23 | 23 | 34 |
| 35 | 24 | 23.5 | 23.5 | 35 |
| 36 | 24 | 24.5 | 24 | 36 |
| 37 | 25 | 25 | 25 | 37 |

Fig.22

※WHEN REMAINDER IS 0, P11 IS SELECTED;
OTHERWISE, P12 IS SELECTED

| AA | P11 | P12 | BB | DISPLAY |
|---|---|---|---|---|
| 38 | 26 | 25.5 | 25.5 | 38 |
| 39 | 26 | 26.5 | 26 | 39 |
| 40 | 27 | 27 | 27 | 40 |
| 41 | 28 | 27.5 | 27.5 | 41 |
| 42 | 28 | 28.5 | 28 | 42 |
| 43 | 29 | 29 | 29 | 43 |
| 44 | 30 | 29.5 | 29.5 | 42 |
| 45 | 30 | 30.5 | 30 | 45 |
| 46 | 31 | 31 | 31 | 46 |
| 47 | 32 | 31.5 | 31.5 | 47 |
| 48 | 32 | 32.5 | 32 | 48 |
| 49 | 33 | 33 | 33 | 49 |
| 50 | 34 | 33.5 | 33.5 | 50 |
| 51 | 34 | 34.5 | 34 | 51 |
| 52 | 35 | 35 | 35 | 52 |
| 53 | 36 | 35.5 | 35.5 | 53 |
| 54 | 36 | 36.5 | 36 | 54 |
| 55 | 37 | 37 | 37 | 55 |
| 56 | 38 | 37.5 | 37.5 | 56 |
| 57 | 38 | 38.5 | 38 | 57 |
| 58 | 39 | 39 | 39 | 58 |
| 59 | 40 | 39.5 | 39.5 | 59 |
| 60 | 40 | 40.5 | 40 | 60 |
| 61 | 41 | 41 | 41 | 61 |
| 62 | 42 | 41.5 | 41.5 | 62 |
| 63 | 42 | 42.5 | 42 | 63 |
| 64 | 43 | 43 | 43 | 64 |
| 65 | 44 | 43.5 | 43.5 | 65 |
| 66 | 44 | 44.5 | 44 | 66 |
| 67 | 45 | 45 | 45 | 67 |
| 68 | 46 | 45.5 | 45.5 | 68 |
| 69 | 46 | 46.5 | 46 | 69 |
| 70 | 47 | 47 | 47 | 70 |
| 71 | 48 | 47.5 | 47.5 | 71 |
| 72 | 48 | 48.5 | 48 | 72 |
| 73 | 49 | 49 | 49 | 73 |
| 74 | 50 | 49.5 | 49.5 | 74 |
| 75 | 50 | 50.5 | 50 | 75 |
| 76 | 51 | 51 | 51 | 76 |

Fig. 23

※WHEN REMAINDER IS 0, P11 IS SELECTED; OTHERWISE, P12 IS SELECTED

| AA | P11 | P12 | BB | DISPLAY |
|---|---|---|---|---|
| 77 | 52 | 51.5 | 51.5 | 77 |
| 78 | 52 | 52.5 | 52 | 78 |
| 79 | 53 | 53 | 53 | 79 |
| 80 | 54 | 53.5 | 53.5 | 80 |
| 81 | 54 | 54.5 | 54 | 81 |
| 82 | 55 | 55 | 55 | 82 |
| 83 | 56 | 55.5 | 55.5 | 83 |
| 84 | 56 | 56.5 | 56 | 84 |
| 85 | 57 | 57 | 57 | 85 |
| 86 | 58 | 57.5 | 57.5 | 86 |
| 87 | 58 | 58.5 | 58 | 87 |
| 88 | 59 | 59 | 59 | 88 |
| 89 | 60 | 59.5 | 59.5 | 89 |
| 90 | 60 | 60.5 | 60 | 90 |
| 91 | 61 | 61 | 61 | 91 |
| 92 | 62 | 61.5 | 61.5 | 92 |
| 93 | 62 | 62.5 | 62 | 93 |
| 94 | 63 | 63 | 63 | 94 |
| 95 | 64 | 63.5 | 63.5 | 95 |
| 96 | 64 | 64.5 | 64 | 96 |
| 97 | 65 | 65 | 65 | 97 |
| 98 | 66 | 65.5 | 65.5 | 98 |
| 99 | 66 | 66.5 | 66 | 99 |
| 100 | 67 | 67 | 67 | 100 |
| 101 | 68 | 67.5 | 67.5 | 101 |
| 102 | 68 | 68.5 | 68 | 102 |
| 103 | 69 | 69 | 69 | 103 |
| 104 | 70 | 69.5 | 69.5 | 104 |
| 105 | 70 | 70.5 | 70 | 105 |
| 106 | 71 | 71 | 71 | 106 |
| 107 | 72 | 71.5 | 71.5 | 107 |
| 108 | 72 | 72.5 | 72 | 108 |
| 109 | 73 | 73 | 73 | 109 |
| 110 | 74 | 73.5 | 73.5 | 110 |
| 111 | 74 | 74.5 | 74 | 111 |
| 112 | 75 | 75 | 75 | 112 |
| 113 | 76 | 75.5 | 75.5 | 113 |
| 114 | 76 | 76.5 | 76 | 114 |
| 115 | 77 | 77 | 77 | 115 |

Fig.24

※WHEN REMAINDER IS 0, P11 IS SELECTED; OTHERWISE, P12 IS SELECTED

| AA | P11 | P12 | BB | DISPLAY |
|---|---|---|---|---|
| 116 | 78 | 77.5 | 77.5 | 116 |
| 117 | 78 | 78.5 | 78 | 117 |
| 118 | 79 | 79 | 79 | 118 |
| 119 | 80 | 79.5 | 79.5 | 119 |
| 120 | 80 | 80.5 | 80 | 120 |
| 121 | 81 | 81 | 81 | 121 |
| 122 | 82 | 81.5 | 81.5 | 122 |
| 123 | 82 | 82.5 | 82 | 123 |
| 124 | 83 | 83 | 83 | 124 |
| 125 | 84 | 83.5 | 83.5 | 125 |
| 126 | 84 | 84.5 | 84 | 126 |
| 127 | 85 | 85 | 85 | 127 |
| 128 | 86 | 85.5 | 85.5 | 128 |
| 129 | 86 | 86.5 | 86 | 129 |
| 130 | 87 | 87 | 87 | 130 |
| 131 | 88 | 87.5 | 87.5 | 131 |
| 132 | 88 | 88.5 | 88 | 132 |
| 133 | 89 | 89 | 89 | 133 |
| 134 | 90 | 89.5 | 89.5 | 134 |
| 135 | 90 | 90.5 | 90 | 135 |
| 136 | 91 | 91 | 91 | 136 |
| 137 | 92 | 91.5 | 91.5 | 137 |
| 138 | 92 | 92.5 | 92 | 138 |
| 139 | 93 | 93 | 93 | 139 |
| 140 | 94 | 93.5 | 93.5 | 140 |
| 141 | 94 | 94.5 | 94 | 141 |
| 142 | 95 | 95 | 95 | 142 |
| 143 | 96 | 95.5 | 95.5 | 143 |
| 144 | 96 | 96.5 | 96 | 144 |
| 145 | 97 | 97 | 97 | 145 |
| 146 | 98 | 97.5 | 97.5 | 146 |
| 147 | 98 | 98.5 | 98 | 147 |
| 148 | 99 | 99 | 99 | 148 |
| 149 | 100 | 99.5 | 99.5 | 149 |
| 150 | 100 | 100.5 | 100 | 150 |
| 151 | 101 | 101 | 101 | 151 |
| 152 | 102 | 101.5 | 101.5 | 152 |
| 153 | 102 | 102.5 | 102 | 153 |
| 154 | 103 | 103 | 103 | 154 |

Fig.25

※WHEN REMAINDER IS 0, P11 IS SELECTED; OTHERWISE, P12 IS SELECTED

| AA | P11 | P12 | BB | DISPLAY |
|---|---|---|---|---|
| 155 | 104 | 103.5 | 103.5 | 155 |
| 156 | 104 | 104.5 | 104 | 156 |
| 157 | 105 | 105 | 105 | 157 |
| 158 | 106 | 105.5 | 105.5 | 156 |
| 159 | 106 | 106.5 | 106 | 159 |
| 160 | 107 | 107 | 107 | 160 |
| 161 | 108 | 107.5 | 107.5 | 161 |
| 162 | 108 | 108.5 | 108 | 162 |
| 163 | 109 | 109 | 109 | 163 |
| 164 | 110 | 109.5 | 109.5 | 164 |
| 165 | 110 | 110.5 | 110 | 165 |
| 166 | 111 | 111 | 111 | 166 |
| 167 | 112 | 111.5 | 111.5 | 167 |
| 168 | 112 | 112.5 | 112 | 168 |
| 169 | 113 | 113 | 113 | 169 |
| 170 | 114 | 113.5 | 113.5 | 170 |
| 171 | 114 | 114.5 | 114 | 171 |
| 172 | 115 | 115 | 115 | 172 |
| 173 | 116 | 115.5 | 115.5 | 173 |
| 174 | 116 | 116.5 | 116 | 174 |
| 175 | 117 | 117 | 117 | 175 |
| 176 | 118 | 117.5 | 117.5 | 176 |
| 177 | 118 | 118.5 | 118 | 177 |
| 178 | 119 | 119 | 119 | 178 |
| 179 | 120 | 119.5 | 119.5 | 179 |
| 180 | 120 | 120.5 | 120 | 180 |
| 181 | 121 | 121 | 121 | 181 |
| 182 | 122 | 121.5 | 121.5 | 182 |
| 183 | 122 | 122.5 | 122 | 183 |
| 184 | 123 | 123 | 123 | 184 |
| 185 | 124 | 123.5 | 123.5 | 185 |
| 186 | 124 | 124.5 | 124 | 186 |
| 187 | 125 | 125 | 125 | 187 |
| 188 | 126 | 125.5 | 125.5 | 188 |
| 189 | 126 | 126.5 | 126 | 189 |
| 190 | 127 | 127 | 127 | 190 |
| 191 | 128 | 127.5 | 127.5 | 191 |
| 192 | 128 | 128.5 | 128 | 192 |
| 193 | 129 | 129 | 129 | 193 |

Fig. 26

※WHEN REMAINDER IS 0, P11 IS SELECTED; OTHERWISE, P12 IS SELECTED

| AA | P11 | P12 | BB | DISPLAY |
|---|---|---|---|---|
| 194 | 130 | 129.5 | 129.5 | 194 |
| 195 | 130 | 130.5 | 130 | 195 |
| 196 | 131 | 131 | 131 | 196 |
| 197 | 132 | 131.5 | 131.5 | 197 |
| 198 | 132 | 132.5 | 132 | 198 |
| 199 | 133 | 133 | 133 | 199 |
| 200 | 134 | 133.5 | 133.5 | 200 |
| 201 | 134 | 134.5 | 134 | 201 |
| 202 | 135 | 135 | 135 | 202 |
| 203 | 136 | 135.5 | 135.5 | 203 |
| 204 | 136 | 136.5 | 136 | 204 |
| 205 | 137 | 137 | 137 | 205 |
| 206 | 138 | 137.5 | 137.5 | 206 |
| 207 | 138 | 138.5 | 138 | 207 |
| 208 | 139 | 139 | 139 | 208 |
| 209 | 140 | 139.5 | 139.5 | 209 |
| 210 | 140 | 140.5 | 140 | 210 |
| 211 | 141 | 141 | 141 | 211 |
| 212 | 142 | 141.5 | 141.5 | 212 |
| 213 | 142 | 142.5 | 142 | 213 |
| 214 | 143 | 143 | 143 | 214 |
| 215 | 144 | 143.5 | 143.5 | 215 |
| 216 | 144 | 144.5 | 144 | 216 |
| 217 | 145 | 145 | 135 | 217 |
| 218 | 146 | 145.5 | 145.5 | 218 |
| 219 | 146 | 146.5 | 146 | 219 |
| 220 | 147 | 147 | 147 | 220 |

<RELATIONS BETWEEN SIGNAL AA AND SIGNAL BB>

REGION R21 $5 \times k \leqq$ SIGNAL AA $< 5 \times k+1$ : SLOPE1 INTERCEPT-k
REGION R23 $5 \times k+3 \leqq$ SIGNAL AA $< 5 \times (k+1)$ : SLOPE1 INTERCEPT-(k+1)
REGION R22 $5 \times k+1 \leqq$ SIGNAL AA $< 5 \times k$ : SLOPE1/2 INTERCEPT(1/2) $\times (3 \times k+1)$
(k=0. 1. 2. ·)

Fig.29

※WHEN REMAINDER IS 0, P21 IS SELECTED;
WHEN REMAINDER IS 1 OR 2, P22 IS SELECTED;
OTHERWISE, P23 IS SELECTED

| AA | P21 | P22 | P23 | BB | DISPLAY |
|---|---|---|---|---|---|
| 0 | 0 | 0.5 | -1 | 0 | 0 |
| 1 | 1 | 1 | 0 | 1 | 1 |
| 2 | 2 | 1.5 | 1 | 1.5 | 2 |
| 3 | 3 | 2 | 2 | 2 | 3 |
| 4 | 4 | 2.5 | 3 | 3 | 4 |
| 5 | 4 | 4.5 | 3 | 4 | 5 |
| 6 | 5 | 5 | 4 | 5 | 6 |
| 7 | 6 | 5.5 | 5 | 5.5 | 7 |
| 8 | 7 | 6 | 6 | 6 | 8 |
| 9 | 8 | 6.5 | 7 | 7 | 9 |
| 10 | 8 | 8.5 | 7 | 8 | 10 |
| 11 | 9 | 9 | 8 | 9 | 11 |
| 12 | 10 | 9.5 | 9 | 9.5 | 12 |
| 13 | 11 | 10 | 10 | 10 | 13 |
| 14 | 12 | 10.5 | 11 | 11 | 14 |
| 15 | 12 | 12.5 | 11 | 12 | 15 |
| 16 | 13 | 13 | 12 | 13 | 16 |
| 17 | 14 | 13.5 | 13 | 13.5 | 17 |
| 18 | 15 | 14 | 14 | 14 | 18 |
| 19 | 16 | 14.5 | 15 | 15 | 19 |
| 20 | 16 | 16.5 | 15 | 16 | 20 |
| 21 | 17 | 17 | 16 | 17 | 21 |
| 22 | 18 | 17.5 | 17 | 17.5 | 22 |
| 23 | 19 | 18 | 18 | 18 | 23 |
| 24 | 20 | 18.5 | 19 | 19 | 24 |
| 25 | 20 | 20.5 | 19 | 20 | 25 |
| 26 | 21 | 21 | 20 | 21 | 26 |
| 27 | 22 | 21.5 | 21 | 21.5 | 27 |
| 28 | 23 | 22 | 22 | 22 | 28 |
| 29 | 24 | 22.5 | 23 | 23 | 29 |
| 30 | 24 | 24.5 | 23 | 24 | 30 |
| 31 | 25 | 25 | 24 | 25 | 31 |
| 32 | 26 | 25.5 | 25 | 25.5 | 32 |
| 33 | 27 | 26 | 26 | 26 | 33 |
| 34 | 28 | 26.5 | 27 | 27 | 34 |
| 35 | 28 | 28.5 | 27 | 28 | 35 |
| 36 | 29 | 29 | 28 | 29 | 36 |
| 37 | 30 | 29.5 | 29 | 29.5 | 37 |

Fig.30

※WHEN REMAINDER IS 0, P21 IS SELECTED;
WHEN REMAINDER IS 1 OR 2, P22 IS SELECTED;
OTHERWISE, P23 IS SELECTED

| AA | P21 | P22 | P23 | BB | DISPLAY |
|---|---|---|---|---|---|
| 38 | 31 | 30 | 30 | 30 | 38 |
| 39 | 32 | 30.5 | 31 | 31 | 39 |
| 40 | 32 | 32.5 | 31 | 32 | 40 |
| 41 | 33 | 33 | 32 | 33 | 41 |
| 42 | 34 | 33.5 | 33 | 33.5 | 42 |
| 43 | 35 | 34 | 34 | 34 | 43 |
| 44 | 36 | 34.5 | 35 | 35 | 44 |
| 45 | 36 | 36.5 | 35 | 36 | 45 |
| 46 | 37 | 37 | 36 | 37 | 46 |
| 47 | 38 | 37.5 | 37 | 37.5 | 47 |
| 48 | 39 | 38 | 38 | 38 | 48 |
| 49 | 40 | 38.5 | 39 | 39 | 49 |
| 50 | 40 | 40.5 | 39 | 40 | 50 |
| 51 | 41 | 41 | 40 | 41 | 51 |
| 52 | 42 | 41.5 | 41 | 41.5 | 52 |
| 53 | 43 | 42 | 42 | 42 | 53 |
| 54 | 44 | 42.5 | 43 | 43 | 54 |
| 55 | 44 | 44.5 | 43 | 44 | 55 |
| 56 | 45 | 45 | 44 | 45 | 56 |
| 57 | 46 | 45.5 | 45 | 45.5 | 57 |
| 58 | 47 | 46 | 46 | 46 | 58 |
| 59 | 48 | 46.5 | 47 | 47 | 59 |
| 60 | 48 | 48.5 | 47 | 48 | 60 |
| 61 | 49 | 49 | 48 | 49 | 61 |
| 62 | 50 | 49.5 | 49 | 49.5 | 62 |
| 63 | 51 | 50 | 50 | 50 | 63 |
| 64 | 52 | 50.5 | 51 | 51 | 64 |
| 65 | 52 | 52.5 | 51 | 52 | 65 |
| 66 | 53 | 53 | 52 | 53 | 66 |
| 67 | 54 | 53.5 | 53 | 53.5 | 67 |
| 68 | 55 | 54 | 54 | 54 | 68 |
| 69 | 56 | 54.5 | 55 | 55 | 69 |
| 70 | 56 | 56.5 | 55 | 56 | 70 |
| 71 | 57 | 57 | 56 | 57 | 71 |
| 72 | 58 | 57.5 | 57 | 57.5 | 72 |
| 73 | 59 | 58 | 58 | 58 | 73 |
| 74 | 60 | 58.5 | 59 | 59 | 74 |
| 75 | 60 | 60.5 | 59 | 60 | 75 |
| 76 | 61 | 61 | 60 | 61 | 76 |

Fig.31

※WHEN REMAINDER IS 0, P21 IS SELECTED;
WHEN REMAINDER IS 1 OR 2, P22 IS SELECTED;
OTHERWISE, P23 IS SELECTED

| AA | P21 | P22 | P23 | BB | DISPLAY |
|---|---|---|---|---|---|
| 77 | 62 | 61.5 | 61 | 61.5 | 77 |
| 78 | 63 | 62 | 62 | 62 | 78 |
| 79 | 64 | 62.5 | 63 | 63 | 79 |
| 80 | 64 | 64.5 | 63 | 64 | 80 |
| 81 | 65 | 65 | 64 | 65 | 81 |
| 82 | 66 | 65.5 | 65 | 65.5 | 82 |
| 83 | 67 | 66 | 66 | 66 | 83 |
| 84 | 68 | 66.5 | 67 | 67 | 84 |
| 85 | 68 | 68.5 | 67 | 68 | 85 |
| 86 | 69 | 69 | 68 | 69 | 86 |
| 87 | 70 | 69.5 | 69 | 69.5 | 87 |
| 88 | 71 | 70 | 70 | 70 | 88 |
| 89 | 72 | 70.5 | 71 | 71 | 89 |
| 90 | 72 | 72.5 | 71 | 72 | 90 |
| 91 | 73 | 73 | 72 | 73 | 91 |
| 92 | 74 | 73.5 | 73 | 73.5 | 92 |
| 93 | 75 | 74 | 74 | 74 | 93 |
| 94 | 76 | 74.5 | 75 | 75 | 94 |
| 95 | 76 | 76.5 | 75 | 76 | 95 |
| 96 | 77 | 77 | 76 | 77 | 96 |
| 97 | 78 | 77.5 | 77 | 77.5 | 97 |
| 98 | 79 | 78 | 78 | 78 | 98 |
| 99 | 80 | 78.5 | 79 | 79 | 99 |
| 100 | 80 | 80.5 | 79 | 80 | 100 |
| 101 | 81 | 81 | 80 | 81 | 101 |
| 102 | 82 | 81.5 | 81 | 81.5 | 102 |
| 103 | 83 | 82 | 82 | 82 | 103 |
| 104 | 84 | 82.5 | 83 | 83 | 104 |
| 105 | 84 | 84.5 | 83 | 84 | 105 |
| 106 | 85 | 85 | 84 | 85 | 106 |
| 107 | 86 | 85.5 | 85 | 85.5 | 107 |
| 108 | 87 | 86 | 86 | 86 | 108 |
| 109 | 88 | 86.5 | 87 | 87 | 109 |
| 110 | 88 | 88.5 | 87 | 88 | 110 |
| 111 | 89 | 89 | 88 | 89 | 111 |
| 112 | 90 | 89.5 | 89 | 89.5 | 112 |
| 113 | 91 | 90 | 90 | 90 | 113 |
| 114 | 92 | 90.5 | 91 | 91 | 114 |
| 115 | 92 | 92.5 | 91 | 92 | 115 |

Fig.32

※WHEN REMAINDER IS 0, P21 IS SELECTED;
WHEN REMAINDER IS 1 OR 2, P22 IS SELECTED;
OTHERWISE, P23 IS SELECTED

| AA | P21 | P22 | P23 | BB | DISPLAY |
|---|---|---|---|---|---|
| 116 | 93 | 93 | 92 | 93 | 116 |
| 117 | 94 | 93.5 | 93 | 93.5 | 117 |
| 118 | 95 | 94 | 94 | 94 | 118 |
| 119 | 96 | 94.5 | 95 | 95 | 119 |
| 120 | 96 | 96.5 | 95 | 96 | 120 |
| 121 | 97 | 97 | 96 | 97 | 121 |
| 122 | 98 | 97.5 | 97 | 97.5 | 122 |
| 123 | 99 | 98 | 98 | 98 | 123 |
| 124 | 100 | 98.5 | 99 | 99 | 124 |
| 125 | 100 | 100.5 | 99 | 100 | 125 |
| 126 | 101 | 101 | 100 | 101 | 126 |
| 127 | 102 | 101.5 | 101 | 101.5 | 127 |
| 128 | 103 | 102 | 102 | 102 | 128 |
| 129 | 104 | 102.5 | 103 | 103 | 129 |
| 130 | 104 | 104.5 | 103 | 104 | 130 |
| 131 | 105 | 105 | 104 | 105 | 131 |
| 132 | 106 | 105.5 | 105 | 105.5 | 132 |
| 133 | 107 | 106 | 106 | 106 | 133 |
| 134 | 108 | 106.5 | 107 | 107 | 134 |
| 135 | 108 | 108.5 | 107 | 108 | 135 |
| 136 | 109 | 109 | 108 | 109 | 136 |
| 137 | 110 | 109.5 | 109 | 109.5 | 137 |
| 138 | 111 | 110 | 110 | 110 | 138 |
| 139 | 112 | 110.5 | 111 | 111 | 139 |
| 140 | 112 | 112.5 | 111 | 112 | 140 |
| 141 | 113 | 113 | 112 | 113 | 141 |
| 142 | 114 | 113.5 | 113 | 113.5 | 142 |
| 143 | 115 | 114 | 114 | 114 | 143 |
| 144 | 116 | 114.5 | 115 | 115 | 144 |
| 145 | 116 | 116.5 | 115 | 116 | 145 |
| 146 | 117 | 117 | 116 | 117 | 146 |
| 147 | 118 | 117.5 | 117 | 117.5 | 147 |
| 148 | 119 | 118 | 118 | 118 | 148 |
| 149 | 120 | 118.5 | 119 | 119 | 149 |
| 150 | 120 | 120.5 | 119 | 120 | 150 |
| 151 | 121 | 121 | 120 | 121 | 151 |
| 152 | 122 | 121.5 | 121 | 121.5 | 152 |
| 153 | 123 | 122 | 122 | 122 | 153 |
| 154 | 124 | 122.5 | 123 | 123 | 154 |

Fig. 33

※WHEN REMAINDER IS 0, P21 IS SELECTED;
WHEN REMAINDER IS 1 OR 2, P22 IS SELECTED;
OTHERWISE, P23 IS SELECTED

| AA | P21 | P22 | P23 | BB | DISPLAY |
|---|---|---|---|---|---|
| 155 | 124 | 124.5 | 123 | 124 | 155 |
| 156 | 125 | 125 | 124 | 125 | 156 |
| 157 | 126 | 125.5 | 125 | 125.5 | 157 |
| 158 | 127 | 126 | 126 | 126 | 158 |
| 159 | 128 | 126.5 | 127 | 127 | 159 |
| 160 | 128 | 128.5 | 127 | 128 | 160 |
| 161 | 129 | 129 | 128 | 129 | 161 |
| 162 | 130 | 129.5 | 129 | 129.5 | 162 |
| 163 | 131 | 130 | 130 | 130 | 163 |
| 164 | 132 | 130.5 | 131 | 131 | 164 |
| 165 | 132 | 132.5 | 131 | 132 | 165 |
| 166 | 133 | 133 | 132 | 133 | 166 |
| 167 | 134 | 133.5 | 133 | 133.5 | 167 |
| 168 | 135 | 134 | 134 | 134 | 168 |
| 169 | 136 | 134.5 | 135 | 135 | 169 |
| 170 | 136 | 136.5 | 135 | 136 | 170 |
| 171 | 137 | 137 | 136 | 137 | 171 |
| 172 | 138 | 137.5 | 137 | 137.5 | 172 |
| 173 | 139 | 138 | 138 | 138 | 173 |
| 174 | 140 | 138.5 | 139 | 139 | 174 |
| 175 | 140 | 140.5 | 139 | 140 | 175 |
| 176 | 141 | 141 | 140 | 141 | 176 |
| 177 | 142 | 141.5 | 141 | 141.5 | 177 |
| 178 | 143 | 142 | 142 | 142 | 178 |
| 179 | 144 | 142.5 | 143 | 143 | 179 |
| 180 | 144 | 144.5 | 143 | 144 | 180 |
| 181 | 145 | 145 | 144 | 145 | 181 |
| 182 | 146 | 145.5 | 145 | 145.5 | 182 |
| 183 | 147 | 146 | 146 | 146 | 183 |
| 184 | 148 | 146.5 | 147 | 147 | 184 |

Fig.35

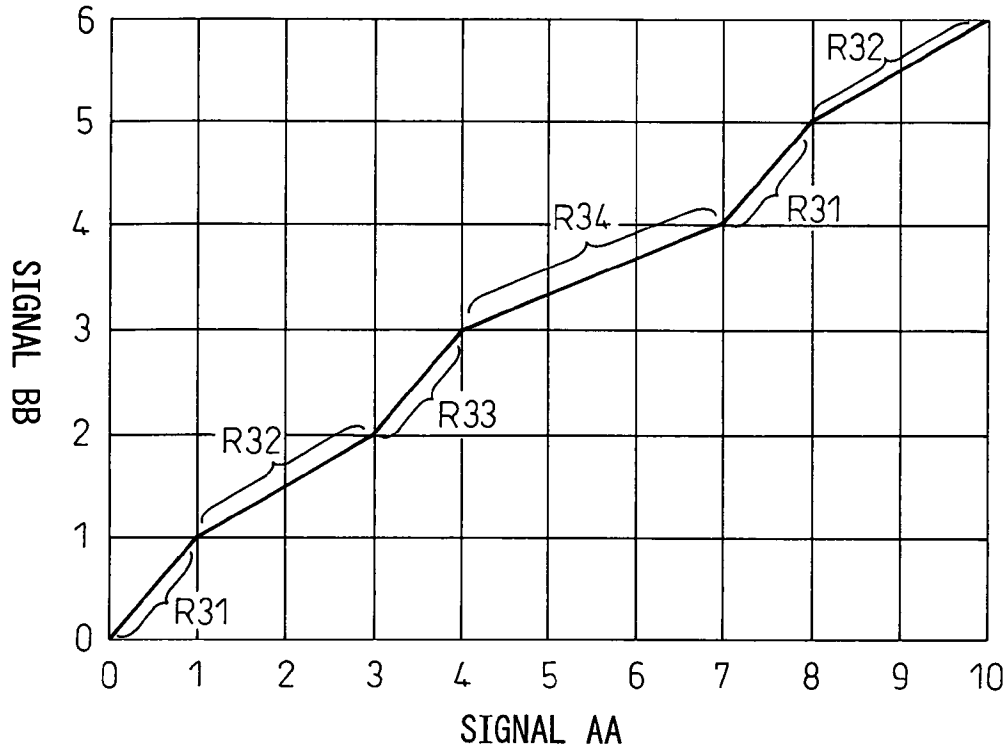

<RELATIONS BETWEEN SIGNAL AA AND SIGNAL BB>

REGION R31 $7\times k \leqq$ SIGNAL AA $< 7\times k+1$ : SLOPE1 INTERCEPT $-k\times 3$
REGION R33 $7\times k+3 \leqq$ SIGNAL AA $< 7\times k+4$ : SLOPE1 INTERCEPT $-k+3-1$
REGION R32 $7\times k+1 \leqq$ SIGNAL AA $< 7\times k+3$ : SLOPE1/2 INTERCEPT $(1/2)\times(k+1)$
REGION R34 $7\times k+4 \leqq$ SIGNAL AA $< 7\times(k+1)$ : SLOPE1/3 INTERCEPT $(1/3)\times(k+1)\times 5$
$(k=0.1.2.\cdots)$ Fig.36 ※WHEN REMAINDER IS 0, P31 IS SELECTED;
WHEN REMAINDER IS 1 OR 2, P32 IS SELECTED;
WHEN REMAINDER IS 3, P33 IS SELECTED;
OTHERWISE, P34 IS SELECTED

| AA | P31 | P32 | P33 | P34 | BB | DISPLAY |
|---|---|---|---|---|---|---|
| 0 | 0 | 0.5 | -1 | 1.666667 | 0 | 0 |
| 1 | 1 | 1 | 0 | 2 | 1 | 1 |
| 2 | 2 | 1.5 | 1 | 2.333333 | 1.5 | 2 |
| 3 | 3 | 2 | 2 | 2.666667 | 2 | 3 |
| 4 | 4 | 2.5 | 3 | 3 | 3 | 4 |
| 5 | 5 | 3 | 4 | 3.333333 | 3.333333 | 5 |
| 6 | 6 | 3.5 | 5 | 3.666667 | 3.666667 | 6 |
| 7 | 4 | 4.5 | 3 | 5.666667 | 4 | 7 |
| 8 | 5 | 5 | 4 | 6 | 5 | 8 |
| 9 | 6 | 5.5 | 5 | 6.333333 | 5.5 | 9 |
| 10 | 7 | 6 | 6 | 6.666667 | 6 | 10 |
| 11 | 8 | 6.5 | 7 | 7 | 7 | 11 |
| 12 | 9 | 7 | 8 | 7.333333 | 7.333333 | 12 |
| 13 | 10 | 7.5 | 9 | 7.666667 | 7.666667 | 13 |
| 14 | 8 | 8.5 | 7 | 9.666667 | 8 | 14 |
| 15 | 9 | 9 | 8 | 10 | 9 | 15 |
| 16 | 10 | 9.5 | 9 | 10.33333 | 9.5 | 16 |
| 17 | 11 | 10 | 10 | 10.66667 | 10 | 17 |
| 18 | 12 | 10.5 | 11 | 11 | 11 | 18 |
| 19 | 13 | 11 | 12 | 11.33333 | 11.33333 | 19 |
| 20 | 14 | 11.5 | 13 | 11.66667 | 11.66667 | 20 |
| 21 | 12 | 12.5 | 11 | 13.66667 | 12 | 21 |
| 22 | 13 | 13 | 12 | 14 | 13 | 22 |
| 23 | 14 | 13.5 | 13 | 14.33333 | 13.5 | 23 |
| 24 | 15 | 14 | 14 | 14.66667 | 14 | 24 |
| 25 | 16 | 14.5 | 15 | 15 | 15 | 25 |
| 26 | 17 | 15 | 16 | 15.33333 | 15.33333 | 26 |
| 27 | 18 | 15.5 | 17 | 15.66667 | 15.66667 | 27 |
| 28 | 16 | 16.5 | 15 | 17.66667 | 16 | 28 |
| 29 | 17 | 17 | 16 | 18 | 17 | 29 |
| 30 | 18 | 17.5 | 17 | 18.33333 | 17.5 | 30 |
| 31 | 19 | 18 | 18 | 18.66667 | 18 | 31 |
| 32 | 20 | 18.5 | 19 | 19 | 19 | 32 |
| 33 | 21 | 19 | 20 | 19.33333 | 19.33333 | 33 |
| 34 | 22 | 19.5 | 21 | 19.66667 | 19.66667 | 34 |
| 35 | 20 | 20.5 | 19 | 21.66667 | 20 | 35 |
| 36 | 21 | 21 | 20 | 22 | 21 | 36 |
| 37 | 22 | 21.5 | 21 | 22.33333 | 21.5 | 37 |

Fig.37 ※WHEN REMAINDER IS 0, P31 IS SELECTED;
WHEN REMAINDER IS 1 OR 2, P32 IS SELECTED;
WHEN REMAINDER IS 3, P33 IS SELECTED;
OTHERWISE, P34 IS SELECTED

| AA | P31 | P32 | P33 | P34 | BB | DISPLAY |
|---|---|---|---|---|---|---|
| 38 | 23 | 22 | 22 | 22.66667 | 22 | 38 |
| 39 | 24 | 22.5 | 23 | 23 | 23 | 39 |
| 40 | 25 | 23 | 24 | 23.33333 | 23.33333 | 40 |
| 41 | 26 | 23.5 | 25 | 23.66667 | 23.66667 | 41 |
| 42 | 24 | 24.5 | 23 | 25.66667 | 24 | 42 |
| 43 | 25 | 25 | 24 | 26 | 25 | 43 |
| 44 | 26 | 25.5 | 25 | 26.33333 | 25.5 | 44 |
| 45 | 27 | 26 | 26 | 26.66667 | 26 | 45 |
| 46 | 28 | 26.5 | 27 | 27 | 27 | 46 |
| 47 | 29 | 27 | 28 | 27.33333 | 27.33333 | 47 |
| 48 | 30 | 27.5 | 29 | 27.66667 | 27.66667 | 48 |
| 49 | 28 | 28.5 | 27 | 29.66667 | 28 | 49 |
| 50 | 29 | 29 | 28 | 30 | 29 | 50 |
| 51 | 30 | 29.5 | 29 | 30.33333 | 29.5 | 51 |
| 52 | 31 | 30 | 30 | 30.66667 | 30 | 52 |
| 53 | 32 | 30.5 | 31 | 31 | 31 | 53 |
| 54 | 33 | 31 | 32 | 31.33333 | 31.33333 | 54 |
| 55 | 34 | 31.5 | 33 | 31.66667 | 31.66667 | 55 |
| 56 | 32 | 32.5 | 31 | 33.66667 | 32 | 56 |
| 57 | 33 | 33 | 32 | 34 | 33 | 57 |
| 58 | 34 | 33.5 | 33 | 34.33333 | 33.5 | 58 |
| 59 | 35 | 34 | 34 | 34.66667 | 34 | 59 |
| 60 | 36 | 34.5 | 35 | 35 | 35 | 60 |
| 61 | 37 | 35 | 36 | 35.33333 | 35.33333 | 61 |
| 62 | 38 | 35.5 | 37 | 35.66667 | 35.66667 | 62 |
| 63 | 36 | 36.5 | 35 | 37.66667 | 36 | 63 |
| 64 | 37 | 37 | 36 | 38 | 37 | 64 |
| 65 | 38 | 37.5 | 37 | 38.33333 | 37.5 | 65 |
| 66 | 39 | 38 | 38 | 38.66667 | 38 | 66 |
| 67 | 40 | 38.5 | 39 | 39 | 39 | 67 |
| 68 | 41 | 39 | 40 | 39.33333 | 39.33333 | 68 |
| 69 | 42 | 39.5 | 41 | 39.66667 | 39.66667 | 69 |
| 70 | 40 | 40.5 | 39 | 41.66667 | 40 | 70 |
| 71 | 41 | 41 | 40 | 42 | 41 | 71 |
| 72 | 42 | 41.5 | 41 | 42.33333 | 41.5 | 72 |
| 73 | 43 | 42 | 42 | 42.66667 | 42 | 73 |
| 74 | 44 | 42.5 | 43 | 43 | 43 | 74 |
| 75 | 45 | 43 | 44 | 43.33333 | 43.33333 | 75 |
| 76 | 46 | 43.5 | 45 | 43.66667 | 43.66667 | 76 |

Fig.38 ※WHEN REMAINDER IS 0, P31 IS SELECTED;
WHEN REMAINDER IS 1 OR 2, P32 IS SELECTED;
WHEN REMAINDER IS 3, P33 IS SELECTED;
OTHERWISE, P34 IS SELECTED

| AA | P31 | P32 | P33 | P34 | BB | DISPLAY |
|---|---|---|---|---|---|---|
| 77 | 44 | 44.5 | 43 | 45.66667 | 44 | 77 |
| 78 | 45 | 45 | 44 | 46 | 45 | 78 |
| 79 | 46 | 45.5 | 45 | 46.33333 | 45.5 | 79 |
| 80 | 47 | 46 | 46 | 46.66667 | 46 | 80 |
| 81 | 48 | 46.5 | 47 | 47 | 47 | 81 |
| 82 | 49 | 47 | 48 | 47.33333 | 47.33333 | 82 |
| 83 | 50 | 47.5 | 49 | 47.66667 | 47.66667 | 83 |
| 84 | 48 | 48.5 | 47 | 49.66667 | 48 | 84 |
| 85 | 49 | 49 | 48 | 50 | 49 | 85 |
| 86 | 50 | 49.5 | 49 | 50.33333 | 49.5 | 86 |
| 87 | 51 | 50 | 50 | 50.66667 | 50 | 87 |
| 88 | 52 | 50.5 | 51 | 51 | 51 | 88 |
| 89 | 53 | 51 | 52 | 51.33333 | 51.33333 | 89 |
| 90 | 54 | 51.5 | 53 | 51.66667 | 51.66667 | 90 |
| 91 | 52 | 52.5 | 51 | 53.66667 | 52 | 91 |
| 92 | 53 | 53 | 52 | 54 | 53 | 92 |
| 93 | 54 | 53.5 | 53 | 54.33333 | 53.5 | 93 |
| 94 | 55 | 54 | 54 | 54.66667 | 54 | 94 |
| 95 | 56 | 54.5 | 55 | 55 | 55 | 95 |
| 96 | 57 | 55 | 56 | 55.33333 | 55.33333 | 96 |
| 97 | 58 | 55.5 | 57 | 55.66667 | 55.66667 | 97 |
| 98 | 56 | 56.5 | 55 | 57.66667 | 56 | 98 |
| 99 | 57 | 57 | 56 | 58 | 57 | 99 |
| 100 | 58 | 57.5 | 57 | 58.33333 | 57.5 | 100 |
| 101 | 59 | 58 | 58 | 58.66667 | 58 | 101 |
| 102 | 60 | 58.5 | 59 | 59 | 59 | 102 |
| 103 | 61 | 59 | 60 | 59.33333 | 59.33333 | 103 |
| 104 | 62 | 59.5 | 61 | 59.66667 | 59.66667 | 104 |
| 105 | 60 | 60.5 | 59 | 61.66667 | 60 | 105 |
| 106 | 61 | 61 | 60 | 62 | 61 | 106 |
| 107 | 62 | 61.5 | 61 | 62.33333 | 61.5 | 107 |
| 108 | 63 | 62 | 62 | 62.66667 | 62 | 108 |
| 109 | 64 | 62.5 | 63 | 63 | 63 | 109 |
| 110 | 65 | 63 | 64 | 63.33333 | 63.33333 | 110 |
| 111 | 66 | 63.5 | 65 | 63.66667 | 63.66667 | 111 |
| 112 | 64 | 64.5 | 63 | 65.66667 | 64 | 112 |
| 113 | 65 | 65 | 64 | 66 | 65 | 113 |
| 114 | 66 | 65.5 | 65 | 66.33333 | 65.5 | 114 |
| 115 | 67 | 66 | 66 | 66.66667 | 66 | 115 |

Fig.39

※WHEN REMAINDER IS 0, P31 IS SELECTED;
WHEN REMAINDER IS 1 OR 2, P32 IS SELECTED;
WHEN REMAINDER IS 3, P33 IS SELECTED;
OTHERWISE, P34 IS SELECTED

| AA | P31 | P32 | P33 | P34 | BB | DISPLAY |
|---|---|---|---|---|---|---|
| 116 | 68 | 66.5 | 67 | 67 | 67 | 116 |
| 117 | 69 | 67 | 68 | 67.33333 | 67.33333 | 117 |
| 118 | 70 | 67.5 | 69 | 67.66667 | 67.66667 | 118 |
| 119 | 68 | 68.5 | 67 | 69.66667 | 68 | 119 |
| 120 | 69 | 69 | 68 | 70 | 69 | 120 |
| 121 | 70 | 69.5 | 69 | 70.33333 | 69.5 | 121 |
| 122 | 71 | 70 | 70 | 70.66667 | 70 | 122 |
| 123 | 72 | 70.5 | 71 | 71 | 71 | 123 |
| 124 | 73 | 71 | 72 | 71.33333 | 71.33333 | 124 |
| 125 | 74 | 71.5 | 73 | 71.66667 | 71.66667 | 125 |
| 126 | 72 | 72.5 | 71 | 73.66667 | 72 | 126 |
| 127 | 73 | 73 | 72 | 74 | 73 | 127 |
| 128 | 74 | 73.5 | 73 | 74.33333 | 73.5 | 128 |
| 129 | 75 | 74 | 74 | 74.66667 | 74 | 129 |
| 130 | 76 | 74.5 | 75 | 75 | 75 | 130 |
| 131 | 77 | 75 | 76 | 75.33333 | 75.33333 | 131 |
| 132 | 78 | 75.5 | 77 | 75.66667 | 75.66667 | 132 |
| 133 | 76 | 76.5 | 75 | 77.66667 | 76 | 133 |
| 134 | 77 | 77 | 76 | 78 | 77 | 134 |
| 135 | 78 | 77.5 | 77 | 78.33333 | 77.5 | 135 |
| 136 | 79 | 78 | 78 | 78.66667 | 78 | 136 |
| 137 | 80 | 78.5 | 79 | 79 | 79 | 137 |
| 138 | 81 | 79 | 80 | 79.33333 | 79.33333 | 138 |
| 139 | 82 | 79.5 | 81 | 79.66667 | 79.66667 | 139 |
| 140 | 80 | 80.5 | 79 | 81.66667 | 80 | 140 |
| 141 | 81 | 81 | 80 | 82 | 81 | 141 |
| 142 | 82 | 81.5 | 81 | 82.33333 | 81.5 | 142 |
| 143 | 83 | 82 | 82 | 82.66667 | 82 | 143 |
| 144 | 84 | 82.5 | 83 | 83 | 83 | 144 |
| 145 | 85 | 83 | 84 | 83.33333 | 83.33333 | 145 |
| 146 | 86 | 83.5 | 85 | 83.66667 | 83.66667 | 146 |
| 147 | 84 | 84.5 | 83 | 85.66667 | 84 | 147 |
| 148 | 85 | 85 | 84 | 86 | 85 | 148 |
| 149 | 86 | 85.5 | 85 | 86.33333 | 85.5 | 149 |
| 150 | 87 | 86 | 86 | 86.66667 | 86 | 150 |
| 151 | 88 | 86.5 | 87 | 87 | 87 | 151 |
| 152 | 89 | 87 | 88 | 87.33333 | 87.33333 | 152 |
| 153 | 90 | 87.5 | 89 | 87.66667 | 87.66667 | 153 |
| 154 | 88 | 88.5 | 87 | 89.66667 | 88 | 154 |

Fig. 40

※WHEN REMAINDER IS 0, P31 IS SELECTED;
WHEN REMAINDER IS 1 OR 2, P32 IS SELECTED;
WHEN REMAINDER IS 3, P33 IS SELECTED;
OTHERWISE, P34 IS SELECTED

| AA | P31 | P32 | P33 | P34 | BB | DISPLAY |
|---|---|---|---|---|---|---|
| 155 | 89 | 89 | 88 | 90 | 89 | 155 |
| 156 | 90 | 89.5 | 89 | 90.33333 | 89.5 | 156 |
| 157 | 91 | 90 | 90 | 90.66667 | 90 | 157 |
| 158 | 92 | 90.5 | 91 | 91 | 91 | 158 |
| 159 | 93 | 91 | 92 | 91.33333 | 91.33333 | 159 |
| 160 | 94 | 91.5 | 93 | 91.66667 | 91.66667 | 160 |
| 161 | 92 | 92.5 | 91 | 93.66667 | 92 | 161 |
| 162 | 93 | 93 | 92 | 94 | 93 | 162 |
| 163 | 94 | 93.5 | 93 | 94.33333 | 93.5 | 163 |
| 164 | 95 | 94 | 94 | 94.66667 | 94 | 164 |
| 165 | 96 | 94.5 | 95 | 95 | 95 | 165 |
| 166 | 97 | 95 | 96 | 95.33333 | 95.33333 | 166 |
| 167 | 98 | 95.5 | 97 | 95.66667 | 95.66667 | 167 |
| 168 | 96 | 96.5 | 95 | 97.66667 | 96 | 168 |
| 169 | 97 | 97 | 96 | 98 | 97 | 169 |
| 170 | 98 | 97.5 | 97 | 98.33333 | 97.5 | 170 |
| 171 | 99 | 98 | 98 | 98.66667 | 98 | 171 |
| 172 | 100 | 98.5 | 99 | 99 | 99 | 172 |
| 173 | 101 | 99 | 100 | 99.33333 | 99.33333 | 173 |
| 174 | 102 | 99.5 | 101 | 99.66667 | 99.66667 | 174 |
| 175 | 100 | 100.5 | 99 | 101.6667 | 100 | 175 |
| 176 | 101 | 101 | 100 | 102 | 101 | 176 |
| 177 | 102 | 101.5 | 101 | 102.3333 | 101.5 | 177 |
| 178 | 103 | 102 | 102 | 102.6667 | 102 | 178 |
| 179 | 104 | 102.5 | 103 | 103 | 103 | 179 |
| 180 | 105 | 103 | 104 | 103.3333 | 103.3333 | 180 |
| 181 | 106 | 103.5 | 105 | 103.6667 | 103.6667 | 181 |
| 182 | 104 | 104.5 | 103 | 105.6667 | 104 | 182 |
| 183 | 105 | 105 | 104 | 106 | 105 | 183 |
| 184 | 106 | 105.5 | 105 | 106.3333 | 105.5 | 184 |
| 185 | 107 | 106 | 106 | 106.6667 | 106 | 185 |
| 186 | 108 | 106.5 | 107 | 107 | 107 | 186 |
| 187 | 109 | 107 | 108 | 107.3333 | 107.3333 | 187 |
| 188 | 110 | 107.5 | 109 | 107.6667 | 107.6667 | 188 |
| 189 | 108 | 108.5 | 107 | 109.6667 | 108 | 189 |
| 190 | 109 | 109 | 108 | 110 | 109 | 190 |
| 191 | 110 | 109.5 | 109 | 110.3333 | 109.5 | 191 |
| 192 | 111 | 110 | 110 | 110.6667 | 110 | 192 |
| 193 | 112 | 110.5 | 111 | 111 | 111 | 193 |

Fig.41 ※WHEN REMAINDER IS 0, P31 IS SELECTED;
WHEN REMAINDER IS 1 OR 2, P32 IS SELECTED;
WHEN REMAINDER IS 3, P33 IS SELECTED;
OTHERWISE, P34 IS SELECTED

| AA | P31 | P32 | P33 | P34 | BB | DISPLAY |
|---|---|---|---|---|---|---|
| 194 | 113 | 111 | 112 | 111.3333 | 111.3333 | 194 |
| 195 | 114 | 111.5 | 113 | 111.6667 | 111.6667 | 195 |
| 196 | 112 | 112.5 | 111 | 113.6667 | 112 | 196 |
| 197 | 113 | 113 | 112 | 114 | 113 | 197 |
| 198 | 114 | 113.5 | 113 | 114.3333 | 113.5 | 198 |
| 199 | 115 | 114 | 114 | 114.6667 | 114 | 199 |
| 200 | 116 | 114.5 | 115 | 115 | 115 | 200 |
| 201 | 117 | 115 | 116 | 115.3333 | 115.3333 | 201 |
| 202 | 118 | 115.5 | 117 | 115.6667 | 115.6667 | 202 |
| 203 | 116 | 116.5 | 115 | 117.6667 | 116 | 203 |
| 204 | 117 | 117 | 116 | 118 | 117 | 204 |
| 205 | 118 | 117.5 | 117 | 118.3333 | 117.5 | 205 |
| 206 | 119 | 118 | 118 | 118.6667 | 118 | 206 |
| 207 | 120 | 118.5 | 119 | 119 | 119 | 207 |
| 208 | 121 | 119 | 120 | 119.3333 | 119.3333 | 208 |
| 209 | 122 | 119.5 | 121 | 119.6667 | 119.6667 | 209 |
| 210 | 120 | 120.5 | 119 | 121.6667 | 120 | 210 |
| 211 | 121 | 121 | 120 | 122 | 121 | 211 |
| 212 | 122 | 121.5 | 121 | 122.3333 | 121.5 | 212 |
| 213 | 123 | 122 | 122 | 122.6667 | 122 | 213 |
| 214 | 124 | 122.5 | 123 | 123 | 123 | 214 |
| 215 | 125 | 123 | 124 | 123.3333 | 123.3333 | 215 |
| 216 | 126 | 123.5 | 125 | 123.6667 | 123.6667 | 216 |
| 217 | 124 | 124.5 | 123 | 125.6667 | 124 | 217 |
| 218 | 125 | 125 | 124 | 126 | 125 | 218 |
| 219 | 126 | 125.5 | 125 | 126.3333 | 125.5 | 219 |
| 220 | 127 | 126 | 126 | 126.6667 | 126 | 220 |
| 221 | 128 | 126.5 | 127 | 127 | 127 | 221 |
| 222 | 129 | 127 | 128 | 127.3333 | 127.3333 | 222 |
| 223 | 130 | 127.5 | 129 | 127.6667 | 127.6667 | 223 |
| 224 | 128 | 128.5 | 127 | 129.6667 | 128 | 224 |
| 225 | 129 | 129 | 128 | 130 | 129 | 225 |
| 226 | 130 | 129.5 | 129 | 130.3333 | 129.5 | 226 |
| 227 | 131 | 130 | 130 | 130.6667 | 130 | 227 |
| 228 | 132 | 130.5 | 131 | 131 | 131 | 228 |
| 229 | 133 | 131 | 132 | 131.3333 | 131.3333 | 229 |
| 230 | 134 | 131.5 | 133 | 131.6667 | 131.6667 | 230 |
| 231 | 132 | 132.5 | 131 | 133.6667 | 132 | 231 |
| 232 | 133 | 133 | 132 | 134 | 133 | 232 |

Fig.42

※WHEN REMAINDER IS 0, P31 IS SELECTED;
WHEN REMAINDER IS 1 OR 2, P32 IS SELECTED;
WHEN REMAINDER IS 3, P33 IS SELECTED;
OTHERWISE, P34 IS SELECTED

| AA | P31 | P32 | P33 | P34 | BB | DISPLAY |
|---|---|---|---|---|---|---|
| 233 | 134 | 133.5 | 133 | 134.3333 | 133.5 | 233 |
| 234 | 135 | 134 | 134 | 134.6667 | 134 | 234 |
| 235 | 136 | 134.5 | 135 | 135 | 135 | 235 |
| 236 | 137 | 135 | 136 | 135.3333 | 135.3333 | 236 |
| 237 | 138 | 135.5 | 137 | 135.6667 | 135.6667 | 237 |
| 238 | 136 | 136.5 | 135 | 137.6667 | 136 | 238 |
| 239 | 137 | 137 | 136 | 138 | 137 | 239 |
| 240 | 138 | 137.5 | 137 | 138.3333 | 137.5 | 240 |
| 241 | 139 | 138 | 138 | 138.6667 | 138 | 241 |
| 242 | 140 | 138.5 | 139 | 139 | 139 | 242 |
| 243 | 141 | 139 | 140 | 139.3333 | 139.3333 | 243 |
| 244 | 142 | 139.5 | 141 | 139.6667 | 139.6667 | 244 |
| 245 | 140 | 140.5 | 139 | 141.6667 | 140 | 245 |
| 246 | 141 | 141 | 140 | 142 | 141 | 246 |
| 247 | 142 | 141.5 | 141 | 142.3333 | 141.5 | 247 |
| 248 | 143 | 142 | 142 | 142.6667 | 142 | 248 |
| 249 | 144 | 142.5 | 143 | 143 | 143 | 249 |
| 250 | 145 | 143 | 144 | 143.3333 | 143.3333 | 250 |
| 251 | 146 | 143.5 | 145 | 143.6667 | 143.6667 | 251 |
| 252 | 144 | 144.5 | 143 | 145.6667 | 144 | 252 |
| 253 | 145 | 145 | 144 | 146 | 145 | 253 |
| 254 | 146 | 145.5 | 145 | 146.3333 | 145.5 | 254 |
| 255 | 147 | 146 | 146 | 146.6667 | 146 | 255 |
| 256 | 148 | 146.5 | 147 | 147 | 147 | 256 |

<RELATIONS BETWEEN SIGNAL AA AND SIGNAL BB>

REGION R41 $5 \times k \leqq$ SIGNAL AA $< 5 \times k+1$ : SLOPE1 INTERCEPT$-k \times 3$ REGION R42 $5 \times k+1 \leqq$ SIGNAL AA $< 5 \times (k+1)$ : SLOPE3/4 INTERCEPT$(1/4) \times (k+1)$ (k=0. 1. 2. ·)

Fig. 45

※WHEN REMAINDER IS 0, P41 IS SELECTED;
OTHERWISE, P42 IS SELECTED

| AA | P41 | P42 | BB | DISPLAY |
|---|---|---|---|---|
| 0 | 0 | 0.25 | 0 | 0 |
| 1 | 1 | 1 | 1 | 1 |
| 2 | 2 | 1.75 | 1.75 | 2 |
| 3 | 3 | 2.5 | 2.5 | 3 |
| 4 | 4 | 3.25 | 3.25 | 4 |
| 5 | 4 | 4.25 | 4 | 5 |
| 6 | 5 | 5 | 5 | 6 |
| 7 | 6 | 5.75 | 5.75 | 7 |
| 8 | 7 | 6.5 | 6.5 | 8 |
| 9 | 8 | 7.25 | 7.25 | 9 |
| 10 | 8 | 8.25 | 8 | 10 |
| 11 | 9 | 9 | 9 | 11 |
| 12 | 10 | 9.75 | 9.75 | 12 |
| 13 | 11 | 10.5 | 10.5 | 13 |
| 14 | 12 | 11.25 | 11.25 | 14 |
| 15 | 12 | 12.25 | 12 | 15 |
| 16 | 13 | 13 | 13 | 16 |
| 17 | 14 | 13.75 | 13.75 | 17 |
| 18 | 15 | 14.5 | 14.5 | 18 |
| 19 | 16 | 15.25 | 15.25 | 19 |
| 20 | 16 | 16.25 | 16 | 20 |
| 21 | 17 | 17 | 17 | 21 |
| 22 | 18 | 17.75 | 17.75 | 22 |
| 23 | 19 | 18.5 | 18.5 | 23 |
| 24 | 20 | 19.25 | 19.25 | 24 |
| 25 | 20 | 20.25 | 20 | 25 |
| 26 | 21 | 21 | 21 | 26 |
| 27 | 22 | 21.75 | 21.75 | 27 |
| 28 | 23 | 22.5 | 22.5 | 28 |
| 29 | 24 | 23.25 | 23.25 | 29 |
| 30 | 24 | 24.25 | 24 | 30 |
| 31 | 25 | 25 | 25 | 31 |
| 32 | 26 | 25.75 | 25.75 | 32 |
| 33 | 27 | 26.5 | 26.5 | 33 |
| 34 | 28 | 27.25 | 27.25 | 34 |
| 35 | 28 | 28.25 | 28 | 35 |
| 36 | 29 | 29 | 29 | 36 |
| 37 | 30 | 29.75 | 29.75 | 37 |

Fig. 46

※WHEN REMAINDER IS 0, P41 IS SELECTED;
OTHERWISE, P42 IS SELECTED

| AA | P41 | P42 | BB | DISPLAY |
|---|---|---|---|---|
| 38 | 31 | 30.5 | 30.5 | 38 |
| 39 | 32 | 31.25 | 31.25 | 39 |
| 40 | 32 | 32.25 | 32 | 40 |
| 41 | 33 | 33 | 33 | 41 |
| 42 | 34 | 33.75 | 33.75 | 42 |
| 43 | 35 | 34.5 | 34.5 | 43 |
| 44 | 36 | 35.25 | 35.25 | 44 |
| 45 | 36 | 36.25 | 36 | 45 |
| 46 | 37 | 37 | 37 | 46 |
| 47 | 38 | 37.75 | 37.75 | 47 |
| 48 | 39 | 38.5 | 38.5 | 48 |
| 49 | 40 | 39.25 | 39.25 | 49 |
| 50 | 40 | 40.25 | 40 | 50 |
| 51 | 41 | 41 | 41 | 51 |
| 52 | 42 | 41.75 | 41.75 | 52 |
| 53 | 43 | 42.5 | 42.5 | 53 |
| 54 | 44 | 43.25 | 43.25 | 54 |
| 55 | 44 | 44.25 | 44 | 55 |
| 56 | 45 | 45 | 45 | 56 |
| 57 | 46 | 45.75 | 45.75 | 57 |
| 58 | 47 | 46.5 | 46.5 | 58 |
| 59 | 48 | 47.25 | 47.25 | 59 |
| 60 | 48 | 48.25 | 48 | 60 |
| 61 | 49 | 49 | 49 | 61 |
| 62 | 50 | 49.75 | 49.75 | 62 |
| 63 | 51 | 50.5 | 50.5 | 63 |
| 64 | 52 | 51.25 | 51.25 | 64 |
| 65 | 52 | 52.25 | 52 | 65 |
| 66 | 53 | 53 | 53 | 66 |
| 67 | 54 | 53.75 | 53.75 | 67 |
| 68 | 55 | 54.5 | 54.5 | 68 |
| 69 | 56 | 55.25 | 55.25 | 69 |
| 70 | 56 | 56.25 | 56 | 70 |
| 71 | 57 | 57 | 57 | 71 |
| 72 | 58 | 57.75 | 57.75 | 72 |
| 73 | 59 | 58.5 | 58.5 | 73 |
| 74 | 60 | 59.25 | 59.25 | 74 |
| 75 | 60 | 60.25 | 60 | 75 |
| 76 | 61 | 61 | 61 | 76 |

Fig.47

※WHEN REMAINDER IS 0, P41 IS SELECTED;
OTHERWISE, P42 IS SELECTED

| AA | P41 | P42 | BB | DISPLAY |
|---|---|---|---|---|
| 77 | 62 | 61.75 | 61.75 | 77 |
| 78 | 63 | 62.5 | 62.5 | 78 |
| 79 | 64 | 63.25 | 63.25 | 79 |
| 80 | 64 | 64.25 | 64 | 80 |
| 81 | 65 | 65 | 65 | 81 |
| 82 | 66 | 65.75 | 65.75 | 82 |
| 83 | 67 | 66.5 | 66.5 | 83 |
| 84 | 68 | 67.25 | 67.25 | 84 |
| 85 | 68 | 68.25 | 68 | 85 |
| 86 | 69 | 69 | 69 | 86 |
| 87 | 70 | 69.75 | 69.75 | 87 |
| 88 | 71 | 70.5 | 70.5 | 88 |
| 89 | 72 | 71.25 | 71.25 | 89 |
| 90 | 72 | 72.25 | 72 | 90 |
| 91 | 73 | 73 | 73 | 91 |
| 92 | 74 | 73.75 | 73.75 | 92 |
| 93 | 75 | 74.5 | 74.5 | 93 |
| 94 | 76 | 75.25 | 75.25 | 94 |
| 95 | 76 | 76.25 | 76 | 95 |
| 96 | 77 | 77 | 77 | 96 |
| 97 | 78 | 77.75 | 77.75 | 97 |
| 98 | 79 | 78.5 | 78.5 | 98 |
| 99 | 80 | 79.25 | 79.25 | 99 |
| 100 | 80 | 80.25 | 80 | 100 |
| 101 | 81 | 81 | 81 | 101 |
| 102 | 82 | 81.75 | 81.75 | 102 |
| 103 | 83 | 82.5 | 82.5 | 103 |
| 104 | 84 | 83.25 | 83.25 | 104 |
| 105 | 84 | 84.25 | 84 | 105 |
| 106 | 85 | 85 | 85 | 106 |
| 107 | 86 | 85.75 | 85.75 | 107 |
| 108 | 87 | 86.5 | 86.5 | 108 |
| 109 | 88 | 87.25 | 87.25 | 109 |
| 110 | 88 | 88.25 | 88 | 110 |
| 111 | 89 | 89 | 89 | 111 |
| 112 | 90 | 89.75 | 89.75 | 112 |
| 113 | 91 | 90.5 | 90.5 | 113 |
| 114 | 92 | 91.25 | 91.25 | 114 |
| 115 | 92 | 92.25 | 92 | 115 |

Fig. 48

※WHEN REMAINDER IS 0, P41 IS SELECTED; OTHERWISE, P42 IS SELECTED

| AA | P41 | P42 | BB | DISPLAY |
|---|---|---|---|---|
| 116 | 93 | 93 | 93 | 116 |
| 117 | 94 | 93.75 | 93.75 | 117 |
| 118 | 95 | 94.5 | 94.5 | 118 |
| 119 | 96 | 95.25 | 95.25 | 119 |
| 120 | 96 | 96.25 | 96 | 120 |
| 121 | 97 | 97 | 97 | 121 |
| 122 | 98 | 97.75 | 97.75 | 122 |
| 123 | 99 | 98.5 | 98.5 | 123 |
| 124 | 100 | 99.25 | 99.25 | 124 |
| 125 | 100 | 100.25 | 100 | 125 |
| 126 | 101 | 101 | 101 | 126 |
| 127 | 102 | 101.75 | 101.75 | 127 |
| 128 | 103 | 102.5 | 102.5 | 128 |
| 129 | 104 | 103.25 | 103.25 | 129 |
| 130 | 104 | 104.25 | 104 | 130 |
| 131 | 105 | 105 | 105 | 131 |
| 132 | 106 | 105.75 | 105.75 | 132 |
| 133 | 107 | 106.5 | 106.5 | 133 |
| 134 | 108 | 107.25 | 107.25 | 134 |
| 135 | 108 | 108.25 | 108 | 135 |
| 136 | 109 | 109 | 109 | 136 |
| 137 | 110 | 109.75 | 109.75 | 137 |
| 138 | 111 | 110.5 | 110.5 | 138 |
| 139 | 112 | 111.25 | 111.25 | 139 |
| 140 | 112 | 112.25 | 112 | 140 |
| 141 | 113 | 113 | 113 | 141 |
| 142 | 114 | 113.75 | 113.75 | 142 |
| 143 | 115 | 114.5 | 114.5 | 143 |
| 144 | 116 | 115.25 | 115.25 | 144 |
| 145 | 116 | 116.25 | 116 | 145 |
| 146 | 117 | 117 | 117 | 146 |
| 147 | 118 | 117.75 | 117.75 | 147 |
| 148 | 119 | 118.5 | 118.5 | 148 |
| 149 | 120 | 119.25 | 119.25 | 149 |
| 150 | 120 | 120.25 | 120 | 150 |
| 151 | 121 | 121 | 121 | 151 |
| 152 | 122 | 121.75 | 121.75 | 152 |
| 153 | 123 | 122.5 | 122.5 | 153 |
| 154 | 124 | 123.25 | 123.25 | 154 |

Fig. 49

※WHEN REMAINDER IS 0, P41 IS SELECTED; OTHERWISE, P42 IS SELECTED

| AA | P41 | P42 | BB | DISPLAY |
|---|---|---|---|---|
| 155 | 124 | 124.25 | 124 | 155 |
| 156 | 125 | 125 | 125 | 156 |
| 157 | 126 | 125.75 | 125.75 | 157 |
| 158 | 127 | 126.5 | 126.5 | 158 |
| 159 | 128 | 127.25 | 127.25 | 159 |
| 160 | 128 | 128.25 | 128 | 160 |
| 161 | 129 | 129 | 129 | 161 |
| 162 | 130 | 129.75 | 129.75 | 162 |
| 163 | 131 | 130.5 | 130.5 | 163 |
| 164 | 132 | 131.25 | 131.25 | 164 |
| 165 | 132 | 132.25 | 132 | 165 |
| 166 | 133 | 133 | 133 | 166 |
| 167 | 134 | 133.75 | 133.75 | 167 |
| 168 | 135 | 134.5 | 134.5 | 168 |
| 169 | 136 | 135.25 | 135.25 | 169 |
| 170 | 136 | 136.25 | 136 | 170 |
| 171 | 137 | 137 | 137 | 171 |
| 172 | 138 | 137.75 | 137.75 | 172 |
| 173 | 139 | 138.5 | 138.5 | 173 |
| 174 | 140 | 139.25 | 139.25 | 174 |
| 175 | 140 | 140.25 | 140 | 175 |
| 176 | 141 | 141 | 141 | 176 |
| 177 | 142 | 141.75 | 141.75 | 177 |
| 178 | 143 | 142.5 | 142.5 | 178 |
| 179 | 144 | 143.25 | 143.25 | 179 |
| 180 | 144 | 144.25 | 144 | 180 |
| 181 | 145 | 145 | 145 | 181 |
| 182 | 146 | 145.75 | 145.75 | 182 |
| 183 | 147 | 146.5 | 146.5 | 183 |
| 184 | 148 | 147.25 | 147.25 | 184 |

SUB GAIN CONTROL CIRCUIT IS USED

SUB GAIN CONTROL CIRCUIT IS NOT USED

Fig.51

| INPUT SIGNAL | WITH SUB GAIN CONTROL CIRCUIT 256 GRAY SCALES SIGNAL A1 | 220 GRAY SCALES COMPUTATION (1) | COMPUTATION (2) | 148 GRAY SCALES SIGNAL B1 | FRACTIONAL PART α | 1−α | 220 GRAY SCALES FRACTIONAL PART' SIGNAL C1 | WITHOUT SUB GAIN CONTROL CIRCUIT 147 GRAY SCALES SIGNAL A2 | FRACTIONAL PART β | 1−β | FRACTIONAL PART | ERROR OF OUTPUT SIGNAL ACCURACY 220 GRAY SCALES SIGNAL C2 | DISPLAY 1 A1−C1 | DISPLAY 2 A1−C2 |
|---|---|---|---|---|---|---|---|---|---|---|---|---|---|---|
| 0 | 0 | 0 | 0.5 | 0 | 0 | 0 | 0 | 0 | 0 | 0 | 0 | 0 | 0 | 0 |
| 1 | 0.85 | 0.85 | 0.925 | 0.85 | 0.85 | 0.15 | 0.85 | 0.57 | 0.57 | 0.43 | 0.57 | 0 | 0.28 |
| 2 | 1.71 | 1.71 | 1.355 | 1.355 | 0.355 | 0.645 | 1.71 | 1.14 | 0.14 | 0.86 | 1.28 | 0 | 0.43 |
| 3 | 2.57 | 2.57 | 1.785 | 1.785 | 0.785 | 0.215 | 2.57 | 1.71 | 0.71 | 0.29 | 2.42 | 0 | 0.15 |
| 4 | 3.43 | 2.43 | 2.715 | 2.43 | 0.43 | 0.57 | 3.43 | 2.29 | 0.29 | 0.71 | 3.29 | 0 | 0.14 |
| 5 | 4.29 | 3.29 | 3.145 | 3.145 | 0.145 | 0.855 | 4.29 | 2.86 | 0.86 | 0.14 | 3.86 | 0 | 0.43 |
| 6 | 5.15 | 4.15 | 3.575 | 3.575 | 0.575 | 0.425 | 5.15 | 3.43 | 0.43 | 0.57 | 4.86 | 0 | 0.29 |
| 7 | 6.01 | 4.01 | 4.505 | 4.01 | 0.01 | 0.99 | 6.01 | 4 | 0 | 0 | 0 | 0 | 6.01 |
| 8 | 6.87 | 4.87 | 4.935 | 4.87 | 0.87 | 0.13 | 6.87 | 4.58 | 0.58 | 0.42 | 6.58 | 0 | 0.29 |
| 9 | 7.72 | 5.72 | 5.36 | 5.36 | 0.36 | 0.64 | 7.72 | 5.15 | 0.15 | 0.85 | 7.3 | 0 | 0.42 |
| 10 | 8.58 | 6.58 | 5.79 | 5.79 | 0.79 | 0.21 | 8.58 | 5.72 | 0.72 | 0.28 | 8.44 | 0 | 0.14 |
| 11 | 9.44 | 6.44 | 6.72 | 6.44 | 0.44 | 0.56 | 9.44 | 6.29 | 0.29 | 0.71 | 9.29 | 0 | 0.15 |
| 12 | 10.3 | 7.3 | 7.15 | 7.15 | 0.15 | 0.85 | 10.3 | 6.87 | 0.87 | 0.13 | 9.87 | 0 | 0.43 |
| 13 | 11.16 | 8.16 | 7.58 | 7.58 | 0.58 | 0.42 | 11.16 | 7.44 | 0.44 | 0.56 | 10.88 | 0 | 0.28 |
| 14 | 12.02 | 8.02 | 8.51 | 8.02 | 0.02 | 0.98 | 12.02 | 8.01 | 0.01 | 0.99 | 12.01 | 0 | 0.01 |
| 15 | 12.88 | 8.88 | 8.94 | 8.88 | 0.88 | 0.12 | 12.88 | 8.58 | 0.58 | 0.42 | 12.58 | 0 | 0.3 |
| 16 | 13.74 | 9.74 | 9.37 | 9.37 | 0.37 | 0.63 | 13.74 | 9.16 | 0.16 | 0.84 | 13.32 | 0 | 0.42 |
| 17 | 14.6 | 10.6 | 9.8 | 9.8 | 0.8 | 0.2 | 14.6 | 9.73 | 0.73 | 0.27 | 14.46 | 0 | 0.14 |
| 18 | 15.45 | 10.45 | 10.725 | 10.45 | 0.45 | 0.55 | 15.45 | 10.3 | 0.3 | 0.7 | 15.3 | 0 | 0.15 |
| 19 | 16.31 | 11.31 | 11.155 | 11.155 | 0.155 | 0.845 | 16.31 | 10.87 | 0.87 | 0.13 | 15.87 | 0 | 0.44 |
| 20 | 17.17 | 12.17 | 11.585 | 11.585 | 0.585 | 0.415 | 17.17 | 11.45 | 0.45 | 0.55 | 16.9 | 0 | 0.27 |
| 21 | 18.03 | 12.03 | 12.515 | 12.03 | 0.03 | 0.97 | 18.03 | 12.02 | 0.02 | 0.98 | 18.02 | 0 | 0.01 |
| 22 | 18.89 | 12.89 | 12.945 | 12.89 | 0.89 | 0.11 | 18.89 | 12.59 | 0.59 | 0.41 | 18.59 | 0 | 0.3 |
| 23 | 19.75 | 13.75 | 13.375 | 13.375 | 0.375 | 0.625 | 19.75 | 13.16 | 0.16 | 0.84 | 19.32 | 0 | 0.43 |
| 24 | 20.61 | 14.61 | 13.805 | 13.805 | 0.805 | 0.195 | 20.61 | 13.74 | 0.74 | 0.26 | 20.48 | 0 | 0.13 |
| 25 | 21.47 | 14.47 | 14.735 | 14.47 | 0.47 | 0.53 | 21.47 | 14.31 | 0.31 | 0.69 | 21.31 | 0 | 0.16 |
| 26 | 22.32 | 15.32 | 15.16 | 15.16 | 0.16 | 0.84 | 22.32 | 14.88 | 0.88 | 0.12 | 21.88 | 0 | 0.44 |
| 27 | 23.18 | 16.18 | 15.59 | 15.59 | 0.59 | 0.41 | 23.18 | 15.45 | 0.45 | 0.55 | 22.9 | 0 | 0.28 |

Fig.52

| INPUT SIGNAL 256 GRAY SCALES | WITH SUB GAIN CONTROL CIRCUIT SIGNAL A1 220 GRAY SCALES | COMPUTATION (1) | COMPUTATION (2) | 148 GRAY SCALES SIGNAL B1 | FRACTIONAL PART | | FRACTIONAL PART' SIGNAL C1 220 GRAY SCALES | WITHOUT SUB GAIN CONTROL CIRCUIT 147 GRAY SCALES SIGNAL A2 | FRACTIONAL PART | | FRACTIONAL PART 220 GRAY SCALES SIGNAL C2 | ERROR OF OUTPUT SIGNAL ACCURACY | |
|---|---|---|---|---|---|---|---|---|---|---|---|---|---|
| | | | | | | | | | | | | DISPLAY 1 | DISPLAY 2 |
| | | | | | $\alpha$ | $1-\alpha$ | | | $\beta$ | $1-\beta$ | | A1−C1 | A1−C2 |
| 28 | 24.04 | 16.04 | 16.52 | 16.04 | 0.04 | 0.96 | 24.04 | 16.03 | 0.03 | 0.97 | 24.03 | 0 | 0.01 |
| 29 | 24.9 | 16.9 | 16.95 | 16.9 | 0.9 | 0.1 | 24.9 | 16.6 | 0.6 | 0.4 | 24.6 | 0 | 0.3 |
| 30 | 25.76 | 17.76 | 17.38 | 17.38 | 0.38 | 0.62 | 25.76 | 17.17 | 0.17 | 0.83 | 25.34 | 0 | 0.42 |
| 31 | 26.62 | 18.62 | 17.81 | 17.81 | 0.81 | 0.19 | 26.62 | 17.74 | 0.74 | 0.26 | 26.48 | 0 | 0.14 |
| 32 | 27.48 | 18.48 | 18.74 | 18.48 | 0.48 | 0.52 | 27.48 | 18.32 | 0.32 | 0.68 | 27.32 | 0 | 0.16 |
| 33 | 28.34 | 19.34 | 19.17 | 19.17 | 0.17 | 0.83 | 28.34 | 18.89 | 0.89 | 0.11 | 27.89 | 0 | 0.45 |
| 34 | 29.2 | 20.2 | 19.6 | 19.6 | 0.6 | 0.4 | 29.2 | 19.46 | 0.46 | 0.54 | 28.92 | 0 | 0.28 |
| 35 | 30.05 | 20.05 | 20.525 | 20.05 | 0.05 | 0.95 | 30.05 | 20.03 | 0.03 | 0.97 | 30.03 | 0 | 0.02 |
| 36 | 30.91 | 20.91 | 20.955 | 20.91 | 0.91 | 0.09 | 30.91 | 20.61 | 0.61 | 0.39 | 30.61 | 0 | 0.3 |
| 37 | 31.77 | 21.77 | 21.385 | 21.385 | 0.385 | 0.615 | 31.77 | 21.18 | 0.18 | 0.82 | 31.36 | 0 | 0.41 |
| 38 | 32.63 | 22.63 | 21.815 | 21.815 | 0.815 | 0.185 | 32.63 | 21.75 | 0.75 | 0.25 | 32.5 | 0 | 0.13 |
| 39 | 33.49 | 22.49 | 22.745 | 22.49 | 0.49 | 0.51 | 33.49 | 22.32 | 0.32 | 0.68 | 33.32 | 0 | 0.17 |
| 40 | 34.35 | 23.35 | 23.175 | 23.175 | 0.175 | 0.825 | 34.35 | 22.9 | 0.9 | 0.1 | 33.9 | 0 | 0.45 |
| 41 | 35.21 | 24.21 | 23.605 | 23.605 | 0.605 | 0.395 | 35.21 | 23.47 | 0.47 | 0.53 | 34.94 | 0 | 0.27 |
| 42 | 36.07 | 24.07 | 24.535 | 24.07 | 0.07 | 0.93 | 36.07 | 24.04 | 0.04 | 0.96 | 36.04 | 0 | 0.03 |
| 43 | 36.92 | 24.92 | 24.96 | 24.92 | 0.92 | 0.08 | 36.92 | 24.61 | 0.61 | 0.39 | 36.61 | 0 | 0.31 |
| 44 | 37.78 | 25.78 | 25.39 | 25.39 | 0.39 | 0.61 | 37.78 | 25.19 | 0.19 | 0.81 | 37.38 | 0 | 0.4 |
| 45 | 38.64 | 26.64 | 25.82 | 25.82 | 0.82 | 0.18 | 38.64 | 25.76 | 0.76 | 0.24 | 38.52 | 0 | 0.12 |
| 46 | 39.5 | 26.5 | 26.75 | 26.5 | 0.5 | 0.5 | 39.5 | 26.33 | 0.33 | 0.67 | 39.33 | 0 | 0.17 |
| 47 | 40.36 | 27.36 | 27.18 | 27.18 | 0.18 | 0.82 | 40.36 | 26.9 | 0.9 | 0.1 | 39.9 | 0 | 0.46 |
| 48 | 41.22 | 28.22 | 27.61 | 27.61 | 0.61 | 0.39 | 41.22 | 27.48 | 0.48 | 0.52 | 40.96 | 0 | 0.26 |
| 49 | 42.08 | 28.08 | 28.54 | 28.08 | 0.08 | 0.92 | 42.08 | 28.05 | 0.05 | 0.95 | 42.05 | 0 | 0.03 |
| 50 | 42.94 | 28.94 | 28.97 | 28.94 | 0.94 | 0.06 | 42.94 | 28.62 | 0.62 | 0.38 | 42.62 | 0 | 0.32 |
| 51 | 43.8 | 29.8 | 29.4 | 29.4 | 0.4 | 0.6 | 43.8 | 29.2 | 0.2 | 0.8 | 43.4 | 0 | 0.4 |
| 52 | 44.65 | 30.65 | 29.825 | 29.825 | 0.825 | 0.175 | 44.65 | 29.77 | 0.77 | 0.23 | 44.54 | 0 | 0.11 |
| 53 | 45.51 | 30.51 | 30.755 | 30.51 | 0.51 | 0.49 | 45.51 | 30.34 | 0.34 | 0.66 | 45.34 | 0 | 0.17 |
| 54 | 46.37 | 31.37 | 31.185 | 31.185 | 0.185 | 0.815 | 46.37 | 30.91 | 0.91 | 0.09 | 45.91 | 0 | 0.46 |
| 55 | 47.23 | 32.23 | 31.615 | 31.615 | 0.615 | 0.385 | 47.23 | 31.49 | 0.49 | 0.51 | 46.98 | 0 | 0.25 |

Fig.53

| INPUT SIGNAL 256 GRAY SCALES | WITH SUB GAIN CONTROL CIRCUIT SIGNAL A1 220 GRAY SCALES | COMPUTATION (1) | COMPUTATION (2) | SIGNAL B1 148 GRAY SCALES | FRACTIONAL PART α | FRACTIONAL PART' 1−α | SIGNAL C1 220 GRAY SCALES | WITHOUT SUB GAIN CONTROL CIRCUIT SIGNAL A2 147 GRAY SCALES | FRACTIONAL PART β | FRACTIONAL PART 1−β | SIGNAL C2 220 GRAY SCALES | ERROR OF OUTPUT SIGNAL ACCURACY DISPLAY 1 A1−C1 | DISPLAY 2 A1−C2 |
|---|---|---|---|---|---|---|---|---|---|---|---|---|---|
| 56 | 48.09 | 32.09 | 32.545 | 32.09 | 0.09 | 0.91 | 48.09 | 32.06 | 0.06 | 0.94 | 48.06 | 0 | 0.03 |
| 57 | 48.95 | 32.95 | 32.975 | 32.95 | 0.95 | 0.05 | 48.95 | 32.63 | 0.63 | 0.37 | 48.63 | 0 | 0.32 |
| 58 | 49.81 | 33.81 | 33.405 | 33.405 | 0.405 | 0.595 | 49.81 | 33.2 | 0.2 | 0.8 | 49.4 | 0 | 0.41 |
| 59 | 50.67 | 34.67 | 33.835 | 33.835 | 0.835 | 0.165 | 50.67 | 33.78 | 0.78 | 0.22 | 50.56 | 0 | 0.11 |
| 60 | 51.52 | 34.52 | 34.76 | 34.52 | 0.52 | 0.48 | 51.52 | 34.35 | 0.35 | 0.65 | 51.35 | 0 | 0.17 |
| 61 | 52.38 | 35.38 | 35.19 | 35.19 | 0.19 | 0.81 | 52.38 | 34.92 | 0.92 | 0.08 | 51.92 | 0 | 0.46 |
| 62 | 53.24 | 36.24 | 35.62 | 35.62 | 0.62 | 0.38 | 53.24 | 35.49 | 0.49 | 0.51 | 52.98 | 0 | 0.26 |
| 63 | 54.1 | 36.1 | 36.55 | 36.1 | 0.1 | 0.9 | 54.1 | 36.07 | 0.07 | 0.93 | 54.07 | 0 | 0.03 |
| 64 | 54.96 | 36.96 | 36.98 | 36.96 | 0.96 | 0.04 | 54.96 | 36.64 | 0.64 | 0.36 | 54.64 | 0 | 0.32 |
| 65 | 55.82 | 37.82 | 37.41 | 37.41 | 0.41 | 0.59 | 55.82 | 37.21 | 0.21 | 0.79 | 55.42 | 0 | 0.4 |
| 66 | 56.68 | 38.68 | 37.84 | 37.84 | 0.84 | 0.16 | 56.68 | 37.78 | 0.78 | 0.22 | 56.56 | 0 | 0.12 |
| 67 | 57.54 | 38.54 | 38.77 | 38.54 | 0.54 | 0.46 | 57.54 | 38.36 | 0.36 | 0.64 | 57.36 | 0 | 0.18 |
| 68 | 58.4 | 39.4 | 39.2 | 39.2 | 0.2 | 0.8 | 58.4 | 38.93 | 0.93 | 0.07 | 57.93 | 0 | 0.47 |
| 69 | 59.25 | 40.25 | 39.625 | 39.625 | 0.625 | 0.375 | 59.25 | 39.5 | 0.5 | 0.5 | 59 | 0 | 0.25 |
| 70 | 60.11 | 40.11 | 40.555 | 40.11 | 0.11 | 0.89 | 60.11 | 40.07 | 0.07 | 0.93 | 60.07 | 0 | 0.04 |
| 71 | 60.97 | 40.97 | 40.985 | 40.97 | 0.97 | 0.03 | 60.97 | 40.65 | 0.65 | 0.35 | 60.65 | 0 | 0.32 |
| 72 | 61.83 | 41.83 | 41.415 | 41.415 | 0.415 | 0.585 | 61.83 | 41.22 | 0.22 | 0.78 | 61.44 | 0 | 0.39 |
| 73 | 62.69 | 42.69 | 41.845 | 41.845 | 0.845 | 0.155 | 62.69 | 41.79 | 0.79 | 0.21 | 62.58 | 0 | 0.11 |
| 74 | 63.55 | 42.55 | 42.775 | 42.55 | 0.55 | 0.45 | 63.55 | 42.36 | 0.36 | 0.64 | 63.36 | 0 | 0.19 |
| 75 | 64.41 | 43.41 | 43.205 | 43.205 | 0.205 | 0.795 | 64.41 | 42.94 | 0.94 | 0.06 | 63.94 | 0 | 0.47 |
| 76 | 65.27 | 44.27 | 43.635 | 43.635 | 0.635 | 0.365 | 65.27 | 43.51 | 0.51 | 0.49 | 65.02 | 0 | 0.25 |
| 77 | 66.12 | 44.12 | 44.56 | 44.12 | 0.12 | 0.88 | 66.12 | 44.08 | 0.08 | 0.92 | 66.08 | 0 | 0.04 |
| 78 | 66.98 | 44.98 | 44.99 | 44.98 | 0.98 | 0.02 | 66.98 | 44.65 | 0.65 | 0.35 | 66.65 | 0 | 0.33 |
| 79 | 67.84 | 45.84 | 45.42 | 45.42 | 0.42 | 0.58 | 67.84 | 45.23 | 0.23 | 0.77 | 67.46 | 0 | 0.38 |
| 80 | 68.7 | 46.7 | 45.85 | 45.85 | 0.85 | 0.15 | 68.7 | 45.8 | 0.8 | 0.2 | 68.6 | 0 | 0.1 |
| 81 | 69.56 | 46.56 | 46.78 | 46.56 | 0.56 | 0.44 | 69.56 | 46.37 | 0.37 | 0.63 | 69.37 | 0 | 0.19 |
| 82 | 70.42 | 47.42 | 47.21 | 47.21 | 0.21 | 0.79 | 70.42 | 46.94 | 0.94 | 0.06 | 69.94 | 0 | 0.48 |
| 83 | 71.28 | 48.28 | 47.64 | 47.64 | 0.64 | 0.36 | 71.28 | 47.52 | 0.52 | 0.48 | 71.04 | 0 | 0.24 |

Fig.54

| INPUT SIGNAL (256 GRAY SCALES) | WITH SUB GAIN CONTROL CIRCUIT: SIGNAL A1 (220 GRAY SCALES) | COMPUTATION (1) | COMPUTATION (2) | SIGNAL B1 (148 GRAY SCALES) | FRACTIONAL PART α | FRACTIONAL PART 1−α | SIGNAL C1 (220 GRAY SCALES) | WITHOUT SUB GAIN CONTROL CIRCUIT: SIGNAL A2 (147 GRAY SCALES) | FRACTIONAL PART β | FRACTIONAL PART 1−β | SIGNAL C2 (220 GRAY SCALES) | ERROR OF OUTPUT SIGNAL ACCURACY: DISPLAY 1 A1−C1 | DISPLAY 2 A1−C2 |
|---|---|---|---|---|---|---|---|---|---|---|---|---|---|
| 84 | 72.14 | 48.14 | 48.57 | 48.14 | 0.14 | 0.86 | 72.14 | 48.09 | 0.09 | 0.91 | 72.09 | 0 | 0.05 |
| 85 | 73 | 49 | 49 | 49 | 0 | 1 | 73 | 48.66 | 0.66 | 0.34 | 72.66 | 0 | 0.34 |
| 86 | 73.85 | 49.85 | 49.425 | 49.425 | 0.425 | 0.575 | 73.85 | 49.23 | 0.23 | 0.77 | 73.46 | 0 | 0.39 |
| 87 | 74.71 | 50.71 | 49.855 | 49.855 | 0.855 | 0.145 | 74.71 | 49.81 | 0.81 | 0.19 | 74.62 | 0 | 0.09 |
| 88 | 75.57 | 50.57 | 50.785 | 50.57 | 0.57 | 0.43 | 75.57 | 50.38 | 0.38 | 0.62 | 75.38 | 0 | 0.19 |
| 89 | 76.43 | 51.43 | 51.215 | 51.215 | 0.215 | 0.785 | 76.43 | 50.95 | 0.95 | 0.05 | 75.95 | 0 | 0.48 |
| 90 | 77.29 | 52.29 | 51.645 | 51.645 | 0.645 | 0.355 | 77.29 | 51.52 | 0.52 | 0.48 | 77.04 | 0 | 0.25 |
| 91 | 78.15 | 52.15 | 52.575 | 52.15 | 0.15 | 0.85 | 78.15 | 52.1 | 0.1 | 0.9 | 78.1 | 0 | 0.05 |
| 92 | 79.01 | 53.01 | 53.005 | 53.005 | 0.005 | 0.995 | 79.01 | 52.67 | 0.67 | 0.33 | 78.67 | 0 | 0.34 |
| 93 | 79.87 | 53.87 | 53.435 | 53.435 | 0.435 | 0.565 | 79.87 | 53.24 | 0.24 | 0.76 | 79.48 | 0 | 0.39 |
| 94 | 80.72 | 54.72 | 53.86 | 53.86 | 0.86 | 0.14 | 80.72 | 53.81 | 0.81 | 0.19 | 80.62 | 0 | 0.1 |
| 95 | 81.58 | 54.58 | 54.79 | 54.58 | 0.58 | 0.42 | 81.58 | 54.39 | 0.39 | 0.61 | 81.39 | 0 | 0.19 |
| 96 | 82.44 | 55.44 | 55.22 | 55.22 | 0.22 | 0.78 | 82.44 | 54.96 | 0.96 | 0.04 | 81.96 | 0 | 0.48 |
| 97 | 83.3 | 56.3 | 55.65 | 55.65 | 0.65 | 0.35 | 83.3 | 55.53 | 0.53 | 0.47 | 83.06 | 0 | 0.24 |
| 98 | 84.16 | 56.16 | 56.58 | 56.16 | 0.16 | 0.84 | 84.16 | 56.1 | 0.1 | 0.9 | 84.1 | 0 | 0.06 |
| 99 | 85.02 | 57.02 | 57.01 | 57.01 | 0.01 | 0.99 | 85.02 | 56.68 | 0.68 | 0.32 | 84.68 | 0 | 0.34 |
| 100 | 85.88 | 57.88 | 57.44 | 57.44 | 0.44 | 0.56 | 85.88 | 57.25 | 0.25 | 0.75 | 85.5 | 0 | 0.38 |
| 101 | 86.74 | 58.74 | 57.87 | 57.87 | 0.87 | 0.13 | 86.74 | 57.82 | 0.82 | 0.18 | 86.64 | 0 | 0.1 |
| 102 | 87.6 | 58.6 | 58.8 | 58.6 | 0.6 | 0.4 | 87.6 | 58.4 | 0.4 | 0.6 | 87.4 | 0 | 0.2 |
| 103 | 88.45 | 59.45 | 59.225 | 59.225 | 0.225 | 0.775 | 88.45 | 58.97 | 0.97 | 0.03 | 87.97 | 0 | 0.48 |
| 104 | 89.31 | 60.31 | 59.655 | 59.655 | 0.655 | 0.345 | 89.31 | 59.54 | 0.54 | 0.46 | 89.08 | 0 | 0.23 |
| 105 | 90.17 | 60.17 | 60.585 | 60.17 | 0.17 | 0.83 | 90.17 | 60.11 | 0.11 | 0.89 | 90.11 | 0 | 0.06 |
| 106 | 91.03 | 61.03 | 61.015 | 61.015 | 0.015 | 0.985 | 91.03 | 60.69 | 0.69 | 0.31 | 90.69 | 0 | 0.34 |
| 107 | 91.89 | 61.89 | 61.445 | 61.445 | 0.445 | 0.555 | 91.89 | 61.26 | 0.26 | 0.74 | 91.52 | 0 | 0.37 |
| 108 | 92.75 | 62.75 | 61.875 | 61.875 | 0.875 | 0.125 | 92.75 | 61.83 | 0.83 | 0.17 | 92.66 | 0 | 0.09 |
| 109 | 93.61 | 62.61 | 62.805 | 62.61 | 0.61 | 0.39 | 93.61 | 62.4 | 0.4 | 0.6 | 93.4 | 0 | 0.21 |
| 110 | 94.47 | 63.47 | 63.235 | 63.235 | 0.235 | 0.765 | 94.47 | 62.98 | 0.98 | 0.02 | 93.98 | 0 | 0.49 |
| 111 | 95.32 | 64.32 | 63.66 | 63.66 | 0.66 | 0.34 | 95.32 | 63.55 | 0.55 | 0.45 | 95.1 | 0 | 0.22 |

Fig.55

| INPUT SIGNAL (256 GRAY SCALES) | SIGNAL A1 (WITH SUB GAIN CONTROL CIRCUIT, 220 GRAY SCALES) | COMPUTATION (1) | COMPUTATION (2) | SIGNAL B1 (148 GRAY SCALES) | FRACTIONAL PART α | FRACTIONAL PART 1−α | SIGNAL C1 (220 GRAY SCALES) | SIGNAL A2 (WITHOUT SUB GAIN CONTROL CIRCUIT, 147 GRAY SCALES) | FRACTIONAL PART β | FRACTIONAL PART 1−β | SIGNAL C2 (220 GRAY SCALES) | DISPLAY 1 (ERROR OF OUTPUT SIGNAL ACCURACY) A1−C1 | DISPLAY 2 A1−C2 |
|---|---|---|---|---|---|---|---|---|---|---|---|---|---|
| 112 | 96.18 | 64.18 | 64.59 | 64.18 | 0.18 | 0.82 | 96.18 | 64.12 | 0.12 | 0.88 | 96.12 | 0 | 0.06 |
| 113 | 97.04 | 65.04 | 65.02 | 65.02 | 0.02 | 0.98 | 97.04 | 64.69 | 0.69 | 0.31 | 96.69 | 0 | 0.35 |
| 114 | 97.9 | 65.9 | 65.45 | 65.45 | 0.45 | 0.55 | 97.9 | 65.27 | 0.27 | 0.73 | 97.54 | 0 | 0.36 |
| 115 | 98.76 | 66.76 | 65.88 | 65.88 | 0.88 | 0.12 | 98.76 | 65.84 | 0.84 | 0.16 | 98.68 | 0 | 0.08 |
| 116 | 99.62 | 66.62 | 66.81 | 66.62 | 0.62 | 0.38 | 99.62 | 66.41 | 0.41 | 0.59 | 99.41 | 0 | 0.21 |
| 117 | 100.48 | 67.48 | 67.24 | 67.24 | 0.24 | 0.76 | 100.48 | 66.98 | 0.98 | 0.02 | 99.98 | 0 | 0.5 |
| 118 | 101.34 | 68.34 | 67.67 | 67.67 | 0.67 | 0.33 | 101.34 | 67.56 | 0.56 | 0.44 | 101.12 | 0 | 0.22 |
| 119 | 102.2 | 68.2 | 68.6 | 68.2 | 0.2 | 0.8 | 102.2 | 68.13 | 0.13 | 0.87 | 102.13 | 0 | 0.07 |
| 120 | 103.05 | 69.05 | 69.025 | 69.025 | 0.025 | 0.975 | 103.05 | 68.7 | 0.7 | 0.3 | 102.7 | 0 | 0.35 |
| 121 | 103.91 | 69.91 | 69.455 | 69.455 | 0.455 | 0.545 | 103.91 | 69.27 | 0.27 | 0.73 | 103.54 | 0 | 0.37 |
| 122 | 104.77 | 70.77 | 69.885 | 69.885 | 0.885 | 0.115 | 104.77 | 69.85 | 0.85 | 0.15 | 104.7 | 0 | 0.07 |
| 123 | 105.63 | 70.63 | 70.815 | 70.63 | 0.63 | 0.37 | 105.63 | 70.42 | 0.42 | 0.58 | 105.42 | 0 | 0.21 |
| 124 | 106.49 | 71.49 | 71.245 | 71.245 | 0.245 | 0.755 | 106.49 | 70.99 | 0.99 | 0.01 | 105.99 | 0 | 0.5 |
| 125 | 107.35 | 72.35 | 71.675 | 71.675 | 0.675 | 0.325 | 107.35 | 71.56 | 0.56 | 0.44 | 107.12 | 0 | 0.23 |
| 126 | 108.21 | 72.21 | 72.605 | 72.21 | 0.21 | 0.79 | 108.21 | 72.14 | 0.14 | 0.86 | 108.14 | 0 | 0.07 |
| 127 | 109.07 | 73.07 | 73.035 | 73.035 | 0.035 | 0.965 | 109.07 | 72.71 | 0.71 | 0.29 | 108.71 | 0 | 0.36 |
| 128 | 109.92 | 73.92 | 73.46 | 73.46 | 0.46 | 0.54 | 109.92 | 73.28 | 0.28 | 0.72 | 109.56 | 0 | 0.36 |
| 129 | 110.78 | 74.78 | 73.89 | 73.89 | 0.89 | 0.11 | 110.78 | 73.85 | 0.85 | 0.15 | 110.7 | 0 | 0.08 |
| 130 | 111.64 | 74.64 | 74.82 | 74.64 | 0.64 | 0.36 | 111.64 | 74.43 | 0.43 | 0.57 | 111.43 | 0 | 0.21 |
| 131 | 112.5 | 75.5 | 75.25 | 75.25 | 0.25 | 0.75 | 112.5 | 75 | 0 | 1 | 112 | 0 | 0.5 |
| 132 | 113.36 | 76.36 | 75.68 | 75.68 | 0.68 | 0.32 | 113.36 | 75.57 | 0.57 | 0.43 | 113.14 | 0 | 0.22 |
| 133 | 114.22 | 76.22 | 76.61 | 76.22 | 0.22 | 0.78 | 114.22 | 76.14 | 0.14 | 0.86 | 114.14 | 0 | 0.08 |
| 134 | 115.08 | 77.08 | 77.04 | 77.04 | 0.04 | 0.96 | 115.08 | 76.72 | 0.72 | 0.28 | 114.72 | 0 | 0.36 |
| 135 | 115.94 | 77.94 | 77.47 | 77.47 | 0.47 | 0.53 | 115.94 | 77.29 | 0.29 | 0.71 | 115.58 | 0 | 0.36 |
| 136 | 116.8 | 78.8 | 77.9 | 77.9 | 0.9 | 0.1 | 116.8 | 77.86 | 0.86 | 0.14 | 116.72 | 0 | 0.08 |
| 137 | 117.65 | 78.65 | 78.825 | 78.65 | 0.65 | 0.35 | 117.65 | 78.43 | 0.43 | 0.57 | 117.43 | 0 | 0.22 |
| 138 | 118.51 | 79.51 | 79.255 | 79.255 | 0.255 | 0.745 | 118.51 | 79.01 | 0.01 | 0.99 | 118.02 | 0 | 0.49 |
| 139 | 119.37 | 80.37 | 79.685 | 79.685 | 0.685 | 0.315 | 119.37 | 79.58 | 0.58 | 0.42 | 119.16 | 0 | 0.21 |

Fig.56

| INPUT SIGNAL 256 GRAY SCALES | SIGNAL A1 (WITH SUB GAIN CONTROL CIRCUIT) 220 GRAY SCALES | COMPUTATION (1) | COMPUTATION (2) | SIGNAL B1 148 GRAY SCALES | FRACTIONAL PART α | FRACTIONAL PART 1−α | SIGNAL C1 220 GRAY SCALES | SIGNAL A2 (WITHOUT SUB GAIN CONTROL CIRCUIT) 147 GRAY SCALES | FRACTIONAL PART β | FRACTIONAL PART 1−β | SIGNAL C2 220 GRAY SCALES | ERROR OF OUTPUT SIGNAL ACCURACY DISPLAY 1 A1−C1 | ERROR OF OUTPUT SIGNAL ACCURACY DISPLAY 2 A1−C2 |
|---|---|---|---|---|---|---|---|---|---|---|---|---|---|
| 140 | 120.23 | 80.23 | 80.615 | 80.23 | 0.23 | 0.77 | 120.23 | 80.15 | 0.15 | 0.85 | 120.15 | 0 | 0.08 |
| 141 | 121.09 | 81.09 | 81.045 | 81.045 | 0.045 | 0.955 | 121.09 | 80.72 | 0.72 | 0.28 | 120.72 | 0 | 0.37 |
| 142 | 121.95 | 81.95 | 81.475 | 81.475 | 0.475 | 0.525 | 121.95 | 81.3 | 0.3 | 0.7 | 121.6 | 0 | 0.35 |
| 143 | 122.81 | 82.81 | 81.905 | 81.905 | 0.905 | 0.095 | 122.81 | 81.87 | 0.87 | 0.13 | 122.74 | 0 | 0.07 |
| 144 | 123.67 | 82.67 | 82.835 | 82.67 | 0.67 | 0.33 | 123.67 | 82.44 | 0.44 | 0.56 | 123.44 | 0 | 0.23 |
| 145 | 124.52 | 83.52 | 83.26 | 83.26 | 0.26 | 0.74 | 124.52 | 83.01 | 0.01 | 0.99 | 124.02 | 0 | 0.5 |
| 146 | 125.38 | 84.38 | 83.69 | 83.69 | 0.69 | 0.31 | 125.38 | 83.59 | 0.59 | 0.41 | 125.18 | 0 | 0.2 |
| 147 | 126.24 | 84.24 | 84.62 | 84.24 | 0.24 | 0.76 | 126.24 | 84.16 | 0.16 | 0.84 | 126.16 | 0 | 0.08 |
| 148 | 127.1 | 85.1 | 85.05 | 85.05 | 0.05 | 0.95 | 127.1 | 84.73 | 0.73 | 0.27 | 126.73 | 0 | 0.37 |
| 149 | 127.96 | 85.96 | 85.48 | 85.48 | 0.48 | 0.52 | 127.96 | 85.3 | 0.3 | 0.7 | 127.6 | 0 | 0.36 |
| 150 | 128.82 | 86.82 | 85.91 | 85.91 | 0.91 | 0.09 | 128.82 | 85.88 | 0.88 | 0.12 | 128.76 | 0 | 0.06 |
| 151 | 129.68 | 86.68 | 86.84 | 86.68 | 0.68 | 0.32 | 129.68 | 86.45 | 0.45 | 0.55 | 129.45 | 0 | 0.23 |
| 152 | 130.54 | 87.54 | 87.27 | 87.27 | 0.27 | 0.73 | 130.54 | 87.02 | 0.02 | 0.98 | 130.04 | 0 | 0.5 |
| 153 | 131.4 | 88.4 | 87.7 | 87.7 | 0.7 | 0.3 | 131.4 | 87.6 | 0.6 | 0.4 | 131.2 | 0 | 0.2 |
| 154 | 132.25 | 88.25 | 88.625 | 88.25 | 0.25 | 0.75 | 132.25 | 88.17 | 0.17 | 0.83 | 132.17 | 0 | 0.08 |
| 155 | 133.11 | 89.11 | 89.055 | 89.055 | 0.055 | 0.945 | 133.11 | 88.74 | 0.74 | 0.26 | 132.74 | 0 | 0.37 |
| 156 | 133.97 | 89.97 | 89.485 | 89.485 | 0.485 | 0.515 | 133.97 | 89.31 | 0.31 | 0.69 | 133.62 | 0 | 0.35 |
| 157 | 134.83 | 90.83 | 89.915 | 89.915 | 0.915 | 0.085 | 134.83 | 89.89 | 0.89 | 0.11 | 134.78 | 0 | 0.05 |
| 158 | 135.69 | 90.69 | 90.845 | 90.69 | 0.69 | 0.31 | 135.69 | 90.46 | 0.46 | 0.54 | 135.46 | 0 | 0.23 |
| 159 | 136.55 | 91.55 | 91.275 | 91.275 | 0.275 | 0.725 | 136.55 | 91.03 | 0.03 | 0.97 | 136.06 | 0 | 0.49 |
| 160 | 137.41 | 92.41 | 91.705 | 91.705 | 0.705 | 0.295 | 137.41 | 91.6 | 0.6 | 0.4 | 137.2 | 0 | 0.21 |
| 161 | 138.27 | 92.27 | 92.635 | 92.27 | 0.27 | 0.73 | 138.27 | 92.18 | 0.18 | 0.82 | 138.18 | 0 | 0.09 |
| 162 | 139.12 | 93.12 | 93.06 | 93.06 | 0.06 | 0.94 | 139.12 | 92.75 | 0.75 | 0.25 | 138.75 | 0 | 0.37 |
| 163 | 139.98 | 93.98 | 93.49 | 93.49 | 0.49 | 0.51 | 139.98 | 93.32 | 0.32 | 0.68 | 139.64 | 0 | 0.34 |
| 164 | 140.84 | 94.84 | 93.92 | 93.92 | 0.92 | 0.08 | 140.84 | 93.89 | 0.89 | 0.11 | 140.78 | 0 | 0.06 |
| 165 | 141.7 | 94.7 | 94.85 | 94.7 | 0.7 | 0.3 | 141.7 | 94.47 | 0.47 | 0.53 | 141.47 | 0 | 0.23 |
| 166 | 142.56 | 95.56 | 95.28 | 95.28 | 0.28 | 0.72 | 142.56 | 95.04 | 0.04 | 0.96 | 142.08 | 0 | 0.48 |
| 167 | 143.42 | 96.42 | 95.71 | 95.71 | 0.71 | 0.29 | 143.42 | 95.61 | 0.61 | 0.39 | 143.22 | 0 | 0.2 |

Fig.57

| INPUT SIGNAL | 256 GRAY SCALES SIGNAL A1 | WITH SUB GAIN CONTROL CIRCUIT 220 GRAY SCALES COMPUTATION (1) | COMPUTATION (2) | 148 GRAY SCALES SIGNAL B1 | FRACTIONAL PART α | 220 GRAY SCALES FRACTIONAL PART' 1−α | SIGNAL C1 | WITHOUT SUB GAIN CONTROL CIRCUIT 147 GRAY SCALES SIGNAL A2 | FRACTIONAL PART β | FRACTIONAL PART 1−β | 220 GRAY SCALES SIGNAL C2 | ERROR OF OUTPUT SIGNAL ACCURACY DISPLAY 1 A1−C1 | DISPLAY 2 A1−C2 |
|---|---|---|---|---|---|---|---|---|---|---|---|---|---|
| 168 | 144.28 | 96.28 | 96.64 | 96.28 | 0.28 | 0.72 | 144.28 | 96.18 | 0.18 | 0.82 | 144.18 | 0 | 0.1 |
| 169 | 145.14 | 97.14 | 97.07 | 97.07 | 0.07 | 0.93 | 145.14 | 96.76 | 0.76 | 0.24 | 144.76 | 0 | 0.38 |
| 170 | 146 | 98 | 97.5 | 97.5 | 0.5 | 0.5 | 146 | 97.33 | 0.33 | 0.67 | 145.66 | 0 | 0.34 |
| 171 | 146.85 | 98.85 | 97.925 | 97.925 | 0.925 | 0.075 | 146.85 | 97.9 | 0.9 | 0.1 | 146.8 | 0 | 0.05 |
| 172 | 147.71 | 98.71 | 98.855 | 98.71 | 0.71 | 0.29 | 147.71 | 98.47 | 0.47 | 0.53 | 147.47 | 0 | 0.24 |
| 173 | 148.57 | 99.57 | 99.285 | 99.285 | 0.285 | 0.715 | 148.57 | 99.05 | 0.05 | 0.95 | 148.1 | 0 | 0.47 |
| 174 | 149.43 | 100.43 | 99.715 | 99.715 | 0.715 | 0.285 | 149.43 | 99.62 | 0.62 | 0.38 | 149.24 | 0 | 0.19 |
| 175 | 150.29 | 100.29 | 100.65 | 100.29 | 0.29 | 0.71 | 150.29 | 100.19 | 0.19 | 0.81 | 150.19 | 0 | 0.1 |
| 176 | 151.15 | 101.15 | 101.08 | 101.075 | 0.075 | 0.925 | 151.15 | 100.76 | 0.76 | 0.24 | 150.76 | 0 | 0.39 |
| 177 | 152.01 | 102.01 | 101.51 | 101.505 | 0.505 | 0.495 | 152.01 | 101.34 | 0.34 | 0.66 | 151.68 | 0 | 0.33 |
| 178 | 152.87 | 102.87 | 101.94 | 101.935 | 0.935 | 0.065 | 152.87 | 101.91 | 0.91 | 0.09 | 152.82 | 0 | 0.05 |
| 179 | 153.72 | 102.72 | 102.86 | 102.72 | 0.72 | 0.28 | 153.72 | 102.48 | 0.48 | 0.52 | 153.48 | 0 | 0.24 |
| 180 | 154.58 | 103.58 | 103.29 | 103.29 | 0.29 | 0.71 | 154.58 | 103.05 | 0.05 | 0.95 | 154.1 | 0 | 0.48 |
| 181 | 155.44 | 104.44 | 103.72 | 103.72 | 0.72 | 0.28 | 155.44 | 103.63 | 0.63 | 0.37 | 155.26 | 0 | 0.18 |
| 182 | 156.3 | 104.3 | 104.65 | 104.3 | 0.3 | 0.7 | 156.3 | 104.2 | 0.2 | 0.8 | 156.2 | 0 | 0.1 |
| 183 | 157.16 | 105.16 | 105.08 | 105.08 | 0.08 | 0.92 | 157.16 | 104.77 | 0.77 | 0.23 | 156.77 | 0 | 0.39 |
| 184 | 158.02 | 106.02 | 105.51 | 105.51 | 0.51 | 0.49 | 158.02 | 105.34 | 0.34 | 0.66 | 157.68 | 0 | 0.34 |
| 185 | 158.88 | 106.88 | 105.94 | 105.94 | 0.94 | 0.06 | 158.88 | 105.92 | 0.92 | 0.08 | 158.84 | 0 | 0.04 |
| 186 | 159.74 | 106.74 | 106.87 | 106.74 | 0.74 | 0.26 | 159.74 | 106.49 | 0.49 | 0.51 | 159.49 | 0 | 0.25 |
| 187 | 160.6 | 107.6 | 107.3 | 107.3 | 0.3 | 0.7 | 160.6 | 107.06 | 0.06 | 0.94 | 160.12 | 0 | 0.48 |
| 188 | 161.45 | 108.45 | 107.73 | 107.725 | 0.725 | 0.275 | 161.45 | 107.63 | 0.63 | 0.37 | 161.26 | 0 | 0.19 |
| 189 | 162.31 | 108.31 | 108.66 | 108.31 | 0.31 | 0.69 | 162.31 | 108.21 | 0.21 | 0.79 | 162.21 | 0 | 0.1 |
| 190 | 163.17 | 109.17 | 109.09 | 109.085 | 0.085 | 0.915 | 163.17 | 108.78 | 0.78 | 0.22 | 162.78 | 0 | 0.39 |
| 191 | 164.03 | 110.03 | 109.52 | 109.515 | 0.515 | 0.485 | 164.03 | 109.35 | 0.35 | 0.65 | 163.7 | 0 | 0.33 |
| 192 | 164.89 | 110.89 | 109.95 | 109.945 | 0.945 | 0.055 | 164.89 | 109.92 | 0.92 | 0.08 | 164.84 | 0 | 0.05 |
| 193 | 165.75 | 110.75 | 110.88 | 110.75 | 0.75 | 0.25 | 165.75 | 110.5 | 0.5 | 0.5 | 165.5 | 0 | 0.25 |
| 194 | 166.61 | 111.61 | 111.31 | 111.305 | 0.305 | 0.695 | 166.61 | 111.07 | 0.07 | 0.93 | 166.14 | 0 | 0.47 |
| 195 | 167.47 | 112.47 | 111.74 | 111.735 | 0.735 | 0.265 | 167.47 | 111.64 | 0.64 | 0.36 | 167.28 | 0 | 0.19 |

Fig.58

| INPUT SIGNAL | WITH SUB GAIN CONTROL CIRCUIT 256 GRAY SCALES SIGNAL A1 | 220 GRAY SCALES COMPUTATION (1) | COMPUTATION (2) | 148 GRAY SCALES SIGNAL B1 | FRACTIONAL PART α | 1−α | 220 GRAY SCALES FRACTIONAL PART' SIGNAL C1 | WITHOUT SUB GAIN CONTROL CIRCUIT 147 GRAY SCALES SIGNAL C2 | FRACTIONAL PART β | FRACTIONAL PART 1−β | 220 GRAY SCALES SIGNAL A2 | ERROR OF OUTPUT SIGNAL ACCURACY DISPLAY 1 A1−C1 | DISPLAY 2 A1−C2 |
|---|---|---|---|---|---|---|---|---|---|---|---|---|---|
| 196 | 168.32 | 112.32 | 112.66 | 112.32 | 0.32 | 0.68 | 168.32 | 112.21 | 0.21 | 0.79 | 168.21 | 0 | 0.11 |
| 197 | 169.18 | 113.18 | 113.09 | 113.09 | 0.09 | 0.91 | 169.18 | 112.79 | 0.79 | 0.21 | 168.79 | 0 | 0.39 |
| 198 | 170.04 | 114.04 | 113.52 | 113.52 | 0.52 | 0.48 | 170.04 | 113.36 | 0.36 | 0.64 | 169.72 | 0 | 0.32 |
| 199 | 170.9 | 114.9 | 113.95 | 113.95 | 0.95 | 0.05 | 170.9 | 113.93 | 0.93 | 0.07 | 170.86 | 0 | 0.04 |
| 200 | 171.76 | 114.76 | 114.88 | 114.76 | 0.76 | 0.24 | 171.76 | 114.5 | 0.5 | 0.5 | 171.5 | 0 | 0.26 |
| 201 | 172.62 | 115.62 | 115.31 | 115.31 | 0.31 | 0.69 | 172.62 | 115.08 | 0.08 | 0.92 | 172.16 | 0 | 0.46 |
| 202 | 173.48 | 116.48 | 115.74 | 115.74 | 0.74 | 0.26 | 173.48 | 115.65 | 0.65 | 0.35 | 173.3 | 0 | 0.18 |
| 203 | 174.34 | 116.34 | 116.67 | 116.34 | 0.34 | 0.66 | 174.34 | 116.22 | 0.22 | 0.78 | 174.22 | 0 | 0.12 |
| 204 | 175.2 | 117.2 | 117.1 | 117.1 | 0.1 | 0.9 | 175.2 | 116.8 | 0.8 | 0.2 | 174.8 | 0 | 0.4 |
| 205 | 176.05 | 118.05 | 117.53 | 117.525 | 0.525 | 0.475 | 176.05 | 117.37 | 0.37 | 0.63 | 175.74 | 0 | 0.31 |
| 206 | 176.91 | 118.91 | 117.96 | 117.955 | 0.955 | 0.045 | 176.91 | 117.94 | 0.94 | 0.06 | 176.88 | 0 | 0.03 |
| 207 | 177.77 | 118.77 | 118.89 | 118.77 | 0.77 | 0.23 | 177.77 | 118.51 | 0.51 | 0.49 | 177.51 | 0 | 0.26 |
| 208 | 178.63 | 119.63 | 119.32 | 119.315 | 0.315 | 0.685 | 178.63 | 119.09 | 0.09 | 0.91 | 178.18 | 0 | 0.45 |
| 209 | 179.49 | 120.49 | 119.75 | 119.745 | 0.745 | 0.255 | 179.49 | 119.66 | 0.66 | 0.34 | 179.32 | 0 | 0.17 |
| 210 | 180.35 | 120.35 | 120.68 | 120.35 | 0.35 | 0.65 | 180.35 | 120.23 | 0.23 | 0.77 | 180.23 | 0 | 0.12 |
| 211 | 181.21 | 121.21 | 121.11 | 121.105 | 0.105 | 0.895 | 181.21 | 120.8 | 0.8 | 0.2 | 180.8 | 0 | 0.41 |
| 212 | 182.07 | 122.07 | 121.54 | 121.535 | 0.535 | 0.465 | 182.07 | 121.38 | 0.38 | 0.62 | 181.76 | 0 | 0.31 |
| 213 | 182.92 | 122.92 | 121.96 | 121.96 | 0.96 | 0.04 | 182.92 | 121.95 | 0.95 | 0.05 | 182.9 | 0 | 0.02 |
| 214 | 183.78 | 122.78 | 122.89 | 122.78 | 0.78 | 0.22 | 183.78 | 122.52 | 0.52 | 0.48 | 183.52 | 0 | 0.26 |
| 215 | 184.64 | 123.64 | 123.32 | 123.32 | 0.32 | 0.68 | 184.64 | 123.09 | 0.09 | 0.91 | 184.18 | 0 | 0.46 |
| 216 | 185.5 | 124.5 | 123.75 | 123.75 | 0.75 | 0.25 | 185.5 | 123.67 | 0.67 | 0.33 | 185.34 | 0 | 0.16 |
| 217 | 186.36 | 124.36 | 124.68 | 124.36 | 0.36 | 0.64 | 186.36 | 124.24 | 0.24 | 0.76 | 186.24 | 0 | 0.12 |
| 218 | 187.22 | 125.22 | 125.11 | 125.11 | 0.11 | 0.89 | 187.22 | 124.81 | 0.81 | 0.19 | 186.81 | 0 | 0.41 |
| 219 | 188.08 | 126.08 | 125.54 | 125.54 | 0.54 | 0.46 | 188.08 | 125.38 | 0.38 | 0.62 | 187.76 | 0 | 0.32 |
| 220 | 188.94 | 126.94 | 125.97 | 125.97 | 0.97 | 0.03 | 188.94 | 125.96 | 0.96 | 0.04 | 188.92 | 0 | 0.02 |
| 221 | 189.8 | 126.8 | 126.9 | 126.8 | 0.8 | 0.2 | 189.8 | 126.53 | 0.53 | 0.47 | 189.53 | 0 | 0.27 |
| 222 | 190.65 | 127.65 | 127.33 | 127.325 | 0.325 | 0.675 | 190.65 | 127.1 | 0.1 | 0.9 | 190.2 | 0 | 0.45 |
| 223 | 191.51 | 128.51 | 127.76 | 127.755 | 0.755 | 0.245 | 191.51 | 127.67 | 0.67 | 0.33 | 191.34 | 0 | 0.17 |

Fig.59

| INPUT SIGNAL (256 GRAY SCALES) | SIGNAL A1 (WITH SUB GAIN CONTROL CIRCUIT, 220 GRAY SCALES) | COMPUTATION (1) | COMPUTATION (2) | SIGNAL B1 (148 GRAY SCALES) | FRACTIONAL PART α | FRACTIONAL PART 1−α | SIGNAL C1 (220 GRAY SCALES) | SIGNAL A2 (WITHOUT SUB GAIN CONTROL CIRCUIT, 147 GRAY SCALES) | FRACTIONAL PART β | FRACTIONAL PART 1−β | SIGNAL C2 (220 GRAY SCALES) | ERROR OF OUTPUT SIGNAL ACCURACY DISPLAY 1 A1−C1 | ERROR OF OUTPUT SIGNAL ACCURACY DISPLAY 2 A1−C2 |
|---|---|---|---|---|---|---|---|---|---|---|---|---|---|
| 224 | 192.37 | 128.37 | 128.69 | 128.37 | 0.37 | 0.63 | 192.37 | 128.25 | 0.25 | 0.75 | 192.25 | 0 | 0.12 |
| 225 | 193.23 | 129.23 | 129.12 | 129.115 | 0.115 | 0.885 | 193.23 | 128.82 | 0.82 | 0.18 | 192.82 | 0 | 0.41 |
| 226 | 194.09 | 130.09 | 129.55 | 129.545 | 0.545 | 0.455 | 194.09 | 129.39 | 0.39 | 0.61 | 193.78 | 0 | 0.31 |
| 227 | 194.95 | 130.95 | 129.98 | 129.975 | 0.975 | 0.025 | 194.95 | 129.96 | 0.96 | 0.04 | 194.92 | 0 | 0.03 |
| 228 | 195.81 | 130.81 | 130.91 | 130.81 | 0.81 | 0.19 | 195.81 | 130.54 | 0.54 | 0.46 | 195.54 | 0 | 0.27 |
| 229 | 196.67 | 131.67 | 131.34 | 131.335 | 0.335 | 0.665 | 196.67 | 131.11 | 0.11 | 0.89 | 196.22 | 0 | 0.45 |
| 230 | 197.52 | 132.52 | 131.76 | 131.76 | 0.76 | 0.24 | 197.52 | 131.68 | 0.68 | 0.32 | 197.36 | 0 | 0.16 |
| 231 | 198.38 | 132.38 | 132.69 | 132.38 | 0.38 | 0.62 | 198.38 | 132.25 | 0.25 | 0.75 | 198.25 | 0 | 0.13 |
| 232 | 199.24 | 133.24 | 133.12 | 133.12 | 0.12 | 0.88 | 199.24 | 132.83 | 0.83 | 0.17 | 198.83 | 0 | 0.41 |
| 233 | 200.1 | 134.1 | 133.55 | 133.55 | 0.55 | 0.45 | 200.1 | 133.4 | 0.4 | 0.6 | 199.8 | 0 | 0.3 |
| 234 | 200.96 | 134.96 | 133.98 | 133.98 | 0.98 | 0.02 | 200.96 | 133.97 | 0.97 | 0.03 | 200.94 | 0 | 0.02 |
| 235 | 201.82 | 134.82 | 134.91 | 134.82 | 0.82 | 0.18 | 201.82 | 134.54 | 0.54 | 0.46 | 201.54 | 0 | 0.28 |
| 236 | 202.68 | 135.68 | 135.34 | 135.34 | 0.34 | 0.66 | 202.68 | 135.12 | 0.12 | 0.88 | 202.24 | 0 | 0.44 |
| 237 | 203.54 | 136.54 | 135.77 | 135.77 | 0.77 | 0.23 | 203.54 | 135.69 | 0.69 | 0.31 | 203.38 | 0 | 0.16 |
| 238 | 204.4 | 136.4 | 136.7 | 136.4 | 0.4 | 0.6 | 204.4 | 136.26 | 0.26 | 0.74 | 204.26 | 0 | 0.14 |
| 239 | 205.25 | 137.25 | 137.13 | 137.125 | 0.125 | 0.875 | 205.25 | 136.83 | 0.83 | 0.17 | 204.83 | 0 | 0.42 |
| 240 | 206.11 | 138.11 | 137.56 | 137.555 | 0.555 | 0.445 | 206.11 | 137.41 | 0.41 | 0.59 | 205.82 | 0 | 0.29 |
| 241 | 206.97 | 138.97 | 137.99 | 137.985 | 0.985 | 0.015 | 206.97 | 137.98 | 0.98 | 0.02 | 206.96 | 0 | 0.01 |
| 242 | 207.83 | 138.83 | 138.92 | 138.83 | 0.83 | 0.17 | 207.83 | 138.55 | 0.55 | 0.45 | 207.55 | 0 | 0.28 |
| 243 | 208.69 | 139.69 | 139.35 | 139.345 | 0.345 | 0.655 | 208.69 | 139.12 | 0.12 | 0.88 | 208.24 | 0 | 0.45 |
| 244 | 209.55 | 140.55 | 139.78 | 139.775 | 0.775 | 0.225 | 209.55 | 139.7 | 0.7 | 0.3 | 209.4 | 0 | 0.15 |
| 245 | 210.41 | 140.41 | 140.71 | 140.41 | 0.41 | 0.59 | 210.41 | 140.27 | 0.27 | 0.73 | 210.27 | 0 | 0.14 |
| 246 | 211.27 | 141.27 | 141.14 | 141.135 | 0.135 | 0.865 | 211.27 | 140.84 | 0.84 | 0.16 | 210.84 | 0 | 0.43 |
| 247 | 212.12 | 142.12 | 141.56 | 141.56 | 0.56 | 0.44 | 212.12 | 141.41 | 0.41 | 0.59 | 211.82 | 0 | 0.3 |
| 248 | 212.98 | 142.98 | 141.99 | 141.99 | 0.99 | 0.01 | 212.98 | 141.99 | 0.99 | 0.01 | 212.98 | 0 | 0 |
| 249 | 213.84 | 142.84 | 142.92 | 142.84 | 0.84 | 0.16 | 213.84 | 142.56 | 0.56 | 0.44 | 213.56 | 0 | 0.28 |
| 250 | 214.7 | 143.7 | 143.35 | 143.35 | 0.35 | 0.65 | 214.7 | 143.13 | 0.13 | 0.87 | 214.26 | 0 | 0.44 |
| 251 | 215.56 | 144.56 | 143.78 | 143.78 | 0.78 | 0.22 | 215.56 | 143.7 | 0.7 | 0.3 | 215.4 | 0 | 0.16 |

Fig.60

| INPUT SIGNAL (256 GRAY SCALES) | SIGNAL A1 (WITH SUB GAIN CONTROL CIRCUIT, 220 GRAY SCALES) | COMPUTATION (1) | COMPUTATION (2) | SIGNAL B1 (148 GRAY SCALES) | FRACTIONAL PART $\alpha$ | FRACTIONAL PART' $1-\alpha$ | SIGNAL C1 (220 GRAY SCALES) | SIGNAL A2 (WITHOUT SUB GAIN CONTROL CIRCUIT, 147 GRAY SCALES) | FRACTIONAL PART $\beta$ | FRACTIONAL PART $1-\beta$ | SIGNAL C2 (220 GRAY SCALES) | DISPLAY 1 A1−C1 (ERROR OF OUTPUT SIGNAL ACCURACY) | DISPLAY 2 A1−C2 (ERROR OF OUTPUT SIGNAL ACCURACY) |
|---|---|---|---|---|---|---|---|---|---|---|---|---|---|
| 252 | 216.42 | 144.42 | 144.71 | 144.42 | 0.42 | 0.58 | 216.42 | 144.28 | 0.28 | 0.72 | 216.28 | 0 | 0.14 |
| 253 | 217.28 | 145.28 | 145.14 | 145.14 | 0.14 | 0.86 | 217.28 | 144.85 | 0.85 | 0.15 | 216.85 | 0 | 0.43 |
| 254 | 218.14 | 146.14 | 145.57 | 145.57 | 0.57 | 0.43 | 218.14 | 145.42 | 0.42 | 0.58 | 217.84 | 0 | 0.3 |
| 255 | 219 | 146 | 146.5 | 146 | 0 | 1 | 219 | 146 | 0 | 1 | 219 | 0 | 0 |

ERROR OF OUTPUT SIGNAL ACCURACY

DISPLAY 1: $\Sigma(A1-C1)=0$

DISPLAY 2: $\Sigma(A1-C2)=70.42$

DISPLAY APPARATUS AND DISPLAY DRIVING METHOD FOR EFFECTIVELY ELIMINATING THE OCCURRENCE OF A MOVING IMAGE FALSE CONTOUR

CROSS REFERENCE TO RELATED APPLICATION

This application is based upon and claims the benefit of priority from the prior Japanese Patent Application No. 2003-187702, filed on Jun. 30, 2003, the entire contents of which are incorporated herein by reference.

BACKGROUND OF THE INVENTION

1. Field of the Invention

The present invention relates to a display apparatus and a display driving method, and more particularly to a display apparatus and a display driving method suitable for driving a plasma display panel (PDP).

2. Description of the Related Art

With the recent trend toward larger-screen displays, the need for thin display apparatuses has been increasing, and various types of thin display apparatus have been commercially implemented. Examples include matrix panels that display images by directly using digital signals, such as PDPs and other gas discharge display panels, digital micromirror devices (DMDs), EL display devices, fluorescent display tubes, and liquid crystal display devices. Among such thin display devices, gas discharge display panels are considered to be the most promising candidate for large-area, direct-view HDTV (high-definition television) display devices, because of the simple production process which facilitates fabrication of larger-area displays, a self-luminescent property which ensures good display quality, and a high response speed.

A plasma display apparatus that utilizes a surface discharge has a structure such that a pair of electrodes are formed on the inner surface of a front glass substrate and a rare gas is filled therein. When a voltage is applied between the electrodes, a surface discharge occurs at the surface of a protective layer and a dielectric layer formed on the electrode surface, resulting in the emission of ultraviolet light. The inner surface of a rear glass substrate is coated with phosphors of three primary colors, red (R), green (G), and blue (B), which when excited by the ultraviolet light, produce visible light to achieve a color display.

In the plasma display apparatus, each field (frame) is divided into a plurality of weighted subfields (SFS: light emission blocks) each comprising a plurality of sustain discharge pulses (sustain pulses), and a gray scale display is achieved by combining these subfields. In a display apparatus that achieves a gray scale display by combining a plurality of such weighted subfields, a phenomenon can occur in which an unnatural color contour, which normally should not exist, appears on the surface of a moving image due to the persistence of human vision, etc. This phenomenon is generally known as "moving image false contour (or moving image pseudo contour." In particular, when a person in a displayed image moves, a green or red color band occurs, for example, on the contour of the person's face or other flesh-colored portions, and this greatly degrades the picture quality.

In the prior art, techniques for improving the picture quality by reducing the moving image false contour phenomenon are proposed in Japanese Patent No. 3322809 (Japanese Unexamined Patent Publication (Kokai) No. 10-31455: JPP'455) and Japanese Unexamined Patent Publication (Kokai) No. 11-85101 (JPP'101). In the prior art, there is also proposed, in Japanese Patent No. 3357666 (Japanese Unexamined Patent Publication (Kokai) No. 2002-82649: JPP'649), a display apparatus and a display driving method in which, by using an error diffusion technique, the maximum gray scale level and the number of reproducible gray scale levels are made sufficiently large without increasing the number of subfields, while at the same time achieving enhancement in the reproducibility of low gray scale levels.

The prior art and its associated problems will be described later with reference to the accompanying drawings.

SUMMARY OF THE INVENTION

According to the present invention, there is provided a display apparatus which expresses luminance by varying light emission time length and displays gray scale by using a subfield method, comprising a gain control circuit compressing the number of gray scale levels of an input signal and outputting a first intermediate image signal with a first number of gray scale levels; a sub gain control circuit receiving the first intermediate image signal, compressing the number of gray scale levels of the first intermediate image signal, and outputting a second intermediate image signal with a second number of gray scale levels; and an error diffusion circuit receiving the second intermediate image signal and increasing the number of gray scale levels by simulating additional gray scale levels through error diffusion.

The display apparatus may further comprise a first subfield arrangement setting unit forming one field with a plurality of subfields so that the number of gray scale levels becomes equal to the first number of gray scale levels; and a second subfield arrangement setting unit forming one field with a plurality of subfields so that the number of gray scale levels becomes equal to the second number of gray scale levels which is smaller than the first number of gray scale levels. The image signal may be any one of RGB signals of red, green, and blue; and the gain control circuit, the sub gain control circuit, and the error diffusion circuit may be provided for each of the RGB signals.

According to the present invention, there is also provided a display apparatus which expresses luminance by varying light emission time length and displays gray scale by using a subfield method, comprising a main path generating, from an input signal with a first number of gray scale levels, a first image signal with a second number of gray scale levels which is smaller than the first number of gray scale levels; a sub path generating a second image signal with a third number of gray scale levels which is smaller than the second number of gray scale levels; a switch circuit outputting the first image signal generated by the main path or the second image signal generated by the sub path by switching therebetween; and a path switching control section detecting, from the input image signal and a signal obtained by processing the input image signal, a motion region where the amount of image motion is larger than a predetermined value, and in the motion region, switching the switch circuit from the first image signal to the second image signal, and wherein the main path comprises a gain control circuit receiving the input image signal with the first number of gray scale levels and outputting a first intermediate image signal with a fourth number of gray scale levels; a sub gain control circuit receiving the first intermediate image signal and outputting a second intermediate image signal which has the second number of gray scale levels; and an error diffusion circuit receiving an output signal of the sub gain control circuit, applying error diffusion, and outputting the first image signal.

The display apparatus may further comprise a first subfield arrangement setting unit forming one field with a plurality of subfields so that the number of gray scale levels becomes equal to the fourth number of gray scale levels; and a second subfield arrangement setting unit forming one field with a plurality of subfields so that the number of gray scale levels becomes equal to the second number of gray scale levels which is smaller than the fourth number of gray scale levels. The first subfield arrangement setting unit may assign a weight 1 to a first subfield and a weight 3 or larger to a second subfield.

The ratio of the weight assigned to each subfield in the first subfield arrangement setting unit to the weight assigned to each subfield in the second subfield arrangement setting unit may be approximately m:n (where m and n are natural numbers, and n<m). The subfields to be set for light emission when displaying an arbitrary gray scale level may except low gray scale levels, the second subfield arrangement setting unit may set the most heavily weighted subfield for light emission along with at least one of the other subfields.

The first subfield arrangement setting unit may set the arrangement of the plurality of subfields to achieve the fourth number of gray scale levels, m, and the second subfield arrangement setting unit may set the arrangement of the plurality of subfields to achieve the second number of gray scale levels, n (where m and n are natural numbers, and n<m). The number of gray scale levels, m, generated by the first subfield arrangement setting unit and the number of gray scale levels, n, generated by the second subfield arrangement setting unit may have a relationship such that (m−1):(n−1) is substantially equal to a ratio of integers. The ratio (m−1):(n−1) may be 2:3, 4:5, or 4:7.

The sub gain control circuit may generate the second intermediate image signal with the second number of gray scale levels by compressing the first intermediate image signal with the fourth number of gray scale levels through multiplication with (n−1)/(m−1). The sub gain control circuit may divide n gray scale levels into a plurality of regions, and may perform the multiplication with the coefficient (n−1)/(m−1) by approximating the divided regions by a broken line formed of a set of straight line segments each having a slope equal to a submultiple of a natural number. The slope of each of the straight line segments in the broken line approximation may be selected from the group consisting of 1, ½, ⅓, and ¼.

The display apparatus may further comprise a weight setting unit multiplying each weight by (m−1)/(n−1) in order to expand the first image signal compressed through the multiplication with the coefficient (n−1)/(m−1) in the sub gain control circuit and output via the error diffusion circuit. The image signal may be any one of RGB signals of red, green, and blue; and the main path, the sub path, the switch circuit, the path switching control section, the gain control circuit, the sub gain control circuit, and the error diffusion circuit may be provided for each of the RGB signals. The display apparatus may be a plasma display apparatus.

Further, according to the present invention, there is provided a display driving method for driving a display that expresses luminance by varying light emission time length and displays gray scale by using a subfield method, the driving method comprising the steps of generating a first intermediate image signal with a first number of gray scale levels by compressing the number of gray scale levels of an input signal; generating a second intermediate image signal with a second number of gray scale levels by further compressing the number of gray scale levels of the first intermediate image signal; and generating an output image signal by applying error diffusion to the second intermediate image signal.

The display driving method may further comprise the steps of performing first subfield arrangement setting to form one field with a plurality of subfields so that the number of gray scale levels becomes equal to the first number of gray scale levels; and performing second subfield arrangement setting to form one field with a plurality of subfields so that the number of gray scale levels becomes equal to the second number of gray scale levels which is smaller than the first number of gray scale levels. The image signal may be any one of RGB signals of red, green, and blue; and gain control circuit, the sub gain control circuit, and the error diffusion circuit may be provided for each of the RGB signals.

In addition, according to the present invention, there is also provided a display driving method for driving a display that expresses luminance by varying light emission time length and displays gray scale by using a subfield method, the display comprising a main path generating, from an input signal with a first number of gray scale levels, a first image signal with a second number of gray scale levels which is smaller than the first number of gray scale levels; a sub path generating a second image signal with a third number of gray scale levels which is smaller than the second number of gray scale levels; a switch circuit outputting the first image signal generated by the main path or the second image signal generated by the sub path by switching therebetween; and a path switching control section detecting, from the input image signal and a signal obtained by processing the input image signal, a motion region where the amount of image motion is larger than a predetermined value, and in the motion region, switching the switch circuit from the first image signal to the second image signal, and wherein, in the main path a first computation is performed to compress the input image signal with the first number of gray scale levels, thereby generating a first intermediate image signal with a fourth number of gray scale levels; a second computation is performed to further compress the first intermediate image signal, thereby outputting a second intermediate image signal having the second number of gray scale levels which is smaller than the fourth number of gray scale levels; and error diffusion is applied to the sub gain control circuit, thereby generating the first image signal.

The display driving method may further comprise the steps of performing first subfield arrangement setting to form one field with a plurality of subfields so that the number of gray scale levels becomes equal to the fourth number of gray scale levels; and performing second subfield arrangement setting to form one field with a plurality of subfields so that the number of gray scale levels becomes equal to the second number of gray scale levels which is smaller than the fourth number of gray scale levels.

In the first subfield arrangement setting, a weight 1 may be assigned to a first subfield and a weight 3 or larger is assigned to a second subfield. The ratio of the weight assigned to each subfield in the first subfield arrangement setting to the weight assigned to each subfield in the second subfield arrangement setting may be approximately m:n (where m and n are natural numbers, and n<m). In the second subfield arrangement setting, of the subfields to be set for light emission when displaying an arbitrary gray scale level except low gray scale levels, the most heavily weighted subfield may be set for light emission along with at least one of the other subfields.

The first subfield arrangement setting may set the arrangement of the plurality of subfields to achieve the fourth number of gray scale levels, m, and the second subfield arrangement setting may set the arrangement of the plurality of subfields to achieve the second number of gray scale levels, n (where m and n are natural numbers, and n<m). The number of gray scale levels, m, generated in the first subfield arrangement setting and the number of gray scale levels, n, generated in the second subfield arrangement setting may have a relationship such that (m−1):(n−1) is substantially equal to a ratio of integers. The ratio (m−1):(n−1) may be 2:3, 4:5, or 4:7.

The generation of the second intermediate image signal performed by further compressing the number of gray scale levels of the first intermediate image signal may be accomplished by multiplying the first intermediate image signal by (n−1)/(m−1). The generation of the second intermediate image signal performed by further compressing the number of gray scale levels of the first intermediate image signal may comprise dividing n gray scale levels into a plurality of regions and multiplying the first intermediate image signal by (n−1)/(m−1) by approximating the divided regions by a broken line formed of a set of straight line segments each having a slope equal to a submultiple of a natural number. The slope of each of the straight line segments in the broken line approximation may be selected from the group consisting of 1, ½, ⅓, and ¼.

The display driving method may further comprise the step of multiplying each weight by (m−1)/(n−1) in order to expand the output image signal compressed through the multiplication with the coefficient (n−1)/(m−1) and output after the error diffusion. The image signal may be any one of RGB signals of red, green, and blue; and the main path, the sub path, the switch circuit, the path switching control section, the gain control circuit, the sub gain control circuit, and the error diffusion circuit may be provided for each of the RGB signals. The display apparatus may be a plasma display apparatus.

BRIEF DESCRIPTION OF THE DRAWINGS

The present invention will be more clearly understood from the description of the preferred embodiments as set forth below with reference to the accompanying drawings, wherein:

FIG. 9 is a diagram (part 1) showing one example of a subfield light emission table which is applied to the plasma display apparatus according to the present invention;

FIG. 10 is a diagram (part 2) showing the example of the subfield light emission table applied to the plasma display apparatus according to the present invention;

FIG. 11 is a diagram (part 3) showing the example of the subfield light emission table applied to the plasma display apparatus according to the present invention;

FIG. 12 is a diagram (part 4) showing the example of the subfield light emission table applied to the plasma display apparatus according to the present invention;

FIG. 13 is a diagram showing one example of a subfield light emission table for the sub path, which is applied to the plasma display apparatus according to the present invention;

FIG. 14 is a diagram (part 1) showing another example of the subfield light emission table applied to the plasma display apparatus according to the present invention;

FIG. 15 is a diagram (part 2) showing the example of the subfield light emission table applied to the plasma display apparatus according to the present invention;

FIG. 16 is a diagram (part 3) showing the example of the subfield light emission table applied to the plasma display apparatus according to the present invention;

FIG. 17 is a diagram (part 4) showing the example of the subfield light emission table applied to the plasma display apparatus according to the present invention;

FIG. 18 is a diagram showing another example of the subfield light emission table for the sub path, which is applied to the plasma display apparatus according to the present invention;

FIG. 21 is a diagram (part 1) for explaining the operation of the sub gain control circuit shown in FIG. 19;

FIG. 22 is a diagram (part 2) for explaining the operation of the sub gain control circuit shown in FIG. 19;

FIG. 23 is a diagram (part 3) for explaining the operation of the sub gain control circuit shown in FIG. 19;

FIG. 24 is a diagram (part 4) for explaining the operation of the sub gain control circuit shown in FIG. 19;

FIG. 25 is a diagram (part 5) for explaining the operation of the sub gain control circuit shown in FIG. 19;

FIG. 26 is a diagram (part 6) for explaining the operation of the sub gain control circuit shown in FIG. 19;

FIG. 29 is a diagram (part 1) for explaining the operation of the sub gain control circuit shown in FIG. 27;

FIG. 30 is a diagram (part 2) for explaining the operation of the sub gain control circuit shown in FIG. 27;

FIG. 31 is a diagram (part 3) for explaining the operation of the sub gain control circuit shown in FIG. 27;

FIG. 32 is a diagram (part 4) for explaining the operation of the sub gain control circuit shown in FIG. 27;

FIG. 33 is a diagram (part 5) for explaining the operation of the sub gain control circuit shown in FIG. 27;

FIG. 35 is a diagram for explaining the sub gain control circuit shown in FIG. 34;

FIG. 36 is a diagram (part 1) for explaining the operation of the sub gain control circuit shown in FIG. 34;

FIG. 37 is a diagram (part 2) for explaining the operation of the sub gain control circuit shown in FIG. 34;

FIG. 38 is a diagram (part 3) for explaining the operation of the sub gain control circuit shown in FIG. 34;

FIG. 39 is a diagram (part 4) for explaining the operation of the sub gain control circuit shown in FIG. 34;

FIG. 40 is a diagram (part 5) for explaining the operation of the sub gain control circuit shown in FIG. 34;

FIG. 41 is a diagram (part 6) for explaining the operation of the sub gain control circuit shown in FIG. 34;

FIG. 42 is a diagram (part 7) for explaining the operation of the sub gain control circuit shown in FIG. 34;

FIG. 45 is a diagram (part 1) for explaining the operation of the sub gain control circuit shown in FIG. 43;

FIG. 46 is a diagram (part 2) for explaining the operation of the sub gain control circuit shown in FIG. 43;

FIG. 47 is a diagram (part 3) for explaining the operation of the sub gain control circuit shown in FIG. 43;

FIG. 48 is a diagram (part 4) for explaining the operation of the sub gain control circuit shown in FIG. 43;

FIG. 49 is a diagram (part 5) for explaining the operation of the sub gain control circuit shown in FIG. 43;

FIG. 51 is a diagram (part 1) for explaining the effect of using the sub gain control circuit in the plasma display apparatus according to the present invention;

FIG. 52 is a diagram (part 2) for explaining the effect of using the sub gain control circuit in the plasma display apparatus according to the present invention;

FIG. 53 is a diagram (part 3) for explaining the effect of using the sub gain control circuit in the plasma display apparatus according to the present invention;

FIG. 54 is a diagram (part 4) for explaining the effect of using the sub gain control circuit in the plasma display apparatus according to the present invention;

FIG. 55 is a diagram (part 5) for explaining the effect of using the sub gain control circuit in the plasma display apparatus according to the present invention;

FIG. 56 is a diagram (part 6) for explaining the effect of using the sub gain control circuit in the plasma display apparatus according to the present invention;

FIG. 57 is a diagram (part 7) for explaining the effect of using the sub gain control circuit in the plasma display apparatus according to the present invention;

FIG. 58 is a diagram (part 8) for explaining the effect of using the sub gain control circuit in the plasma display apparatus according to the present invention;

FIG. 59 is a diagram (part 9) for explaining the effect of using the sub gain control circuit in the plasma display apparatus according to the present invention; and FIG. 60 is a diagram (part 10) for explaining the effect of using the sub gain control circuit in the plasma display apparatus according to the present invention.

DESCRIPTION OF THE PREFERRED EMBODIMENTS

Before proceeding to the detailed description of the preferred embodiments of the present invention, the prior art display apparatuses and display driving methods and their associated problems will be described with reference to the drawings.

Figure 1:
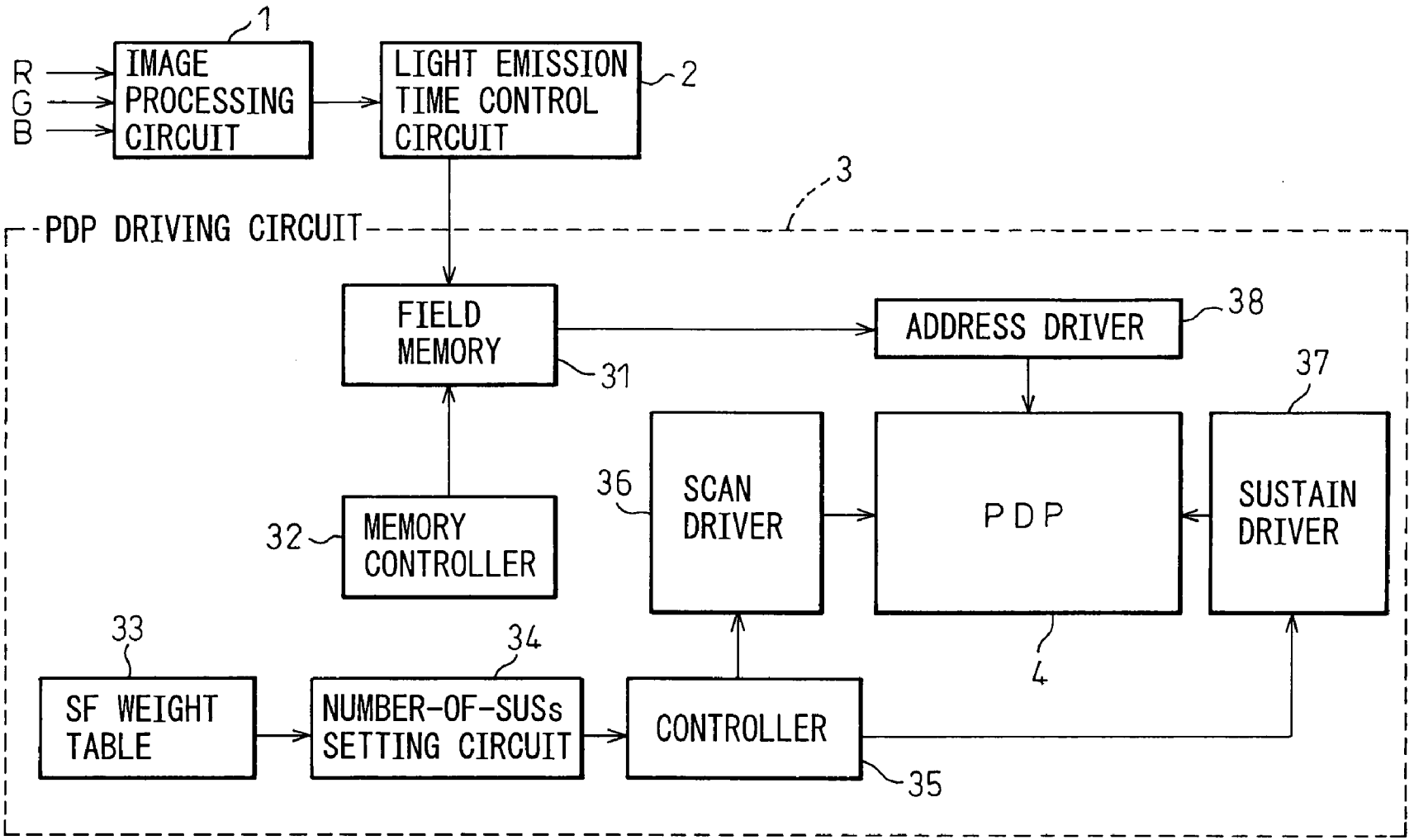
FIG. 1 is a block diagram schematically showing one example of a plasma display apparatus.

FIG. 1 is a block diagram schematically showing one example of a plasma display apparatus. In FIG. 1, reference numeral 1 is an image processing circuit, 2 is an light emission time control circuit, 3 is a PDP driving circuit, and 4 is a PDP. For convenience of illustration, in FIG. 1 the PDP 4 is shown inside the PDP driving circuit 3.

As shown in FIG. 1, the plasma display apparatus comprises: the image processing circuit 1 which processes image signals of R, G, and B colors; the light emission time control circuit 2 which controls the light emission time for light emission in the PDP 4 in accordance with output signals of the image processing circuit 1; and the PDP driving circuit 3 which drives the PDP 4 in accordance with the output of the light emission time control circuit 2. The PDP driving circuit 3 comprises a field memory 31, a memory controller 32, an SF weight table 33, a number-of-SUSs setting circuit 34, a controller 35, a scan driver 36, a sustain driver 37, and an address driver 38. Here, the SF weight table 33 is a memory device which stores the ratio of the number of SUSs (weight) for each subfield, and the number-of-SUSs setting circuit 34 is a circuit which, in accordance with the SF weight table 33, sets the number of SUSs with which each SF is caused to emit light.

The light emission time control circuit 2 receives the output signals of the image processing circuit 1, converts them into data indicating the times and the subfields for light emission to achieve desired gray scale levels, and supplies the converted data to the PDP driving circuit 3. The converted data supplied from the light emission time control circuit 2 is written to and read from the field memory 31 under the control of the memory controller 32. Here, the light emission time control circuit 2 and the field memory 31 together constitute a subfield converting section.

The address driver 38 drives the PDP 4 based on the data read from the field memory 31. The controller 35 receives the output of the SF weight table 33 via the number-of-SUSs setting circuit 34, and controls the driving of the PDP 4 by controlling the scan driver 36 as well as the sustain driver 37. When the PDP 4 is driven by the scan driver 36 and the address driver 38, a wall charge is formed on each pixel to be activated for light emission in each subfield, and when the PDP 4 is driven by the sustain driver 37, sustain discharge occurs.

Figure 2:
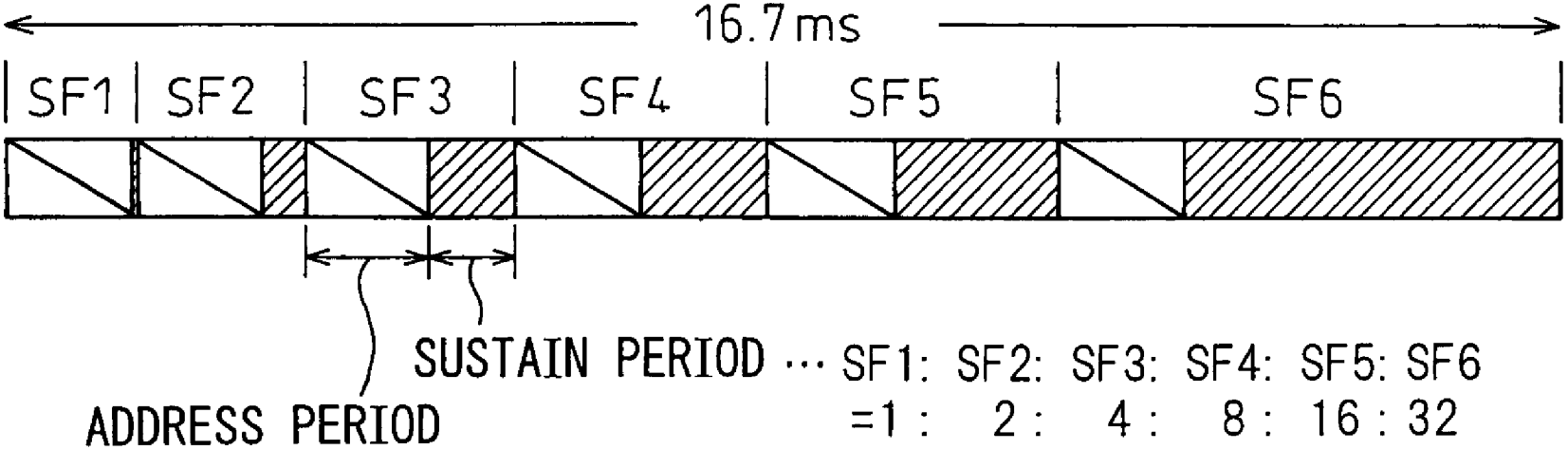
Fig.2 (PRIOR ART)
FIG. 2 is a diagram showing one example of a gray scale driving sequence in a prior art plasma display apparatus.

FIG. 2 is a diagram showing one example of a gray scale driving sequence in the prior art plasma display apparatus.

As shown in FIG. 2, in the gray scale driving sequence for the plasma display apparatus, each field for forming one complete image is divided, for example, into a plurality of subfields (for example, SF1 to SF6), and a gray scale display of the image is achieved by controlling the sustain period (light emission period) in each subfield. Each subfield comprises an address period in which a wall charge is formed for all the pixels that are to be activated for light emission in the subfield period, and the sustain period which determines the luminance level. Accordingly, if the number of subfields is increased, the number of address periods increases correspondingly, and the sustain periods for light emission are relatively shortened, resulting in reduced screen brightness.

In a PDP, in order to increase the number of reproducible gray scale levels by using the limited number of subfields, a gray scale driving method is commonly employed that drives the PDP by using the sustain periods proportional to the bit weights as shown in FIG. 2. That is, in the example shown in FIG. 2, one field is made up of six subfield periods SF1 to SF6, and 64 levels of gray scale are reproduced by a 6-bit image signal (image data) corresponding to each subfield. The sustain periods in the respective subfield periods SF1 to SF6 are indicated by hatching by assuming, for convenience, that light emission is produced in each subfield period, and the time (length) ratio is set as SF1:SF2:SF3:SF4:SF5:SF6=1:2:4:8:16:32. Here, one field period is about 16.7 ms.

When displaying a moving image on the PDP using the above gray scale driving sequence, a phenomenon can occur in which an unnatural color contour, which normally should not exist, appears on the surface of the moving image due to the persistence of human vision, etc. The contour occurring in this phenomenon is generally known as "moving image false contour". This moving image false contour becomes particularly noticeable when a person on the display screen moves; for example, a green or red color band occurs on the contour of the person's face or other flesh-colored portions, degrading the picture quality.

In the prior art, techniques for improving the picture quality by reducing the moving image false contour phenomenon are proposed in JPP'455 and JPP'101.

Figure 3:
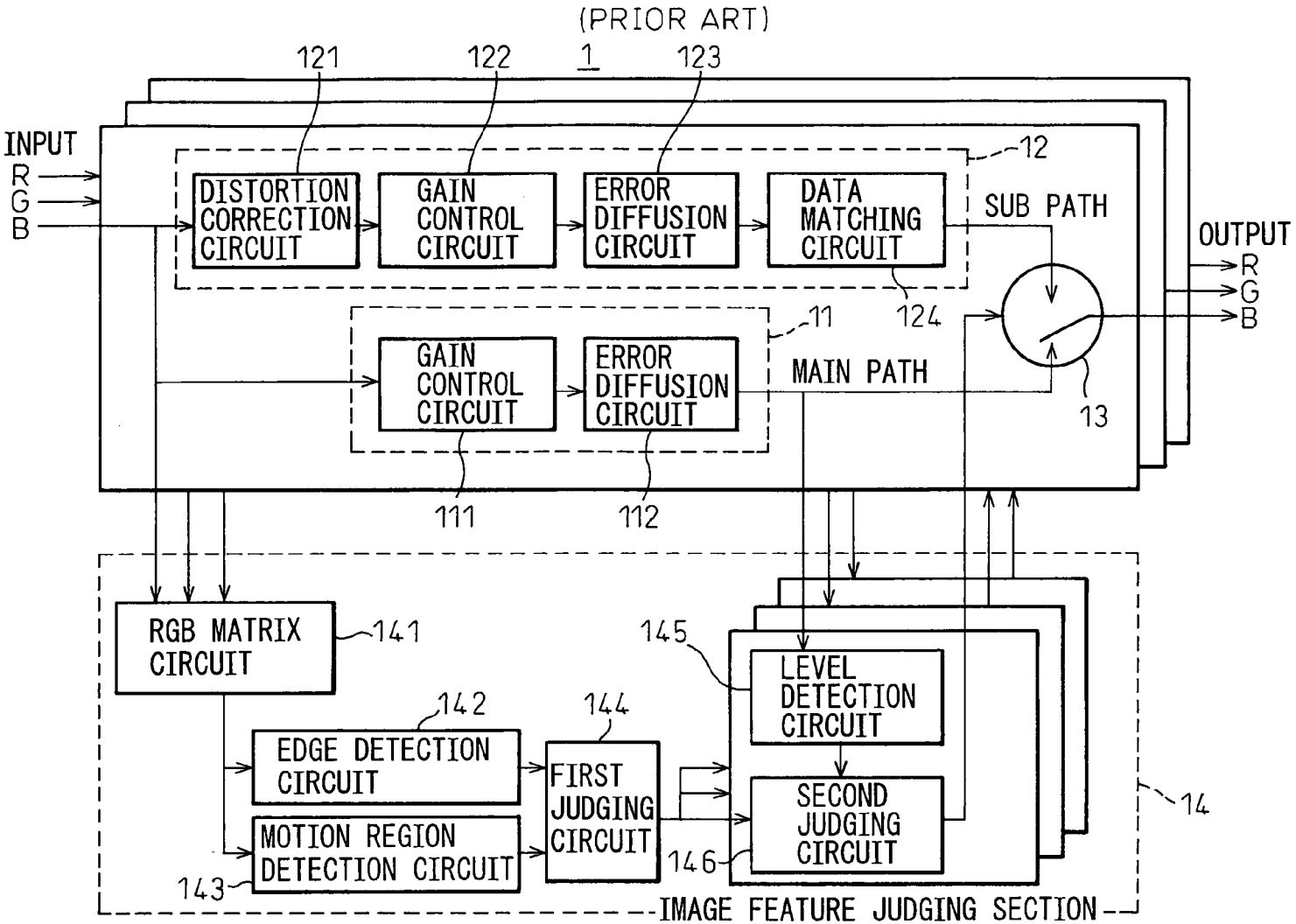
Fig.3 (PRIOR ART)
FIG. 3 is a block diagram showing one example of an image processing circuit in the prior art plasma display apparatus.

FIG. 3 is a block diagram showing one example of an image processing circuit in the prior art plasma display apparatus, which is applied, for example, as the image processing circuit 1 in the plasma display apparatus shown in FIG. 1.

As shown in FIG. 3, the image processing circuit 1 roughly comprises a main path 11, a sub path 12, a switch circuit 13, and an image feature judging section 14. Each input image signal is supplied in parallel to the main path 11, the sub path 12, and to a part of the image feature judging section 14. The output of the main path 11 is supplied to the switch circuit 13, as well as to a part of the image feature judging section 14. The output of the sub path 12 is supplied to the switch circuit 13. Based on a path select/switch signal supplied from the image feature judging section 14, the switch circuit 13 supplies the image signal from the main path 11 or the sub path 12, whichever is selected, to the light emission time control circuit 2 shown in FIG. 1.

The main path 11 includes a gain control circuit 111 which is supplied with the input image signal, and an error diffusion circuit 112 which is supplied with an output signal of the gain control circuit 111. On the other hand, the sub path 12 includes a distortion correction circuit 121 which is supplied with the input image signal, a gain control circuit 122 which is supplied with an output signal of the distortion correction circuit 121, an error diffusion circuit 123 which is supplied with an output signal of the gain control circuit 122, and a data matching circuit 124 which is supplied with an output signal of the error diffusion circuit 123.

The image feature judging section 14 includes an RGB matrix circuit 141 which is supplied with the input image signals, an edge detection circuit 142 and a motion region detection circuit 143 each of which is supplied with an output signal of the RGB matrix circuit 141, a first judging circuit 144 which is supplied with output signals of the edge detection circuit 142 and the motion region detection circuit 143, a level detection circuit 145 which is supplied with the output signal of the main path, and a second judging circuit 146 which is supplied with output signals of the first judging circuit 144 and the level detection circuit 145. Here, when each field comprises eight subfields, and the ratio of the number of sustain pulses among the respective subfield periods is set as SF1:SF2:SF3:SF4:SF5:SF6:SF7:SF8=12:8:4:2:1:4:8:12, for example, the main path 11 represents 52 real gray scale levels with a 6-bit output for each of the RGB signals; in this case, the number of reproducible gray scale levels for each color is 52 from level 0 to level 51.

In the image processing circuit shown in FIG. 3, rather than performing image motion detection and edge detection for each of the three RGB colors independently of each other, the RGB matrix circuit 141 generates a luminance signal from the RGB signals and, based on the generated luminance signal, the edge detection circuit 142 detects an edge of the image and the motion region detection circuit 143 detects a motion region in the image, thereby achieving a reduction in the amount of circuitry. The luminance signal Y can be generated using a generating equation such as Y=0.30R+0.59G+0.11B.

The highest luminance level that can be displayed on the PDP 4 via the main path 11 is 51 with a 6-bit output, while the highest luminance level of the input image signal is 255 with an 8-bit input. Accordingly, the gain control circuit 111 multiplies the input image signal with a gain coefficient $51\times2^{8-6}/255=204/255$. As a result of the multiplication with this gain coefficient, the error diffusion circuit 112 at the next stage can apply error diffusion over the entire range of the input image signal. The gain control circuit 111 can be constructed from a conventional multiplier or from a memory such as a RAM (Random Access Memory) or a ROM (Read Only Memory).

By applying error diffusion to the image signal obtained via the gain control circuit 111, the error diffusion circuit 112 simulates intermediate gray levels to increase the number of gray scale levels. Since the number of reproducible gray scale levels in the main path 11 is 52, the output bit count of the error diffusion circuit 112 is 6.

The sub path 12 represents 9 real gray scale levels with a 4-bit output; in this case, the number of reproducible gray scale levels for each of the RGB colors is 9 from level 0 to level 8.

The sub path 12 can represent gray scale in 9 steps from 0 to 8, but the amount of luminance does not increase equally, but increases unequally such as 0, 1, 3, 7, 11, and so on. As a result, a correction that is an inverse function of the display characteristic after the error diffusion must be applied to obtain a linear display characteristic as a whole. In the distortion correction circuit 121, such an inverse function characteristic is stored in a ROM or RAM table.

Figure 4:
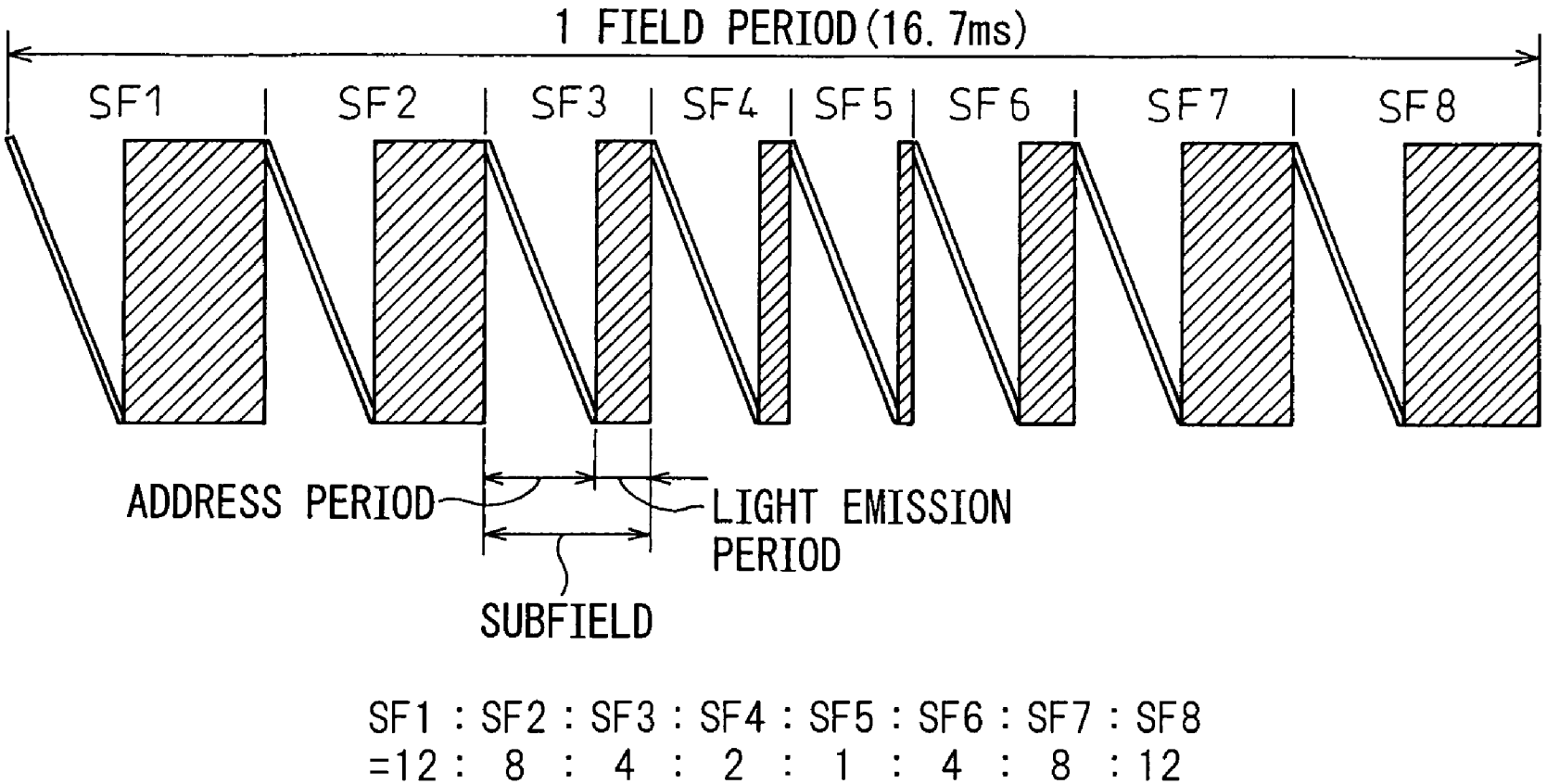
FIG. 4 is a diagram showing another example of the gray scale driving sequence in the plasma display apparatus.
Figure 5:
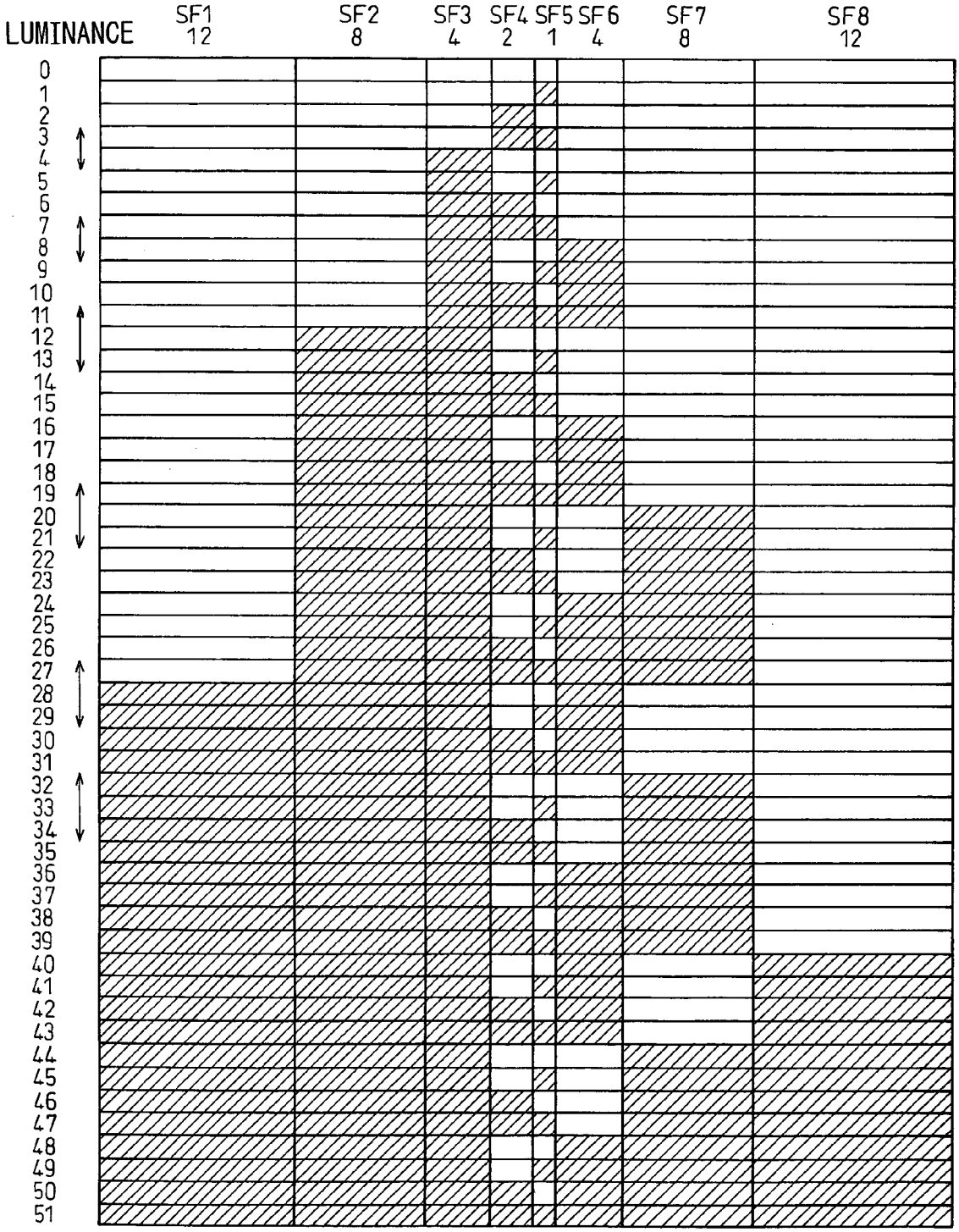
FIG. 5 is a diagram showing one example of an arrangement of light emission subfield periods for each luminance level in a main path.
Figure 6:
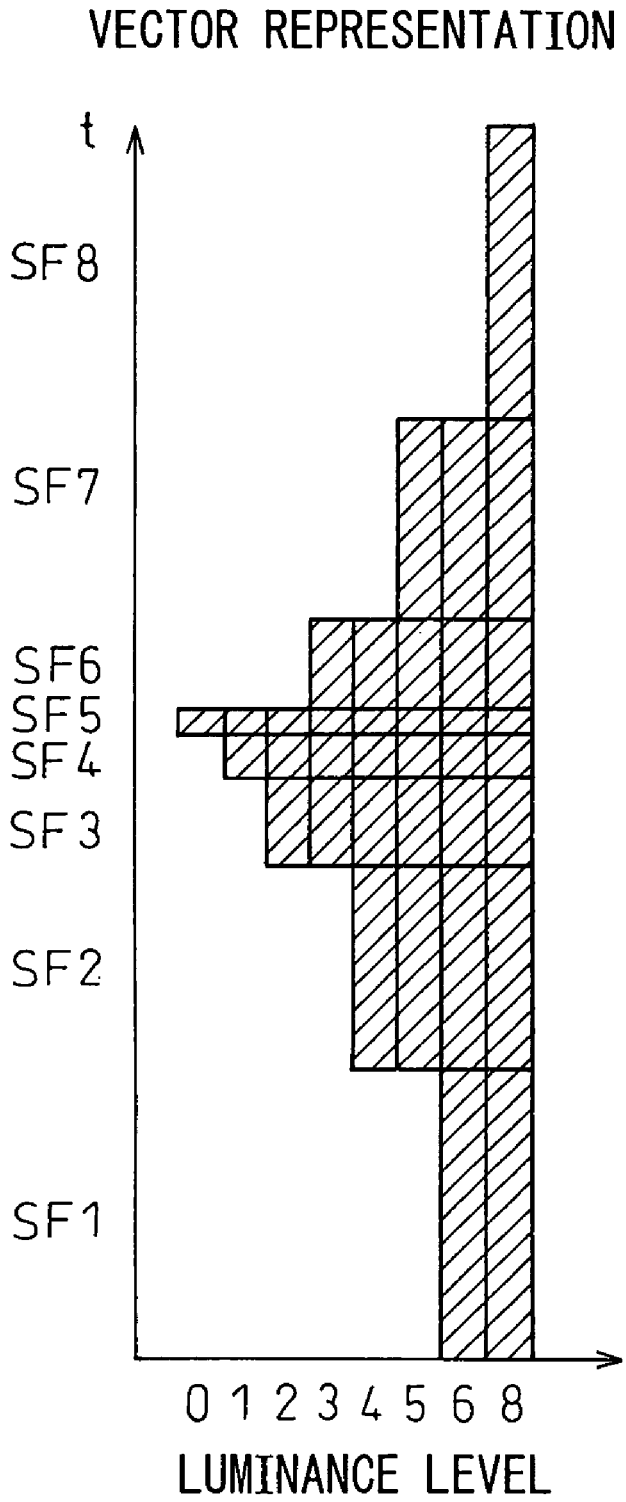
FIG. 6 is a diagram showing one example of an arrangement of light emission subfield periods for each luminance level in a sub path.

FIG. 4 is a diagram showing another example of the gray scale driving sequence in the plasma display apparatus, FIG. 5 is a diagram showing one example of an arrangement of light emission subfield periods for each luminance level in the main path, and FIG. 6 is a diagram showing one example of an arrangement of light emission subfield periods for each luminance level in the sub path.

When each field is made up of eight subfields SF1 to SF8, and the ratio of the number of sustain pulses (the luminance level ratio) is set as SF1:SF2:SF3:SF4:SF5:SF6:SF7:SF8=12:8:4:2:1:4:8:12, as described above, the gray scale driving sequence is as shown in FIG. 4.

In this case, the main path 11 can reproduce the input image signal in 52 real gray scale levels, and the arrangement of the light emission subfield periods for each luminance level is as shown by hatching in FIG. 5. On the other hand, the sub path 12 reproduces the input image signal in 9 real gray scale levels, and the arrangement of the light emission subfield periods for each luminance level is as shown in FIG. 6. The display characteristic of the input image signal, after processing through the sub path 12, is nonlinear; therefore, the inverse function correction for correcting the nonlinear characteristic and the error diffusion are applied to correct the nonlinear display characteristic to the linear display characteristic.

The highest luminance level that can be displayed on the PDP 4 via the sub path 12 is 8 with a 4-bit output, while the highest luminance level of the input image signal is 255 with an 8-bit input. Accordingly, the gain control circuit 122 multiplies the input image signal with a gain coefficient $8\times2^{8-4}/255=128/255$. As a result of the multiplication with this gain coefficient, the error diffusion circuit 123 at the next stage can apply error diffusion over the entire range of the input image signal. The gain control circuit 122 can be constructed from a conventional multiplier or from a RAM or a ROM.

By applying error diffusion to the image signal obtained via the gain control circuit 122, the error diffusion circuit 123 simulates intermediate gray levels to increase the number of gray scale levels. Since the number of reproducible gray scale levels in the sub path 12 is 9, the output bit count of the error diffusion circuit 123 is 4. The data matching circuit 124 is provided to match the luminance level in the sub path 12 to the luminance level in the main path 11.

Based on the path select/switch signal supplied from the image feature judging section 14, the switch circuit 13 switches the path to be used in accordance with the input image signal. Accordingly, for the RGB signals constituting the input image signals, the path switching is performed for each of the R, G, and B colors independently of each other. Therefore, even in the case of the RGB signals for the same pixel, there can occur cases where, for example, the R signal is processed through the main path 11 while the G and B signals are processed through the sub path 12.

Next, the operation of the image feature judging circuit 14 will be described. The image feature judging circuit 14 detects an image on which a moving image false contour is likely to occur, and generates and outputs the path select/switch signal for instructing the switch circuit 13 to switch the path so that pixel data forming such an image will be processed through the sub path 12.

As earlier described, the moving image false contour tends to occur at specific luminance levels, that is, at such luminance levels where the light emission subfield period greatly varies along the time axis even though the gray scale level changes only slightly. In view of this, the level detection circuit 145, based on the output of the error diffusion circuit 112 in the main path 11, supplies to the second judging circuit 146 a signal for controlling the sensitivity with which to switch the path to the sub path 12 by the path select/switch signal output from the first judging circuit 144. More specifically, for a luminance level where the moving image false contour is noticeable, the level detection circuit 145 outputs to the second judging circuit 146 a signal that increases the sensitivity with which to switch to the sub path 12; on the other hand, for a luminance level where the moving image false contour is inherently not easily detectable even when the image has a portion containing much motion, the level detection circuit 145 outputs a signal that reduces the sensitivity with which to switch to the sub path 12.

The reason that the level detection circuit 145 detects the luminance level by using the output image data from the main path 11 is that the luminance level where the moving image false contour is noticeable is substantially determined by the arrangement of the light emission subfield periods in the main path 11. In a portion rich in high-frequency components within an image, that is, in an edge portion, the difference between fields is detected even in an area where there is only a small amount of motion and, as a result, the amount of motion is detected larger than necessary. In view of this, the edge detection circuit 142 detects an edge portion within the image based on the input image signal, and supplies the result to the first judging circuit 144. Then, the first judging circuit 144 normalizes the amount of motion, that is, the degree of motion, by dividing the difference by the edge component. As a result, the amount of motion in the edge portion is reduced, and the first judging circuit 144 generates and outputs the path select/switch signal so that the edge portion will not be processed through the main path 11.

Furthermore, since the moving image false contour becomes noticeable in a portion where gray scale changes smoothly or mildly, the false contour is not easily detectable in a portion rich in high-frequency components within an image. This characteristic is also an important factor to be considered when making a decision for the path switching; therefore, based on the input image signal, the edge detection circuit 142 outputs to the first judging circuit 144 a signal for controlling the sensitivity with which the path is switched to the sub path 12 by the path select/switch signal output from the second judging circuit 146. More specifically, the sensitivity with which to switch the path to the sub path 12 is controlled so that low-frequency regions where gray scale changes smoothly can be easily processed through the sub path 12, in other words, edge portions can be easily processed through the main path 11.

The motion region detection circuit 143 detects a region containing motion within the image based on the smallest value of the difference from the image one field back and the difference from the image two fields back obtained from the luminance signal, and supplies the result of the detection to the first judging circuit 144. Further, the edge detection circuit 142 calculates a horizontal edge (horizontal line) and a vertical edge (vertical line) from the luminance signal, and obtains the amount of edge by mixing these edges. The amount of edge thus obtained is supplied to the first judging circuit 144. Therefore, based on the output information from the motion region detection circuit 143 and the edge detection circuit 142, the first judging circuit 144 judges pixels that tend to cause a moving image false contour, and supplies the result of the judgment to the second judging circuit 145.

The level detection circuit 145 detects the luminance level based on a corresponding one of the RGB signals that has been output from the main path 11. The luminance level detected by the level detection circuit 145 is supplied to the second judging circuit 146. Therefore, based on the result of the judgment from the first judging circuit 144 and the luminance level detected by the level detection circuit 145, the second judging circuit 146 generates the path select/switch signal for causing the path to be switched so that pixel data greater than a prescribed level will be processed through the sub path 12, and supplies the thus generated signal to the switch circuit 13. The level detection circuit 145 and the second judging circuit 146 together constitute a level judging section.

In this way, the path is automatically switched so that normally the input image signal is processed through the main path 11 which ensures an adequate number of gray scale levels, and so that the input image signal is processed through the sub path 12 only for pixel data that tends to cause a moving image false contour. Therefore, normally the input image signal is processed through the main path 11 which provides an extremely good S/N ratio and ensures a sufficient number of real gray scale levels for the PDP, and the processed image is presented for display on the PDP 4; on the other hand, for an image portion where a moving image false contour is highly likely to occur, the image signal is processed through the sub path 12 which has a very high capability to eliminate the moving image false contour though the S/N ratio somewhat drops, and the processed image is presented for display on the PDP 4. In this case, since the light emission subfield periods in the main path 11 and the light emission subfield periods in the sub path 12 have a close relationship to each other, the path switching portion (boundary) is hardly noticeable.

Figure 7:
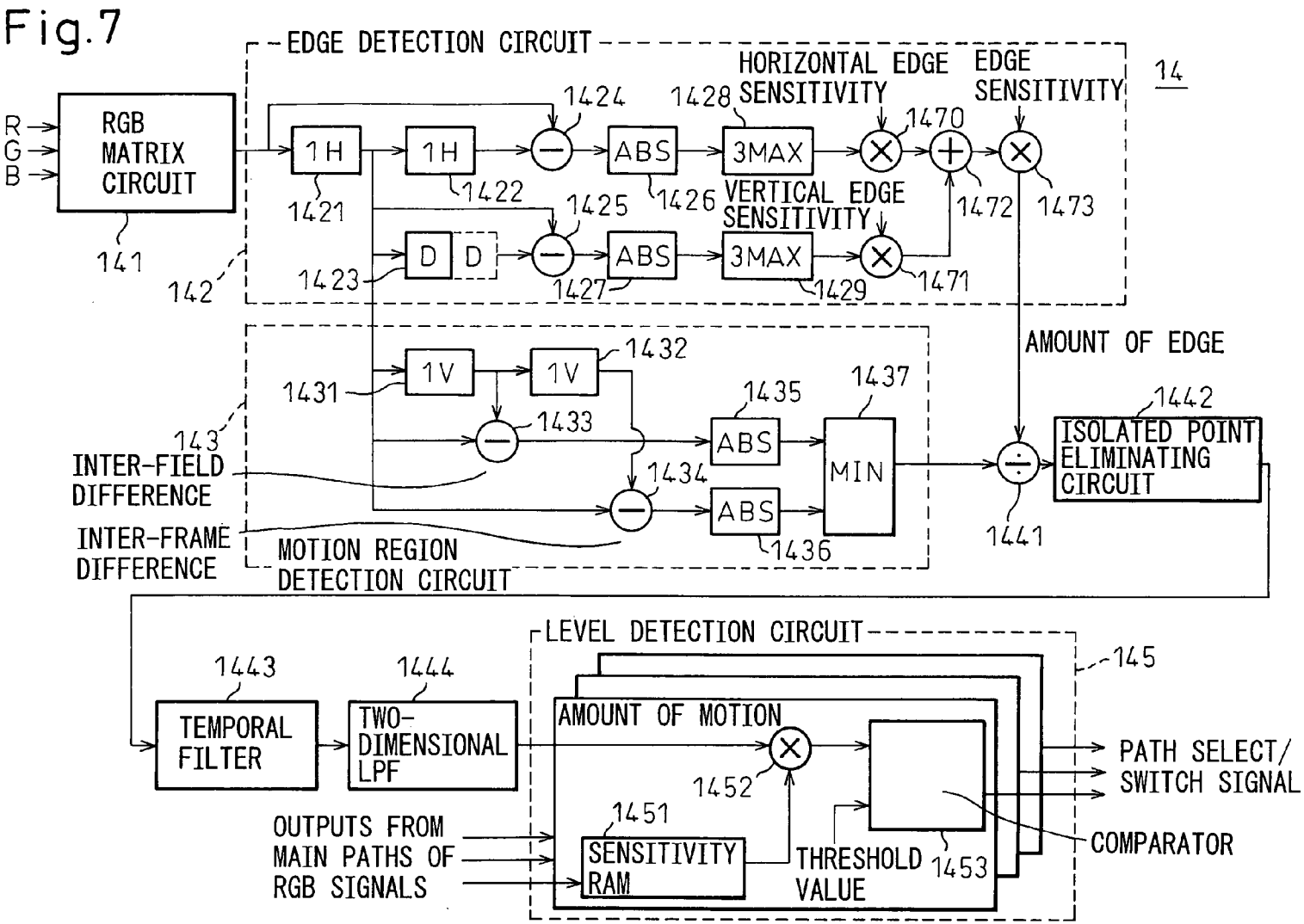
FIG. 7 is a block diagram showing one example of an image feature judging section in the image processing circuit of FIG. 3.

FIG. 7 is a block diagram showing one example of the image feature judging section in the image processing circuit of FIG. 3.

As shown in FIG. 7, the edge detection circuit 142 comprises 1H delay circuits 1421 and 1422, a delay circuit 1423, subtraction circuits 1424 and 1425, absolute value circuits 1426 and 1427, maximum value detection circuits 1428 and 1429, multiplication circuits 1470, 1471, and 1473, and an addition circuit 1472. The motion region detection circuit 143 comprises 1V delay circuits 1431 and 1432, subtraction circuits 1433 and 1434, absolute value circuits 1435 and 1436, and a minimum value detection circuit 1437. Here, 1H indicates one horizontal scan period of the input image signal, and 1V indicates one vertical scan period of the input image signal.

The first judging circuit 144 comprises a division circuit 1441, on the output side of which are connected an isolated point eliminating circuit 1442, a temporal filter 1443, and a two-dimensional low-pass filter (LPF) 1444. The level detection circuit 145 comprises a sensitivity RAM 1451, a multiplication circuit 1452, and a comparator 1453.

In the edge detection circuit 142, the subtraction circuit 1424 obtains the difference between the current input luminance signal Y and the input luminance signal Y two H's back, and the absolute value circuit 1426 obtains the absolute value of the difference fed from the subtraction circuit 1424. Of the absolute values obtained by the absolute value circuit 1426, the maximum value detection circuit 1428 detects, for example, the three largest absolute values and outputs them to the multiplication circuit 1470. The multiplication circuit 1470 is supplied with a coefficient that determines the sensitivity with which to detect a horizontal edge extending in a horizontal direction, and the output of the multiplication circuit 1470 is supplied to the addition circuit 1472.

The delay circuit 1423 delays the input luminance signal Y on a pixel-by-pixel basis (D), and the subtraction circuit 1425 obtains the difference between pixels of the input image signal. The absolute value circuit 1427 obtains the absolute value of the difference fed from the subtraction circuit 1425 and, of the absolute values obtained by the absolute value circuit 1427, the maximum value detection circuit 1429 detects, for example, the three largest absolute values and outputs them to the multiplication circuit 1471. The multiplication circuit 1471 is supplied with a coefficient that determines the sensitivity with which to detect a vertical edge extending in a vertical direction, and the output of the multiplication circuit 1471 is supplied to the addition circuit 1472. The output of the addition circuit 1472 is supplied to the multiplication circuit 1473 where it is multiplied with a coefficient that determines the edge sensitivity as a whole. The multiplication circuit 1473 thus outputs a signal indicating the amount of edge, which is supplied to the division circuit 1441.

In the motion region detection circuit 143, the subtraction circuit 1433 obtains the difference of the input luminance signal Y between two adjacent field periods and supplies it to the absolute value circuit 1435, while the subtraction circuit 1434 obtains the difference of the input luminance signal Y between two adjacent frame periods and supplies it to the absolute value circuit 1436. Therefore, the absolute value circuit 1435 obtains the absolute value of the difference between the input luminance signal Y in the current field period and the input luminance signal Y one field period back, and supplies it to the minimum value detection circuit 1437.

The absolute value circuit 1436 obtains the absolute value of the difference between the input luminance signal Y in the current field period and the input luminance signal Y two field periods back, and supplies it to the minimum value detection circuit 1437 which, of the absolute values supplied from the absolute value circuits 1435 and 1436, supplies the smallest value to the division circuit 1441 as a signal indicating the amount of motion. When non-interlaced scanning is employed, a difference may be detected between an odd-numbered field period and the even-numbered field period that follows, even when actually there is no motion in the image. Therefore, the difference is obtained between the input luminance signal Y in the current field period and the input luminance signal Y two field periods back as well as the difference between the input luminance signal Y in the current field period and the input luminance signal Y one field period back, and the amount of motion is obtained from the smallest value of their absolute values.

The absolute value of the difference obtained from each of the absolute value circuits 1435 and 1436 is, for example, in units of levels/field, and the amount of motion obtained from the minimum value detection circuit 1437 is, for example, in units of dots/field. Here, the amount of motion is expressed as Amount of Motion (dots/field)={(|difference (minimum value)(levels/field)|)}+{|slope (levels/dot)|}.

The division circuit 1441 normalizes the degree of motion in the image, i.e., the amount of motion, by dividing the amount of motion obtained from the minimum value detection circuit 1437 by the amount of edge obtained from the multiplication circuit 1473. The amount of motion normalized by the division circuit 1441 is supplied to the multiplication circuit 1452 in the level detection circuit 145 via the isolated point eliminating circuit 1442, the temporal filter 1443, and the two-dimensional LPF 1444.

The isolated point eliminating circuit 1442 is provided to eliminate isolated image data such as noise. For example, if, in a given region within the image, only one pixel is in motion while its surrounding pixels do not exhibit any motion, that one pixel can be regarded as noise, and in such cases, the isolated point is eliminated by the isolated point eliminating circuit 1442. More specifically, the amount of motion of each pixel in each line is compared with a threshold value, and any pixel whose amount of motion is smaller than the threshold value can be eliminated as an isolated point by regarding it as a non-moving pixel.

The temporal filter 1443 is provided to correct the falling of the level of motion-exhibiting pixel data so that the level falls mildly along the time axis. For example, when a particular pixel within the image, which is in motion, stops abruptly, its motion does not appear stopping immediately to the human eye because of the persistence of human vision, etc. even though that particular pixel has stopped when seen in terms of the image data. Therefore, the temporal filter 1443 corrects the falling of the level of the motion-exhibiting pixel data so that the level falls mildly along the time axis, thereby making the image displayed on the PDP 4 match the characteristics of human vision, thus reducing the unnaturalness of the image. In a specific method, the temporal filter 1443 obtains the maximum value from the amount of motion obtained from the isolated point eliminating circuit 1442 and the value read out of the memory described later, multiplies the maximum value with a coefficient smaller than 1, and stores the result in the memory. The obtained maximum value is output from the temporal filter 1443 and fed to the two-dimensional LPF 1444. That is, since the amount of motion stored in the memory decreases little by little, the amount of motion being output from the temporal filter 1443 decreases mildly even when the actual amount of motion has dropped to zero.

The two-dimensional LPF 1444 corrects data of one pixel based on the data of its surrounding pixels, and thereby averages the pixel data within a certain range to prevent only one pixel from showing a level extremely different from the levels of its surrounding pixels. That is, the two-dimensional LPF 1444 corrects the amount of motion in two-dimensional space. The two-dimensional LPF 1444 having such a function is well known in the art.

The level detection circuit 145 comprises three detection circuit sections one for each of the RGB signals, each section comprising the sensitivity RAM 1451, multiplication circuit 1452, and comparator 1453. For example, the output of the main path 11 for the R signal is supplied to the sensitivity RAM 1451 in the detection circuit section for the R signal, and the amount of motion supplied from the two-dimensional LPF 1444 is multiplied in the multiplication circuit 1452 by the coefficient read out of the sensitivity RAM 1451. The amount of motion thus multiplied is supplied to the comparator 1453. The comparator 1453 compares the amount of motion supplied from the multiplication circuit 1452 with a threshold value; if the amount of motion supplied from the multiplication circuit 1452 is larger than the threshold value, the comparator 1453 outputs a path select/switch signal for switching the R signal path to the sub path 12. In like manner, the detection circuit sections for the G and B signals each output a path select/switch signal for switching the G or B signal path based on the output of the main path 11 for the G or B signal, respectively.

Therefore, in each of the RGB processing systems, normally the input image signal (corresponding one of the RGB signals) is processed through the main path that ensures a relatively large number of gray scale levels, but pixel data that tends to cause a moving image false contour is processed through the sub path 12 by automatically switching the path to the sub path 12. In principle, the S/N ratio of the image displayed based on the image data processed through the sub path 12 is somewhat inferior to that of the image displayed based on the image data processed through the main path 11, but since the image displayed based on the image data processed through the sub path 12 represents a moving image portion, the degradation of the S/N ratio is hardly noticeable to the human eye and, therefore, does present any problem in practice. In this case, the calculation parameters used in the main path 11 and the sub path 12 are set so that the degradation of the S/N ratio caused by processing the data through the sub path 12 will not become noticeable to the human eye. Here, as a matter of course, the calculation parameters used in the main path 11 and the sub path 12 need to be re-set to optimum parameters each time the driving sequence for the PDP 4 or the subfield structure for the PDP 4 is changed.

In the prior art, there is also proposed, in JPP'649, a display apparatus and a display driving method in which, by using an error diffusion technique, the maximum gray scale level and the number of reproducible gray scale levels are made sufficiently large without increasing the number of subfields, while at the same time achieving enhancement in the reproducibility of low gray scale levels.

In the prior art, various display driving techniques for reducing the moving image false contour have been proposed as described above. Specifically, the image processing circuit in the prior art plasma display apparatus shown in FIG. 3 (for example, JPP'455), for example, provides an excellent technique in that it can completely suppress the occurrence of a moving image false contour, but there has been the problem that the image region processed through the sub path contains noise due to error diffusion, that is, the image region appears like noise due to the reduced number of gray scale levels. In particular, when the number of gray scale levels in the main path is made large, the number of gray scale levels where a moving image false contour tends to occur increases, resulting in an increase in the number of image regions to be switched to the moving path, and hence an increase in noise, causing a degradation of picture quality.

The prior art also proposes a technique for reducing the degradation of picture quality caused when the number of gray scale levels in the main path is made large (for example, JPP'101), but it has technically been difficult to detect a color space that cannot be recognized by human vision.

There is also proposed in the prior art a display apparatus and a display driving method in which the number of gray scales is increased by error diffusion (for example, JPP'649), but this increases the amount and cost of hardware since the gray scale conversion table requires the provision of a memory.

An object of the present invention to provide a display apparatus and a display driving method that can effectively eliminate the occurrence of a moving image false contour without incurring a substantial increase in cost.

According to the present invention, the weight of each subfield is set small in the subfield arrangement in the main path so that a moving image false contour does not easily occur, and provisions are made to prevent a situation where, of the subfields to be set for light emission when displaying gray scale, the most heavily weighted subfield alone is set for light emission.

In this case, the total number of gray scale levels decreases since the weight of each field is set small, but according to the present invention, a first subfield arrangement setting unit, a second subfield arrangement setting unit, and a sub gain control circuit work together to increase the apparent number of gray scale levels. More specifically, gray scale levels that cannot be reproduced by combining the plurality of subfields are simulated by applying error diffusion between the gray scale levels that can be reproduced by combining the plurality of subfields. Furthermore, since the number of gray scale levels is increased by performing computations in the sub gain control circuit, the present invention eliminates the need for a gray scale conversion table and the memory capacity can be reduced.

As a result, moving image false contours do not easily occur at most of the gray scale levels generated in the main path, and the path is switched to the sub path only for the remaining gray scale levels where a moving image false contour is likely to occur. This serves to greatly reduce the noise that occurs due to error diffusion in the sub path.

Below, embodiments of a display apparatus and a display driving method according to the present invention will be described in detail with reference to the drawings.

Figure 8:
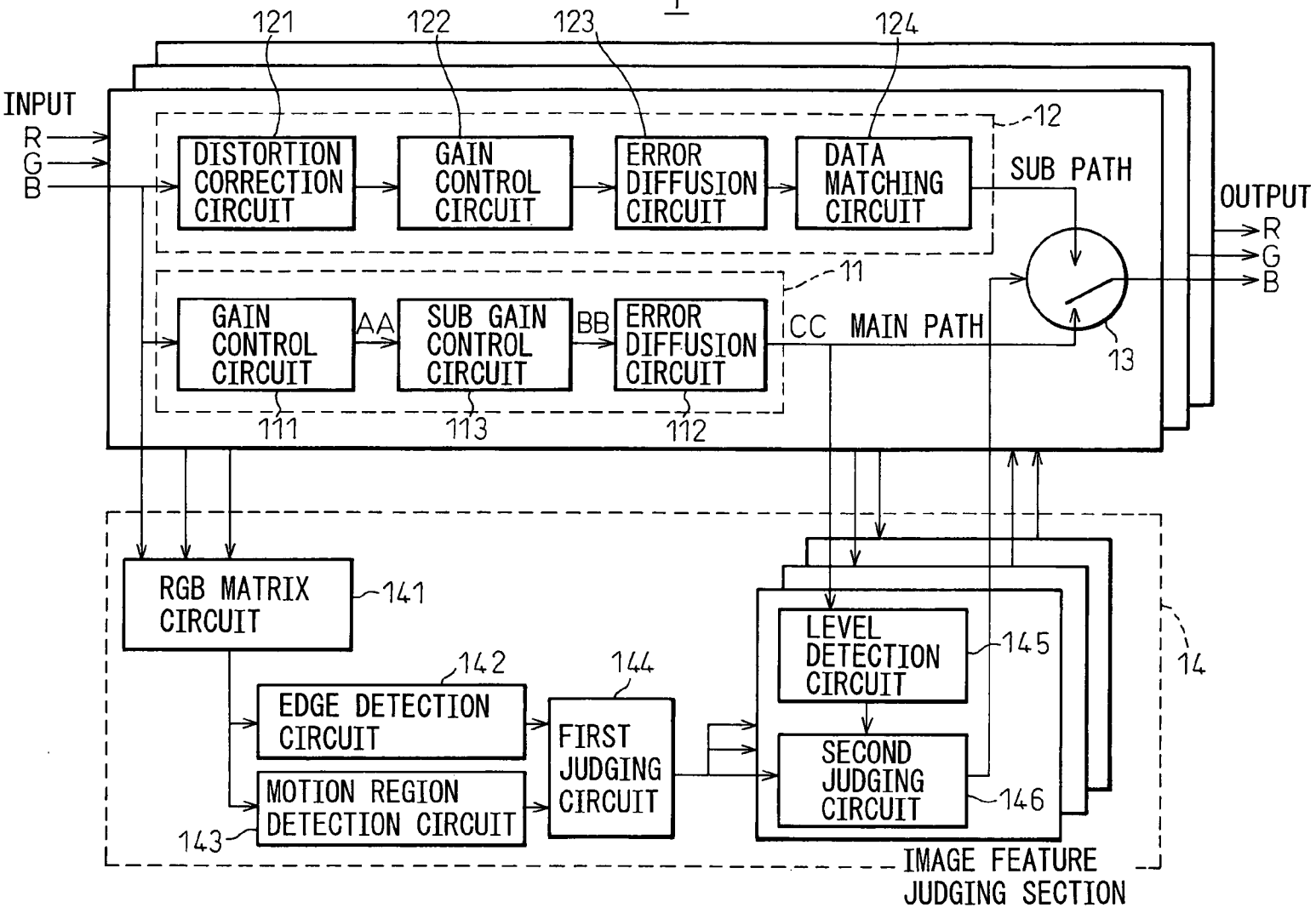
FIG. 8 is a block diagram showing one example of an image processing circuit in a plasma display apparatus according to the present invention.

FIG. 8 is a block diagram showing one example of an image processing circuit in the plasma display apparatus according to the present invention, which is applied, for example, as the image processing circuit 1 in the plasma display apparatus previously shown in FIG. 1. In FIG. 8, reference numeral 1 is the image processing circuit, 11 is a main path, 12 is a sub path, 13 is a switch circuit, and 14 is an image feature judging section. Further, reference numeral 111 is a gain control circuit, 112 is an error diffusion circuit, 113 is a sub gain control circuit, 121 is a distortion correction circuit, 122 is a gain control circuit, 123 is an error diffusion circuit, and 124 is a data matching circuit. On the other hand, reference numeral 141 is an RGB matrix circuit, 142 is an edge detection circuit, 143 is a motion region detection circuit, 144 is a first judging circuit, 145 is a level detection circuit, and 146 is a second judging circuit.

As is apparent from a comparison between FIG. 8 and the previously shown FIG. 3, the image processing circuit in the plasma display apparatus according to the present invention shown in FIG. 8 differs from the prior art image processing circuit 1 shown in FIG. 3 by the inclusion of the sub gain control circuit 113 which is inserted between the gain control circuit 111 and the error diffusion circuit 112 in the main path 11. The effect, etc. of providing the sub gain control circuit 113 in addition to the gain control circuit 111 in the present invention will be described in detail later with reference to FIGS. 50 to 60.

Figure 50A:
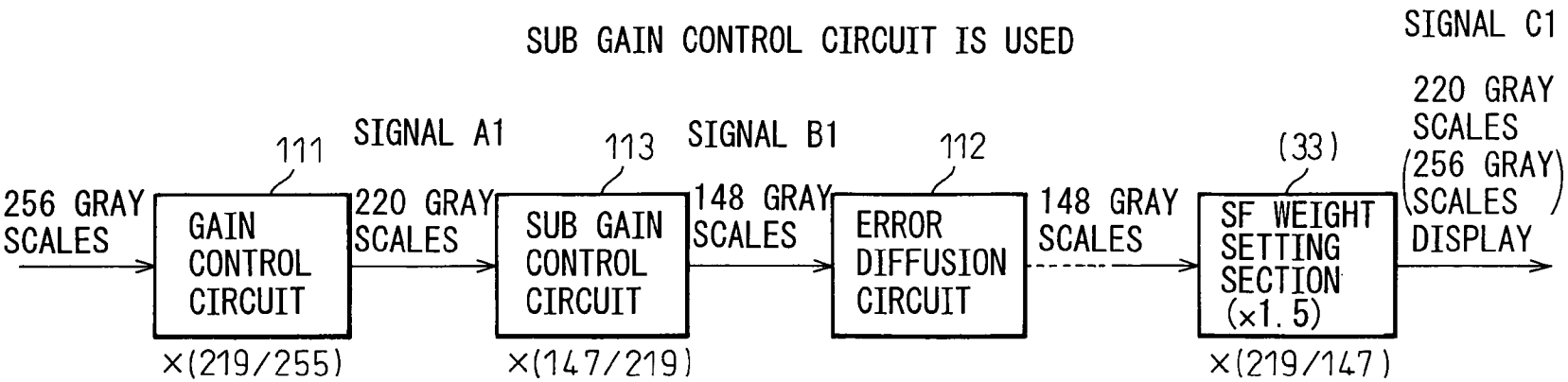
FIGS. 50A and 50B are block diagrams of essential portions, showing a comparison between the configuration in which the sub gain control circuit is used and the configuration in which the sub gain control circuit is not used in the plasma display apparatus.

As shown in FIGS. 8 and 50A, in the main path 11, an input image signal, for example, with 256 gray scale levels, is supplied to the gain control circuit 111 where it is multiplied by 219/255, and a signal (first intermediate image signal) AA with 220 gray scale levels is output from the gain control circuit 111. The first intermediate image signal AA with 220 gray scale levels is supplied to the sub gain control circuit 113 where it is multiplied by 147/219, and a signal (second intermediate image signal) BB with 148 gray scale levels is output from the sub gain control circuit 113. Further, the second intermediate image signal BB with 148 gray scale levels is supplied to the error diffusion circuit 112, and a signal (first image signal: output signal of the main path 11) CC with 148 gray scale levels is output from the error diffusion circuit 112. In the image processing circuit of the plasma display apparatus shown in FIG. 8, the sub path 12, the switch circuit 13, and the image feature judging section 14 are essentially the same in configuration as those previously shown in FIG. 3, and the description thereof will not be repeated here. Further, in the image processing circuit of the plasma display apparatus shown in FIG. 8, the image feature judging section 14 is the same as the image feature judging section described with reference to FIGS. 3 and 7, and the description thereof will also be omitted here.

FIGS. 9 to 12 are diagrams showing one example of a subfield light emission table which is applied to the plasma display apparatus according to the present invention and used when producing a gray scale display in the main path. FIG. 13 is a diagram showing one example of a subfield light emission table for the sub path, which is applied to the plasma display apparatus according to the present invention, and which corresponds to the subfield light emission table for the main path shown in FIGS. 9 to 12.

In the subfield light emission table shown in FIGS. 9 to 12, the weights between the subfields (SFs) are set small and, in addition, of the subfields to be set for light emission when displaying an arbitrary gray scale level except low gray scale levels, the most heavily weighted subfield is prohibited from being set for light emission independently of the others.

More specifically, as shown in FIGS. 9 to 12, the weights of SF1 to SF10 are set in the ratio of SF1:SF2:SF3:SF4:SF5:SF6:SF7:SF8:SF9:SF10=1:2:4:8:12:16:20:24:28:32, that is, the weights between the SFs are set small. In addition, except at low gray scale levels (gray scale levels: 1, 2, 4, 8), the most heavily weighted subfield will not be set for light emission independently of the others in the case of gray scale levels (gray scale levels: 16, 28, 44, 64, 88, 116) where the next SF is set for light emission.

As a result, moving image false contours do not easily occur at most gray scale levels, but at some gray scale levels, the moving image false contour does occur. Therefore, for such gray scale levels, the path is switched from the main path to the sub path to completely eliminate the occurrence of the moving image false contour.

That is, as shown in FIG. 13, for gray scale levels where the moving image false contour is likely to occur (for example, gray scale levels: 2, 4, 8, 16, 28, 44, 64, 88, 116, 148), the path is switched from the main path 11 to the sub path 12 to completely eliminate the occurrence of the moving image false contour. The subfield light emission table shown in FIGS. 9 to 12 is applied to the main path 11 in the image processing circuit shown in FIG. 8, and can also be used by switching to the sub path 12 for the above-listed specific grayscale levels, but even when this subfield light emission table is applied to an image processing circuit that does not have a sub path, and all the gray scale levels are displayed in accordance with the combinations shown in the subfield light emission table of FIGS. 9 to 12, the moving image false contour can be greatly reduced compared with the prior art driving method (for example, SF1:SF2:SF3:SF4:SF5:SF6=1:2:4:8:16:32).

FIGS. 14 to 17 are diagrams showing another example of the subfield light emission table which is applied to the plasma display apparatus according to the present invention and used when producing a gray scale display in the main path. FIG. 18 is a diagram showing one example of the subfield light emission table for the sub path, which is applied to the plasma display apparatus according to the present invention, and which corresponds to the subfield light emission table for the main path shown in FIGS. 14 to 17. As is apparent from a comparison between FIGS. 14 to 17 and FIGS. 9 to 12, in the subfield light emission table shown in FIGS. 14 to 17 the weights are assigned to SF1 to SF10 in the reverse order from those assigned in the subfield light emission table shown in FIGS. 9 to 12 (that is, SF1:SF2:SF3:SF4:SF5:SF6:SF7:SF8:SF9:SF10=32:28:24:20:16:12:8:4:2:1).

In the subfield light emission table shown in FIGS. 14 to 17 also, the weights between the subfields (SFs) are set small and, in addition, of the subfields to be set for light emission when displaying an arbitrary gray scale level except low gray scale levels (gray scale levels: 1, 2, 4, 8), the most heavily weighted subfield is prohibited from being set for light emission independently of the others. As a result, moving image false contours do not easily occur at most gray scale levels, but at some gray scale levels, the moving image false contour does occur. Therefore, by switching the path from the main path to the sub path for such gray scale levels (for example, gray scale levels: 2, 4, 8, 16, 28, 44, 64, 88, 116, 148), the occurrence of the moving image false contour can be completely eliminated.

Figure 19:
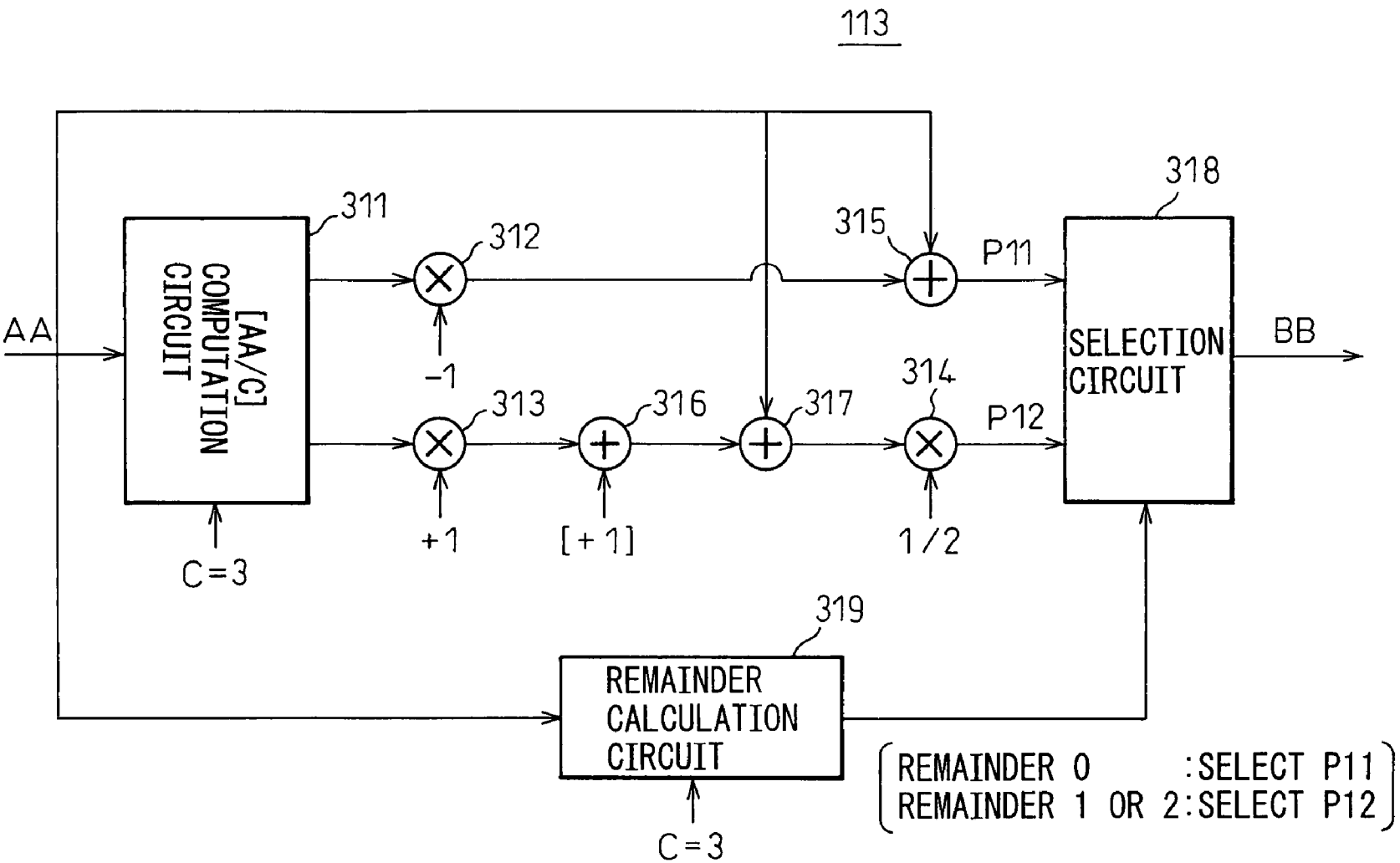
FIG. 19 is a block diagram schematically showing a sub gain control circuit in a first embodiment of the plasma display apparatus according to the present invention.
Figure 20:
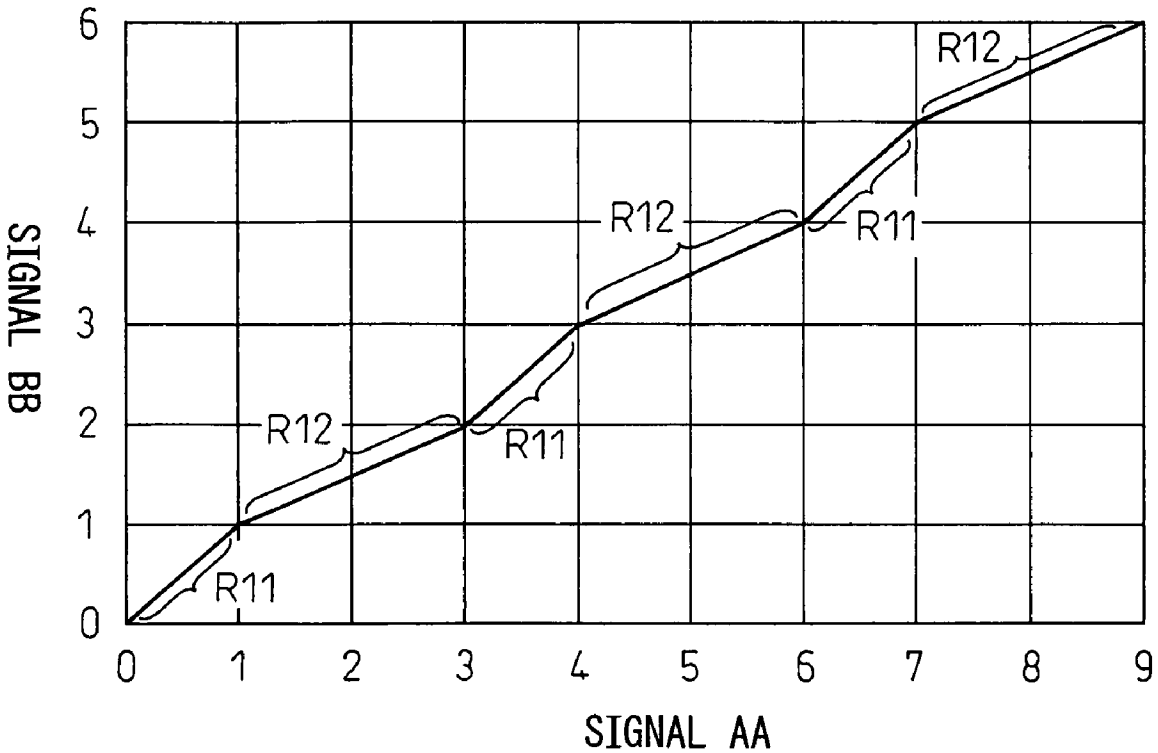
FIG. 20 is a diagram for explaining the sub gain control circuit shown in FIG. 19.

FIG. 19 is a block diagram schematically showing a sub gain control circuit in a first embodiment of the plasma display apparatus according to the present invention, and FIG. 20 is a diagram for explaining the sub gain control circuit shown in FIG. 19. The following description assumes the use of the main path subfield light emission table shown in FIGS. 9 to 12 and the sub path subfield light emission table shown in FIG. 13.

The sub gain control circuit shown in FIG. 19 performs computations that satisfy the relations shown in FIG. 20, and comprises a computation circuit 311, multiplication circuits 312 to 314, addition circuits 315 to 317, a selection circuit 318, and a remainder calculation circuit 319. The computation circuit 311 receives the input signal AA (the first intermediate image signal with 220 gray scale levels output from the gain control circuit 111), divides it by a coefficient C=3, and outputs the integer part. The result of the computation [AA/3] is supplied to the multiplication circuits 312 and 313.

The output signal of the computation circuit 311 is multiplied by "−1" in the multiplication circuit 312, and the output signal of the multiplication circuit 312 is summed with the input signal AA in the addition circuit 315. As a result, BB=AA−[AA/3] is obtained from the path P11. On the other hand, the output signal of the computation circuit 311 supplied to the multiplication circuit 313 is multiplied by "+1", the output signal of the multiplication circuit 313 is summed with "+1" in the addition circuit 316, the output signal of the addition circuit 316 is summed with the input signal AA in the addition circuit 317, and the sum is multiplied by "½" in the multiplication circuit 314. As a result, BB=(AA+[AA/3]+1)/2 is obtained from the path P12.

The selection circuit 318 selects the output signal of the path P11 or the output signal of the path P12 in accordance with the output of the remainder calculation circuit 319; that is, when the remainder of AA/3 is zero (exactly divisible), the path P11 (the output signal of the addition circuit 315) is selected, while when the remainder of AA/3 is not zero (1 or 2, that is, not exactly divisible), the path P12 (the output signal of the multiplication circuit 314) is selected, and the thus selected signal is output as the second intermediate image signal BB.

In this way, the sub gain control circuit according to the first embodiment shown in FIG. 19 performs computations that satisfy the relations shown in FIG. 20; as shown in FIG. 20, in the first embodiment, the entire gray scale range is divided into two regions, region R11 and region R12, so that the ratio between the input signal AA and the output signal BB becomes approximately equal to ⅔.

In the region R11, the relation 3×K≦input signal AA<3×K+1 holds, and the mathematical equation between the input signal AA and the output signal BB is given as BB=AA−[AA/3]. On the other hand, in the region R12, the relation 3×K+1≦input signal AA<3×(K+1) holds, and the mathematical equation between the input signal AA and the output signal BB is given as BB=(AA+[AA/3]+1)/2.

Table 1 below shows the relationship between the subfields SF1 to SF10 and the weights, which is stored in the SF weight table 33 (see FIG. 1) according to the first embodiment; as shown, the weights are multiplied by 1.5 (3/2). That is, the gray scale (number of gray scale levels: 148) resulting from the multiplication by ⅔ in the sub gain control circuit of the first embodiment is converted back to the original gray scale (number of gray scale levels: 220) for display on the PDP 4.

TABLE 1

| | SF1 | SF2 | SF3 | SF4 | SF5 | SF6 | SF7 | SF8 | SF9 | SF10 |
|---|---|---|---|---|---|---|---|---|---|---|
| WEIGHT | 1 | 3 | 6 | 12 | 18 | 24 | 30 | 36 | 42 | 48 |

FIGS. 21 to 26 are diagrams for explaining the operation of the sub gain control circuit shown in FIG. 19, and illustrate how the input signal AA with 220 gray scale levels input to the sub gain control circuit 113 is output as the output signal BB with 147 gray scale levels by selecting the path P11 or the path 12 in accordance with the output of the remainder calculation circuit 319, and how the output signal BB is converted back to the image signal with 220 gray scale levels in accordance with the SF weight table 33.

Figure 27:
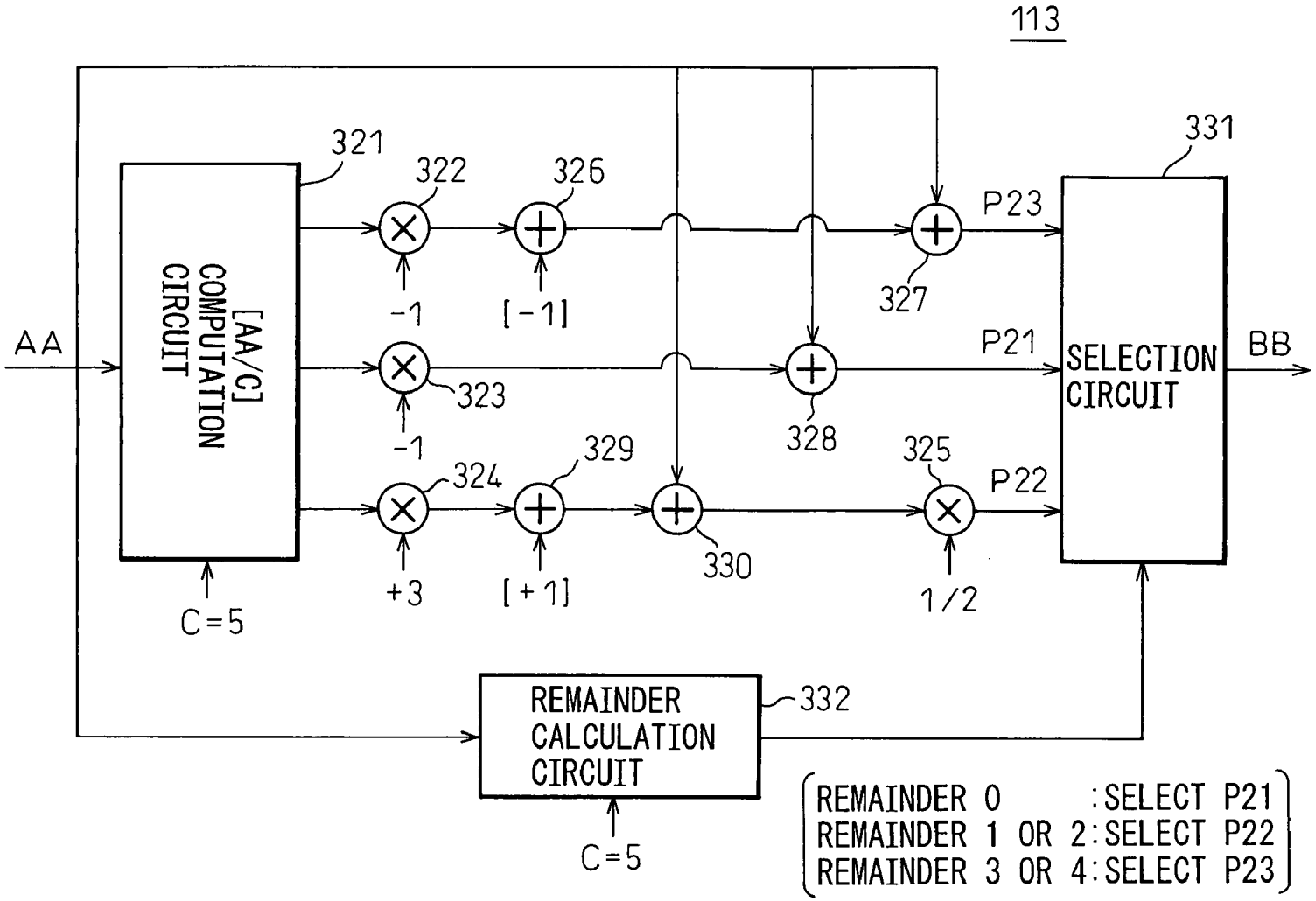
FIG. 27 is a block diagram schematically showing a sub gain control circuit in a second embodiment of the plasma display apparatus according to the present invention.
Figure 28:
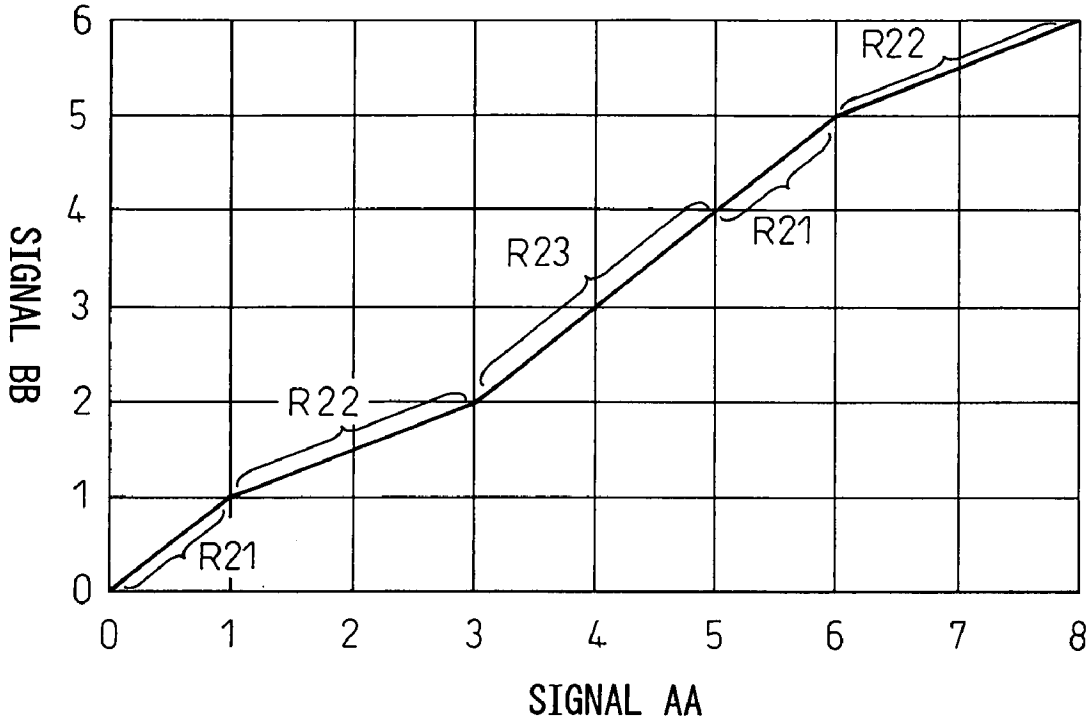
FIG. 28 is a diagram for explaining the sub gain control circuit shown in FIG. 27.

FIG. 27 is a block diagram schematically showing a sub gain control circuit in a second embodiment of the plasma display apparatus according to the present invention, and FIG. 28 is a diagram for explaining the sub gain control circuit shown in FIG. 27.

The sub gain control circuit shown in FIG. 27 performs computations that satisfy the relations shown in FIG. 28, and comprises a computation circuit 321, multiplication circuits 322 to 325, addition circuits 326 to 330, a selection circuit 331, and a remainder calculation circuit 332. The computation circuit 321 receives the input signal AA (the first intermediate image signal with 184 gray scale levels output from the gain control circuit 111), divides it by a coefficient C=5, and outputs the integer part. The result of the computation [AA/5] is supplied to the multiplication circuits 322, 323, and 324.

The output signal of the computation circuit 321 is multiplied by "−1" in the multiplication circuit 322, the resulting product is summed with "−1" in the addition circuit 326, and the output signal of the addition circuit 326 is summed with the input signal AA in the addition circuit 327. As a result, BB=AA−[AA/5]−1 is obtained from the path P23. On the other hand, the output signal of the computation circuit 321 supplied to the multiplication circuit 323 is multiplied by "−1", and the output signal of the multiplication circuit 323 is summed with the input signal AA in the addition circuit 328. As a result, BB=AA−[AA/5] is obtained from the path P21. Further, the output signal of the computation circuit 321 supplied to the multiplication circuit 324 is multiplied by "+3", the output signal of the multiplication circuit 324 is summed with "+1" in the addition circuit 329, the output signal of the addition circuit 329 is summed with the input signal AA in the addition circuit 330, and the sum is multiplied by "½" in the multiplication circuit 325. As a result, BB=(AA+[AA/5]×3+1)/2 is obtained from the path P22.

The selection circuit 331 selects the output signal of one of the paths P21 to P23 in accordance with the output of the remainder calculation circuit 332; that is, when the remainder of AA/5 is zero, the path P21 (the output signal of the addition circuit 328) is selected, and when the remainder of AA/5 is 1 or 2, the path P22 (the output signal of the multiplication circuit 325) is selected, while when the remainder of AA/5 is 3 or 4, the path P23 (the output signal of the addition circuit 327) is selected, and the thus selected signal is output as the second intermediate image signal BB.

In this way, the sub gain control circuit according to the second embodiment shown in FIG. 27 performs computations that satisfy the relations shown in FIG. 28; as shown in FIG. 28, in the second embodiment, the entire gray scale range is divided into three regions, region R21, region R22, and region R23, so that the ratio between the input signal AA and the output signal BB becomes approximately equal to ⅘.

In the region R21, the relation 5×K≦input signal AA<5×K+1 holds, and the mathematical equation between the input signal AA and the output signal BB is given as BB=AA-[AA/5]. On the other hand, in the region R22, the relation 5×K+1≦input signal AA<5×K+3 holds, and the mathematical equation between the input signal AA and the output signal BB is given as BB=(AA+[AA/5]×3+1)/2. Further, in the region R23, the relation 5×K+3≦input signal AA<5×(K+1) holds, and the mathematical equation between the input signal AA and the output signal BB is given as BB=AA−[AA/5]−1.

Table 2 below shows the relationship between the subfields SF1 to SF10 and the weights, which is stored in the SF weight table 33 according to the second embodiment; as shown, the weights are multiplied by 1.25 (5/4). That is, the gray scale (number of gray scale levels: 148) resulting from the multiplication by ⅘ in the sub gain control circuit of the second embodiment is converted back to the original gray scale (number of gray scale levels: 184) for display on the PDP 4.

TABLE 2

| | SF1 | SF2 | SF3 | SF4 | SF5 | SF6 | SF7 | SF8 | SF9 | SF10 |
|---|---|---|---|---|---|---|---|---|---|---|
| WEIGHT | 1 | 3 | 5 | 10 | 15 | 20 | 25 | 30 | 35 | 40 |

FIGS. 29 to 33 are diagrams for explaining the operation of the sub gain control circuit shown in FIG. 27, and illustrate how the input signal AA with 184 gray scale levels input to the sub gain control circuit 113 is output as the output signal BB with 148 gray scale levels by selecting one of the paths P21 to P23 in accordance with the output of the remainder calculation circuit 332, and how the output signal BB is converted back to the image signal with 184 gray scale levels in accordance with the SF weight table 33.

Figure 34:
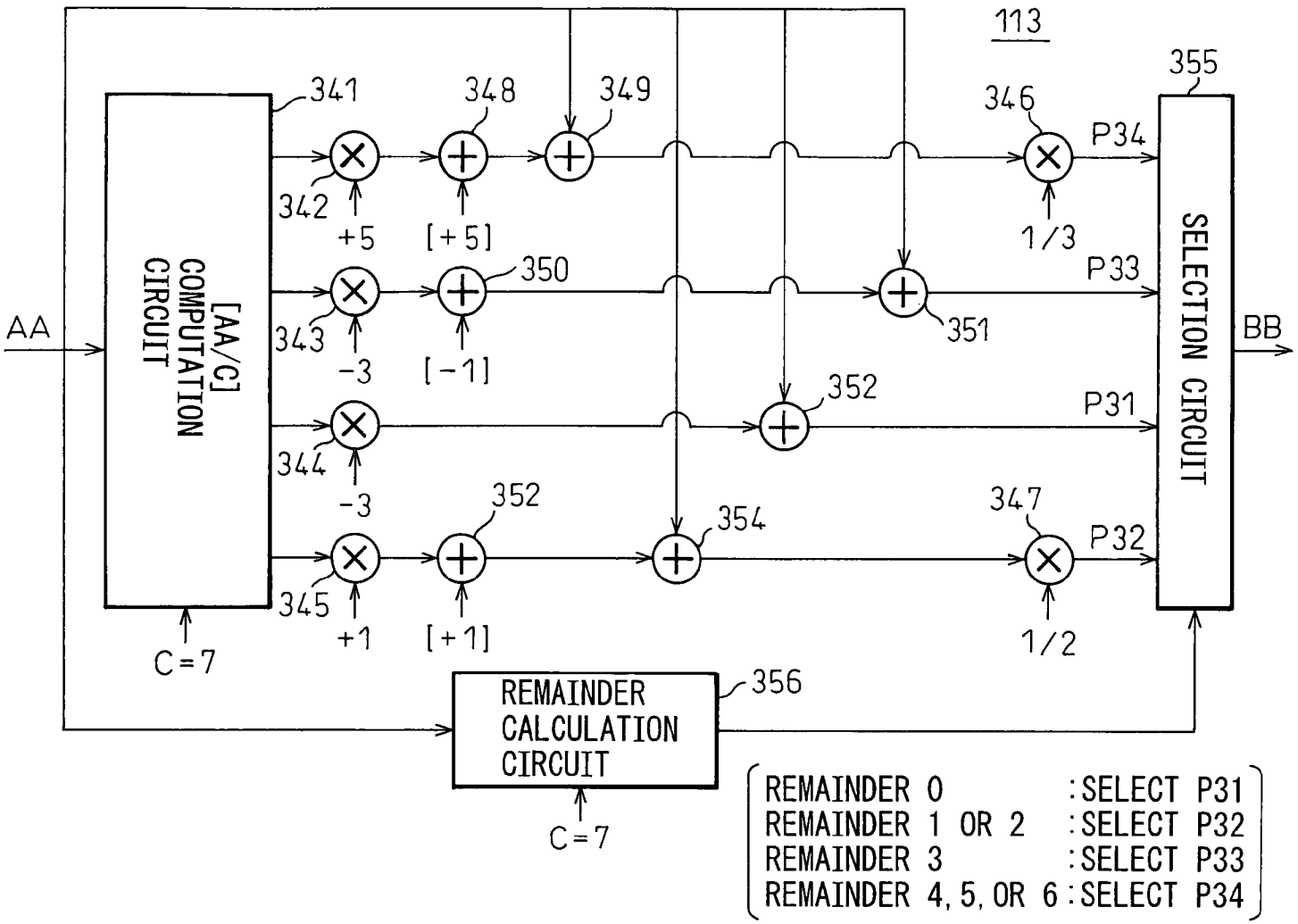
FIG. 34 is a block diagram schematically showing a sub gain control circuit in a third embodiment of the plasma display apparatus according to the present invention.

FIG. 34 is a block diagram schematically showing a sub gain control circuit in a third embodiment of the plasma display apparatus according to the present invention, and FIG. 35 is a diagram for explaining the sub gain control circuit shown in FIG. 34.

The sub gain control circuit shown in FIG. 34 performs computations that satisfy the relations shown in FIG. 35, and comprises a computation circuit 341, multiplication circuits 342 to 347, addition circuits 348 to 354, a selection circuit 355, and a remainder calculation circuit 356. The computation circuit 341 receives the input signal AA (the first intermediate image signal with 256 gray scale levels output from the gain control circuit 111), divides it by a coefficient C=7, and outputs the integer part. The result of the computation [AA/7] is supplied to the multiplication circuits 342, 343, 344, and 345.

The output signal of the computation circuit 341 is multiplied by "+5", in the multiplication circuit 342, the resulting product is summed with "+5", in the addition circuit 348, the output signal of the addition circuit 348 is summed with the input signal AA in the addition circuit 349, and the sum is multiplied by "⅓" in the multiplication circuit 346. As a result, BB=(AA+[AA/7]×5+5)/3 is obtained from the path P34. On the other hand, the output signal of the computation circuit 341 supplied to the multiplication circuit 343 is multiplied by "−3", the resulting product is summed with "−1" in the addition circuit 350, and the output signal of the addition circuit 350 is summed with the input signal AA in the addition circuit 351. As a result, BB=AA−[AA/7]×3−1 is obtained from the path P33.

Further, the output signal of the computation circuit 341 supplied to the multiplication circuit 344 is multiplied by "−3", and the output signal of the multiplication circuit 344 is summed with the input signal AA in the addition circuit 352. As a result, BB=AA−[AA/7]×3 is obtained from the path P31. On the other hand, the output signal of the computation circuit 341 supplied to the multiplication circuit 345 is multiplied by "+1", the resulting product is summed with "+1" in the addition circuit 353, the output signal of the addition circuit 353 is summed with the input signal AA in the addition circuit 354, and the sum is multiplied by "½" in the multiplication circuit 347. As a result, BB=(AA+[AA/7]+1)/2 is obtained from the path P32.

The selection circuit 355 selects the output signal of one of the paths P31 to P34 in accordance with the output of the remainder calculation circuit 356; that is, when the remainder of AA/7 is zero, the path P31 (the output signal of the addition circuit 352) is selected, and when the remainder of AA/7 is 1 or 2, the path P32 (the output signal of the multiplication circuit 347) is selected, while when the remainder of AA/7 is 3, the path P33 (the output signal of the addition circuit 351) is selected, and when the remainder of AA/7 is 4, 5, or 6, the path P34 (the output signal of the multiplication circuit 346) is selected, and the thus selected signal is output as the second intermediate image signal BB.

In this way, the sub gain control circuit according to the third embodiment shown in FIG. 34 performs computations that satisfy the relations shown in FIG. 35; as shown in FIG. 35, in the third embodiment, the entire gray scale range is divided into four regions, region R31, region R32, region R33, and region R34, so that the ratio between the input signal AA and the output signal BB becomes approximately equal to 4/7.

In the region R31, the relation 7×K≦input signal AA<7×K+1 holds, and the mathematical equation between the input signal AA and the output signal BB is given as BB=AA−[AA/7]×3. On the other hand, in the region R32, the relation 7×K+1≦input signal AA<7×K+3 holds, and the mathematical equation between the input signal AA and the output signal BB is given as BB=(AA+[AA/7]+1)/2. Further, in the region R33, the relation 7×K+3≦input signal AA<7×K+4 holds, and the mathematical equation between the input signal AA and the output signal BB is given as BB=AA−[AA/7]×3−1. In the region R34, the relation 7×K+4≦input signal AA<7×(K+1) holds, and the mathematical equation between the input signal AA and the output signal BB is given as BB=(AA+[AA/7]×5+5)/3.

Table 3 below shows the relationship between the subfields SF1 to SF10 and the weights, which is stored in the SF weight table 33 according to the third embodiment; as shown, the weights are multiplied by 1.75 (7/4). That is, the gray scale (number of gray scale levels: 148) resulting from the multiplication by 4/7 in the sub gain control circuit of the third embodiment is converted back to the original gray scale (number of gray scale levels: 256) for display on the PDP 4. Here, as shown in Tables 1 to 3, the weight of the first subfield SF1 is 1, while the weight of the second subfield SF2 is 3 (or not smaller than 3).

TABLE 3

| | SF1 | SF2 | SF3 | SF4 | SF5 | SF6 | SF7 | SF8 | SF9 | SF10 |
|---|---|---|---|---|---|---|---|---|---|---|
| WEIGHT | 1 | 3 | 7 | 14 | 21 | 28 | 35 | 42 | 49 | 56 |

FIGS. 36 to 42 are diagrams for explaining the operation of the sub gain control circuit shown in FIG. 34, and illustrate how the input signal AA with 256 gray scale levels input to the sub gain control circuit 113 is output as the output signal BB with 148 gray scale levels by selecting one of the paths P31 to P34 in accordance with the output of the remainder calculation circuit 356, and how the output signal BB is converted back to the image signal with 256 gray scale levels in accordance with the SF weight table 33.

Figure 43:
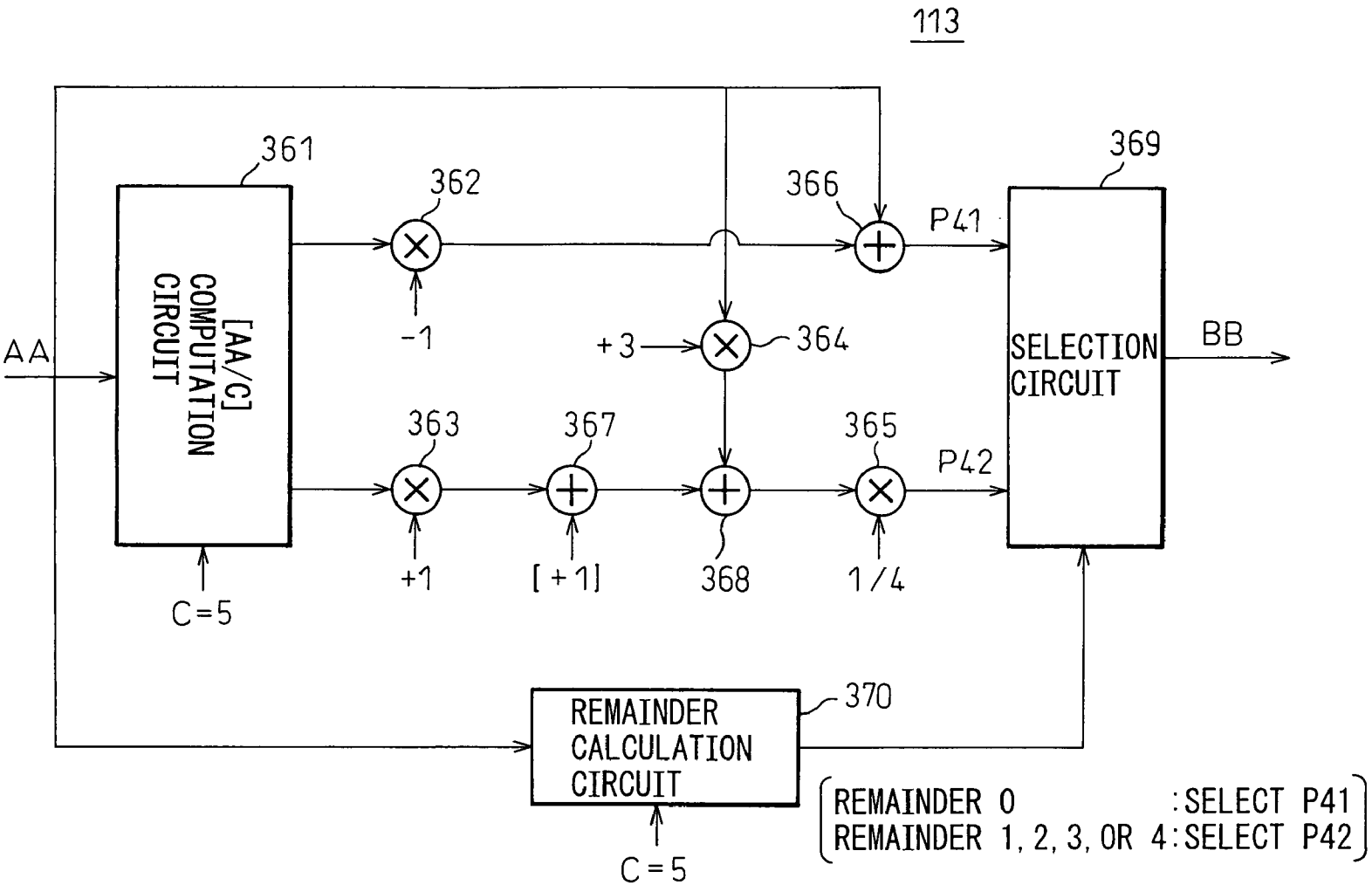
FIG. 43 is a block diagram schematically showing a sub gain control circuit in a fourth embodiment of the plasma display apparatus according to the present invention.
Figure 44:
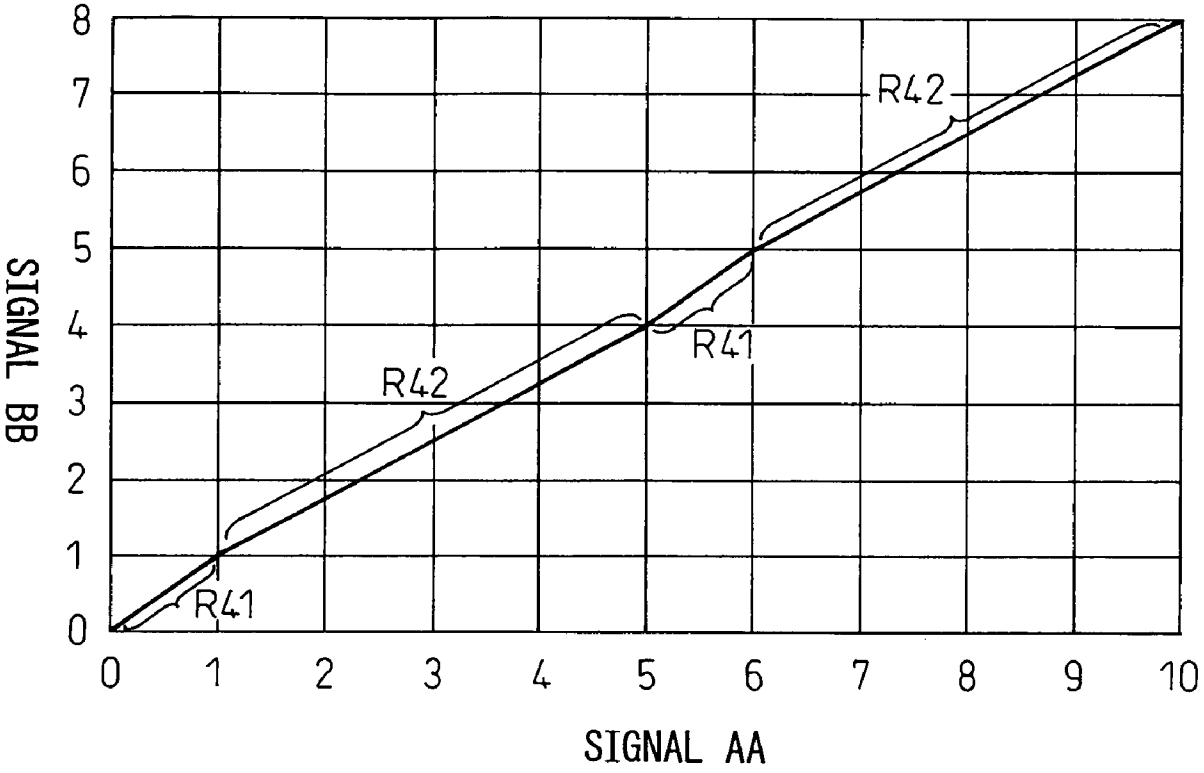
FIG. 44 is a diagram for explaining the sub gain control circuit shown in FIG. 43.

FIG. 43 is a block diagram schematically showing a sub gain control circuit in a fourth embodiment of the plasma display apparatus according to the present invention, and FIG. 44 is a diagram for explaining the sub gain control circuit shown in FIG. 43.

The sub gain control circuit shown in FIG. 43 performs computations that satisfy the relations shown in FIG. 44, and comprises a computation circuit 361, multiplication circuits 362 to 365, addition circuits 366 to 368, a selection circuit 369, and a remainder calculation circuit 370. The computation circuit 361 receives the input signal AA (the first intermediate image signal with 184 gray scale levels output from the gain control circuit 111), divides it by a coefficient C=5, and outputs the integer part. The result of the computation [AA/5] is supplied to the multiplication circuits 362 and 363.

The output signal of the computation circuit 361 is multiplied by "−1" in the multiplication circuit 362, and the output signal of the multiplication circuit 362 is summed with the input signal AA in the addition circuit 366. As a result, BB=AA−[AA/5] is obtained from the path P41. On the other hand, the output signal of the computation circuit 361 supplied to the multiplication circuit 363 is multiplied by "+1", the resulting product is summed with "+1" in the addition circuit 367, the output signal of the addition circuit 367 is summed with the input signal AA in the addition circuit 368, and the sum is multiplied by "¼" in the multiplication circuit 365. As a result, BB=(AA×3+[AA/5]+1)/4 is obtained from the path P42.

The selection circuit 369 selects the output signal of the path P41 or the output signal of the path P42 in accordance with the output of the remainder calculation circuit 370; that is, when the remainder of AA/5 is zero, the path P41 (the output signal of the addition circuit 366) is selected, while when the remainder of AA/5 is 1, 2, 3, or 4, the path P42 (the output signal of the multiplication circuit 365) is selected, and the thus selected signal is output as the second intermediate image signal BB.

In this way, the sub gain control circuit according to the fourth embodiment shown in FIG. 43 performs computations that satisfy the relations shown in FIG. 44; as shown in FIG. 44, in the fourth embodiment, the entire gray scale range is divided into two regions, region R41 and region R42, so that the ratio between the input signal AA and the output signal BB becomes approximately equal to ⅘.

In the region R41, the relation 5×K≦input signal AA<5×K+1 holds, and the mathematical equation between the input signal AA and the output signal BB is given as BB=AA−[AA/5]. On the other hand, in the region R42, the relation 5×K+1≦input signal AA<5×(K+1) holds, and the mathematical equation between the input signal AA and the output signal BB is given as BB=(AA×3+[AA/5]+1)/4.

In the fourth embodiment, the output signal BB to be generated in the region R42 is generated from a smaller number of gray scale levels than the number of gray scale levels of the input signal AA. More specifically, gray scale levels 2, 3, and 4, for example, are achieved by the diffusion of the weight 1 and the weight 5. In the fourth embodiment, the circuit is simplified by reducing the number of divided regions compared with the previously described second embodiment. That is, in the fourth embodiment, since the sub gain control circuit can be constructed using a similar configuration to the sub gain control circuit of the previously described first embodiment, the sub gain control circuit of the first embodiment and the sub gain control circuit of the fourth embodiment can be implemented using the same circuit but by changing the parameter. Further, since the parameter is approximated by the coefficient (n−1)/(m−1), the linearity of the display gray scale can be improved.

The relationship between the subfields SF1 to SF10 and the weights, stored in the SF weight table 33 according to the fourth embodiment, is the same as that previously shown in Table 2, and therefore, the weights are multiplied by 1.25 (⅝). That is, the gray scale (number of gray scale levels: 148) resulting from the multiplication by ⅘ in the sub gain control circuit of the fourth embodiment is multiplied by ⅝ and thus converted back to the original gray scale (number of gray scale levels: 184) for display on the PDP 4.

FIGS. 45 to 49 are diagrams for explaining the operation of the sub gain control circuit shown in FIG. 43, and illustrate how the input signal AA with 184 gray scale levels input to the sub gain control circuit 113 is output as the output signal BB with 148 gray scale levels by selecting the path P41 or the path 42 in accordance with the output of the remainder calculation circuit 370, and how the output signal BB is converted back to the image signal with 184 gray scale levels in accordance with the SF weight table 33.

Figure 50B:
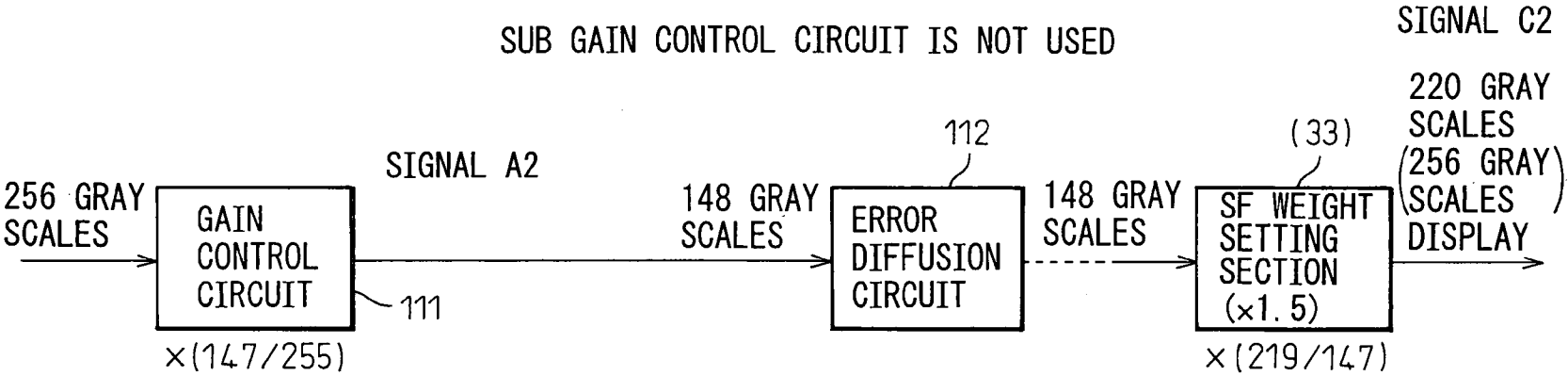

FIG. 50 is a block diagram of essential portions, showing a comparison between the configuration in which the sub gain control circuit is used and the configuration in which the sub gain control circuit is not used in the plasma display apparatus: FIG. 50A shows the case in which the sub gain control circuit is used, and FIG. 50B shows the case in which the sub gain control circuit is not used.

First, when the sub gain control circuit 113 is used, as shown in FIG. 50A, the input image signal, for example, with 256 gray scale levels, is multiplied by 219/255 in the gain control circuit 111 and thus converted (compressed) to the first intermediate image signal A1 (the first intermediate image signal AA) with 220 gray scale levels, which is supplied to the sub gain control circuit 113. In the sub gain control circuit 113, as previously described with reference to FIGS. 19 to 26, the first intermediate image signal A1 with 220 gray scale levels is multiplied by ⅔ (147/219) and thus converted to the second intermediate image signal B1 (the second intermediate image signal BB) with 148 gray scale levels, which is supplied to the error diffusion circuit 112. Here, the fractional part resulting when the input image signal with 256 gray scale levels is multiplied by 219/255 in the gain control circuit 111 is passed through the sub gain control circuit 113 to the error diffusion circuit 112 where error diffusion is applied to it. Further, the fractional part of the second intermediate image signal B1 resulting when the first intermediate image signal A1 with 220 gray scale levels is multiplied by ⅔ in the sub gain control circuit 113 (the processing similar to that described with reference to FIGS. 19 to 26) is also passed to the error diffusion circuit 112 where error diffusion is applied to it.

Then, the output signal of the error diffusion circuit 112 (with 148 real gray scale levels) is converted (expanded) to an image signal C1 with 220 gray scale levels by multiplying the number of gray scale levels by 1.5 (3/2) in the SUS weight setting section (for example, the conversion table stored in the SF weight table 33 in FIG. 1, the number-of-SUSs setting circuit 34, and the controller 35). Here, the image signal C1 with 220 gray scale levels resulting from the multiplication by 3/2 in the SF weight setting section contains data obtained by error diffusion in the error diffusion circuit 112, and the PDP 4 thus simulates a 256-gray-scale display.

On the other hand, when the sub gain control circuit is not used, as shown in FIG. 50B, the input image signal, for example, with 256 gray scale levels, is multiplied by 147/255 in the gain control circuit 111 and thus converted to the intermediate image signal A2 with 148 gray scale levels, which is supplied to the error diffusion circuit 112. Here, the fractional part resulting when the input image signal with 256 gray scale levels is multiplied by 147/255 in the gain control circuit 111 is passed to the error diffusion circuit 112 where error diffusion is applied to it.

Then, the output signal of the error diffusion circuit 112 (with 148 real gray scale levels) is converted to an image signal C2 with 220 gray scale levels by multiplying it by 3/2 in the SF weight setting section (33). Here, the image signal C2 with 220 gray scale levels resulting from the multiplication by 3/2 in the SF weight setting section contains data obtained by error diffusion in the error diffusion circuit 112, and the PDP 4 thus simulates a 256-gray-scale display.

FIGS. 51 to 60 are diagrams for explaining the effect of using the sub gain control circuit 113 in the plasma display apparatus according to the present invention. In FIGS. 51 to 60, COMPUTATION (1) in the column of "WITH SUB GAIN CONTROL CIRCUIT" corresponds to the computation in the path P11 in FIG. 19, that is, B1=A1−[A1/3], while COMPUTATION (2) corresponds to the computation in the path P12 in FIG. 19, that is, B1=(A1+[A1/3]+1)/2, and the output of the path P11 or the path P12 is selected depending on whether the signal A1 is exactly divisible by 3 or not. In the case of not using the sub gain circuit, the difference between the first intermediate image signal A1 and the output image signal C2 is taken as the error of the output signal accuracy to consider the error with respect to the 220-gray-scale signal.

As can be seen from FIGS. 51 to 60, when the parameter of the gain control circuit 111 is changed so that the input image signal with 256 gray scale levels is multiplied by 147/255 in the gain control circuit 111, and the resulting intermediate image signal A1 with 148 gray scale levels is supplied to the error diffusion circuit 112 whose output signal is supplied to the SF weight setting section (33) as shown in FIG. 50B, information loss (signal loss) occurs due to the signal compression performed in the gain control circuit 111.

That is, when the sub gain control circuit is used as shown in FIG. 50A, the error of the output signal accuracy (A1-C1) is zero at every gray scale level, which means that no error occurs between the input signal (the first intermediate image signal A1) and the output image signal C1 (the input signal is completely reproduced), but in the case of FIG. 50B that does not use the sub gain control circuit, an error occurs in the output signal accuracy (A1-C2) at each gray scale level, the error accumulating as much as to 70.42 gray scale levels.

In this way, the display apparatus according to the present invention is essentially different from the prior art in which the parameter of the gain control circuit is simply changed. It will also be noted that the present invention is not limited in application to plasma display apparatuses, but is also applicable to any other display apparatus that expresses luminance by varying light emission time length and achieves gray scale display by using a subfield method.

As described above, according to the present invention, a display apparatus and a display driving method that can effectively eliminate the occurrence of a moving image false contour can be provided without incurring a substantial increase in cost.

Many different embodiments of the present invention may be constructed without departing from the spirit and scope of the present invention, and it should be understood that the present invention is not limited to the specific embodiments described in this specification, except as defined in the appended claims.

What is claimed is:

1. A display apparatus that expresses luminance by varying light emission time length and displays gray scale by using a subfield method, comprising:

a main path outputting first display data having a number of gray scale levels N;

a sub path outputting second display data having a number of gray scale levels M, where M is less than N; and a switch circuit selecting and outputting either one of inputted said first data display data and said second display data in a unit of a pixel according to a result of a detected amount of motion, wherein the main path comprises a first gain control circuit reducing the number of gray scale levels, a second gain control circuit further reducing the number of gray scale levels from said first gain control circuit, and an error diffusion circuit performing error diffusion on an output signal of said second gain control circuit.

2. The display apparatus according to claim 1, wherein a fractional part of the output signal from said first gain control circuit is applied to said error diffusion circuit, as is, via said second gain control circuit, and said error diffusion circuit performs error diffusion based on the fractional part which is output from both of said first gain control circuit said second gain control circuit.

3. The display apparatus according to claim 2, wherein an output signal of an integer part from said second gain control circuit is output, so that same data is successively outputted with respect to said input signal with predetermined gray scale levels, which is different only by 1 when setting for light emission of an input signal to display in ascendant order.

4. The display apparatus according to claim 1, wherein a most heavily weighted subfield is set for light emission along with at least one other subfield.

* * * * *